US009631899B2

(12) United States Patent
Lebel et al.

(10) Patent No.: US 9,631,899 B2
(45) Date of Patent: Apr. 25, 2017

(54) BALLISTIC AND IMPACT PROTECTIVE MILITARY HELMET ASSEMBLY

(75) Inventors: Stéphane Lebel, St. Redempteur (CA); Edward R. Hall, Montreal (CA); Michael James McGinn, Montreal (CA); Dominic Giroux Bernier, Montreal (CA); Richard Coomber, Montreal (CA); Curtis Herman, Montreal (CA)

(73) Assignee: Revision Military S.a.r.l., Luxembourg (LU)

( * ) Notice: Subject to any disclaimer, the term of this patent is extended or adjusted under 35 U.S.C. 154(b) by 729 days.

(21) Appl. No.: 13/419,038

(22) Filed: Mar. 13, 2012

(65) Prior Publication Data

US 2012/0317706 A1 Dec. 20, 2012

Related U.S. Application Data

(60) Provisional application No. 61/452,462, filed on Mar. 14, 2011.

(51) Int. Cl.
*A42B 3/04* (2006.01)
*F41H 1/08* (2006.01)

(52) U.S. Cl.
CPC *F41H 1/08* (2013.01); *A42B 3/04* (2013.01)

(58) Field of Classification Search
CPC ..... A42B 3/04
USPC ..... 2/6.2–6.7, 422
See application file for complete search history.

(56) References Cited

U.S. PATENT DOCUMENTS

| | | | |
|---|---|---|---|
| 3,956,447 | A | 5/1976 | Denommee et al. |
| D242,088 | S | 11/1976 | Durand et al. |
| 4,181,768 | A | 1/1980 | Severin |
| 4,233,687 | A | 11/1980 | Lancellotti |
| 4,457,985 | A | 7/1984 | Harpell et al. |
| 4,536,892 | A | 8/1985 | Brinkhoff et al. |
| 4,737,402 | A | 4/1988 | Harpell et al. |

(Continued)

FOREIGN PATENT DOCUMENTS

WO WO 2011/028966 A2 3/2011

OTHER PUBLICATIONS

Invitation to Pay Additional Fees for International Application No. PCT/CA2012/050154 mailed Apr. 25, 2012.

(Continued)

*Primary Examiner* — Katherine Moran
(74) *Attorney, Agent, or Firm* — Wolf, Greenfield & Sacks, P.C.

(57) ABSTRACT

A helmet assembly is provided including a front mount configured to attach to the front of the helmet above a brim of the helmet, a mandible for protecting a portion of the user's face, a lower edge rim mounting portion such as a halo attached along the lower edge of the helmet for securing the mandible to a helmet and providing power and data conduits. The front mount provides a center top mounting arrangement that operatively connects a center top location of the face shield to a center front mount on the helmet. The mount provides frontal bracket portions for mounting accessories. The helmet assembly provides a helmet shell with a curved shape having a surrounding reinforcing ridge. A reeling system is provided for adjusting front and lower chin straps. Other improvements in helmet assemblies are also disclosed.

25 Claims, 55 Drawing Sheets

(56) References Cited

U.S. PATENT DOCUMENTS

| | | | | |
|---|---|---|---|---|
| 5,376,426 | A | 12/1994 | Harpell et al. | |
| 5,623,730 | A * | 4/1997 | Baudou et al. | 2/6.2 |
| 5,901,369 | A | 5/1999 | Pilney | |
| 6,029,269 | A | 2/2000 | El-Soudani | |
| 6,116,328 | A | 9/2000 | Karmarkar et al. | |
| 6,268,301 | B1 | 7/2001 | Dalman et al. | |
| 6,481,024 | B1 * | 11/2002 | Grant | A42B 3/08 2/421 |
| 6,820,285 | B2 | 11/2004 | Bataille et al. | |
| 7,219,370 | B1 * | 5/2007 | Teetzel et al. | 2/6.2 |
| 7,407,900 | B2 | 8/2008 | Cunningham | |
| 7,546,645 | B2 * | 6/2009 | Goodhand et al. | 2/424 |
| 7,665,149 | B2 | 2/2010 | Carbajal et al. | |
| 7,849,517 | B2 | 12/2010 | Rogers et al. | |
| 7,908,667 | B2 * | 3/2011 | Rogers et al. | 2/6.2 |
| 2009/0083890 | A1 | 4/2009 | Dempsey et al. | |
| 2009/0126059 | A1 | 5/2009 | Tack et al. | |
| 2009/0144872 | A1 * | 6/2009 | Lebel et al. | 2/6.7 |
| 2009/0224426 | A1 | 9/2009 | Micarelli | |
| 2009/0224427 | A1 | 9/2009 | Micarelli | |
| 2009/0307826 | A1 | 12/2009 | Rogers et al. | |
| 2010/0064405 | A1 * | 3/2010 | McGovern | 2/6.7 |
| 2010/0083413 | A1 * | 4/2010 | McGovern | A42B 3/04 2/6.6 |
| 2010/0091377 | A1 * | 4/2010 | Hedges et al. | 359/630 |
| 2010/0108255 | A1 | 5/2010 | Micarelli | |
| 2012/0177869 | A1 | 7/2012 | Micarelli | |
| 2012/0204331 | A1 | 8/2012 | Lebel et al. | |

OTHER PUBLICATIONS

International Search Report and Written Opinion for International Application No. PCT/CA2012/050154 mailed Jun. 8, 2012.

International Preliminary Report on Patentability for International Application No. PCT/CA2012/050154 mailed Sep. 26, 2013.

* cited by examiner

BALLISTIC AND IMPACT PROTECTIVE MILITARY HELMET ASSEMBLY

This application claims the benefit of U.S. Provisional Application 61/452,462, filed Mar. 14, 2011.

REFERENCE TO GOVERNMENT FUNDING

This invention was made with Government support under Contract No. W911QY-10-C-0121, awarded by the U.S. Army Material Command, a division of the United States Department of Defense. The Government has certain rights in this invention.

TECHNICAL FIELD OF THE INVENTION

The present invention relates to helmet assemblies having multiple components such as face shields, mandibles, or mouth guards and accessories.

BACKGROUND OF THE INVENTION

A number of protective and military helmets are known, such as the helmet known as the Advanced Combat Helmet (ACH), which was a successor to the Personnel Armor System Ground Troops (PASGT) such as shown in U.S. Pat. No. Des. 242,088. Further, military and law-enforcement helmets with face shields are known such as disclosed in U.S. Pat. Nos. 5,901,369 and 4,536,892. These face shields provide pivot arrangements on opposite lateral sides of the face shield to allow the face shield to be pivoted upward away from the user's face when the face shield is not deployed. The face shield is held in a deployed position in front of the user's face by locking of the pivot arrangements.

The present inventors recognize a need for a helmet with increased coverage, improved ballistic performance, improved impact performance, and improved freedom of movement. The inventors recognize a need for a helmet that has a closer conformity with the user's head and is lighter with improved equipment compatibility. The inventors further recognize a need for a redesign communication system to fit within their revised helmet having a closer conformity with a user's head.

The present inventors have recognized that it would be desirable to provide a helmet assembly with an improved attachment system for attaching a face shield, a mandible, goggles, heads-up displays, GPS units, batteries, communication systems, and other accessories.

The present inventors also recognize that it would be desirable to provide an attachment system that was quickly and easily installed onto, or removed from, a helmet. The present inventors recognize a need for the lower edge of the helmet to carry power and/or data over one or more conduits.

The present inventors recognize a need for a helmet with anchor mounts formed in the helmet shell and thereby eliminate the need for through holes that are generally found in certain prior art helmets for mounting accessories.

Some prior art helmet strap systems have as many as five buckles or points of adjustment for adjusting the various straps used to secure the helmet to a user's bead. The inventors recognized a need to eliminate the several buckle strap adjustments of the prior helmet strap systems. The present inventors recognize a need for improved helmet retention system that reduces complexity and one in which a user may operate with only one hand.

The present inventors further recognize a need for a face guard or mandible that provides access to a user's mouth. Further, the present inventors recognize a need for a mandible that is removable with one hand by a centrally located release mechanism.

SUMMARY OF THE INVENTION

An exemplary embodiment of the invention provides a helmet assembly including a front mount configured to attached to the front of the helmet above a brim of the helmet, a mandible for protecting a portion of die user's face, an accessory-mounting rim portion, such as a "halo", attached along die lower edge of the helmet for securing the mandible to a helmet and providing power and data conduits, and attachment location for other accessories.

In one embodiment, the helmet assembly includes a face shield and the front mount provides a center top mounting arrangement that operatively connects a center top location of the face shield to a center front mount on the helmet. The face shield can be raised and lowered about a pivot axis provided in the mounting arrangement between a tilted up, non-use position and a lowered, deployed position.

In one embodiment, the front mount includes left and right bracket portions that extend laterally across a portion of the front of the helmet adjacent to the brim. The bracket portions have edge lips on sides of the bracket portion for retaining an accessory. The edge lips can be upper and lower edge lips that extend vertically toward each other. Each bracket portion has a rearward extending lateral accessory engagement portion for attachment of accessories, such as an LED.

In one embodiment, the helmet assembly has a helmet that includes a right and left ear coverage areas, an upper portion, a stiffening ridge, a rear portion, and a bottom edge. The rear coverage areas are connected to the upper portion on opposite lateral sides. The rear portion is connected to the upper portion at the rear of the helmet shell. The stiffening ridge joins the each ear coverage area with the upper portion. The stiffening ridge also joins the rear portion with the upper portion.

The stiffening ridge offsets the upper portion from the left ear coverage area, the right ear coverage area, and the rear portion. The offset between the upper portion and rear portion is less than the offset between the upper portion and each of the ear coverage areas. The helmet can comprise at least two steps along the lower edge. The lower most portion of the rear portion is below the lower most portions of the ear coverage areas to provide increase head and neck protection in the rear. The helmet shell comprises an upper brim edge and the stiffening ridge bridges between the upper brim edge and the ear coverage areas at a front of the helmet. The stiffening ridge extends from the brim edge on a first side of the helmet continuously around the helmet to the brim edge on a second side of the helmet.

The helmet can have a center anchor, opposite lateral front anchors, and a rear anchor. Each anchor is formed on the outside surface of the helmet shell, therefore all helmet through-holes are eliminated. The center anchor and the rear anchor can be centered on the front-to-back midplane of the helmet.

The accessory-mounting rim portion, such as a halo, has at least two steps as shown from a side view that match the two steps of the lower helmet edge. Therefore, the accessory-mounting rim portion has a form the matches the continuous edge of the helmet along its circumference around the helmet.

In one embodiment, the accessory-mounting rim portion comprises a hook receiver and a locking pin recess for securing the mandible to the accessory-mounting rim portion. The hook receiver is located ahead of the locking pin recess. The accessory-mounting rim portion has a strike plate adjacent to the locking pin recess for buffering or absorbing contact between a pin of the mandible and the accessory-mounting rim portion before the pin engages the recess.

In one embodiment, the accessory-mounting rim portion comprises a power conduit, a computer data conduit, or both. The accessory-mounting rim portion may have a rear port for receiving a cable connection where the cable connection may be capable of carrying power or data or both.

In one embodiment, the helmet assembly has a battery configured to attach to the rear of the accessory-mounting rim portion and extend upward along the rear of die helmet. The battery may be in communication with the conduits of the accessory-mounting rim portion for powering accessories attached to the helmet.

In one embodiment, the helmet assembly has a GPS holder attached to the rear anchor.

In one embodiment, the mandible comprises right and left cheek protecting portions connected at the front by a mouth protecting portion and the mouth protecting portion has a front cover that is openable by a pivotal connection with die mouth protecting portion. The cover has a closed position for protecting a user, an open position for permitting access to a user's mouth, and a release position that actuates a release mechanism for releasing the mandible from connection to the lower edge accessory-mounting rim portion.

A mounting mechanism of the mandible has a book and a sliding pin at the rear of each of the left and right cheek protecting portions. The hook is configured to pivotally engage a hook receiver such as a hook, engaging element, a hole or a bar on the accessory-mounting rim portion and the pin is configured to engage a locking pin recess on die accessory-mounting rim portion. Tills arrangement provides a pivotal one hand attachment and detachment of the mandible from the accessory-mounting rim portion.

In one embodiment, the helmet assembly includes a heads-up display releasably securable to the bracket portion of the front mount. The beads-up-display may have a retractable display screen that is positioned inside the visor. The heads-up display may receive power and data from the conduit(s) of the accessory-mounting rim portion.

In one embodiment, the helmet assembly has a communications system with a pair of ear cups in signal communication with the accessory-mounting rim portion. The ear cups have a speaker and padding for providing a predefined level of ear protection from external sound sources. The ear cups have a reduced depth to be configured to fit between the conformal helmet shell and a user.

In one embodiment, the helmet assembly has a helmet retention system for securing the helmet to a user's head. The helmet retention system is adjustable by one hand. The retention system has a front chin contact strap for crossing the front of a user's chin, a lower chin contact strap for extending under a user's chin, a first reel rotatable to tighten or loosen the front chin contact strap, a second reel rotatable to tighten or loosen the lower chin contact strap. A first reeling strap connects the ends of the lower chin contact strap to the first reel, and a second reeling strap connects the ends of the front chin contact strap to the second reel. The first and second reels may be located on the accessory-mounting rim portion at the rear of the accessory-mounting rim portion.

In one embodiment, the helmet assembly has a goggle clip receiver mount attached to the rear of the accessory-mounting rim portion, A pair of goggle clips are connectable with securing straps of a goggle and the goggle clips are releasably securable within the goggle clip receivers to secure goggle straps around to the rear of the helmet. The goggle clip receiver mount may include a battery that is signal connected with the accessory-mounting rim portion.

In one embodiment, the helmet assembly has a night vision enhancing device releasably attached to the front mount. In one embodiment, the front mount has a center vent.

In one embodiment, the helmet assembly has a mask positionable under the helmet for covering a user's face to provide protection against chemical, biological, nuclear, or radiological exposure. The mask may be used with or without a balaclava positionable under the helmet.

Numerous other advantages and features of the present invention will become readily apparent from the following detailed description of the invention and the embodiments thereof, and from the accompanying drawings.

DETAILED DESCRIPTION

Figure 1:
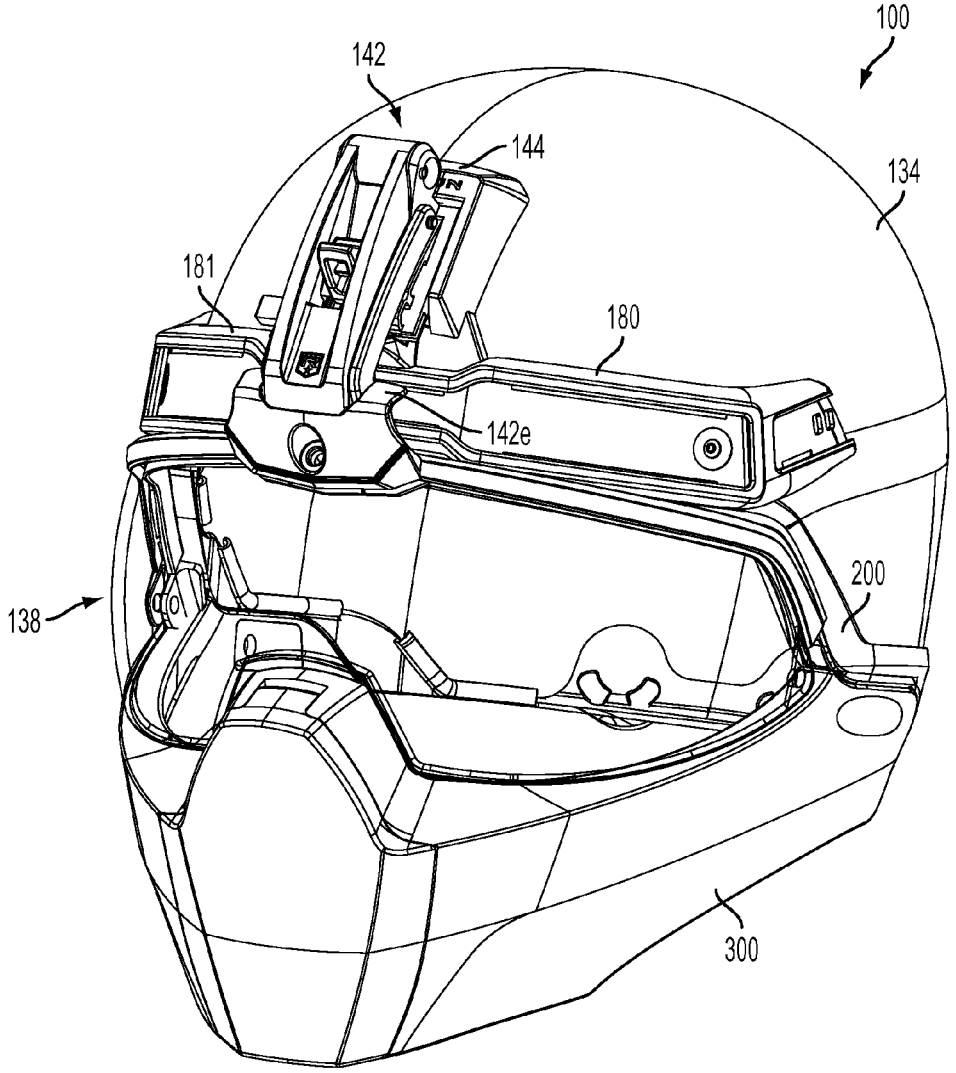
FIG. 1 is a perspective view of an exemplary embodiment of the helmet assembly of the invention.

While this Invention is susceptible of embodiment in many different forms, there are shown in the drawings, and will be described herein in detail, specific embodiments thereof with the understanding that the present disclosure is to be considered as an exemplification of the principles of the invention and is not intended to limit die invention to the specific embodiments illustrated.

For ease of description, the helmet assembly and associated apparatuses herein will be described generally according to an orientation where a wearer is wearing the helmet and facing in a forward direction. Thus, the helmet has a front and forward direction corresponding to the forward direction, a rear or back spaced from the front in an opposite rearward direction, opposite sides laterally spaced apart on a left and right of the front, an upper or top corresponding generally to a direction directed toward the sky and lower or bottom generally corresponding to a downward direction directed toward the ground.

It should be noted that the helmet assembly described herein is symmetrical across a vertical, front-to-back midplane 167 (FIG. 2) as evidenced by the figures and any description of a right side component will also describe the left side component as a mirror image thereof.

FIGS. 1-4 illustrate a helmet assembly 100 to be worn by a user or wearer 31 (FIG. 7) according to an exemplary embodiment of the invention. The helmet assembly includes a helmet 134, an accessory-mounting rim portion 200, such as a halo, attached to the lower edge of the helmet, a mandible operatively connected to the helmet by the accessory-mounting rim portion 200. A protective face shield, such as a transparent visor or transparent face shield 138 is also operatively connected to the helmet, substantially between a front of the helmet 134 and the mandible 300. A mounting arrangement 142 is operatively connected to the helmet 134 and to the face shield 138 which allows movement of the face shield 138 with respect to the helmet. The mounting arrangement 142 includes a shield mount 142*e* and a front helmet mount 144.

Helmet

Referring to FIGS. 5-10H the helmet 134 has a conformal shell that more closely matches the shape of a user's head as compared with prior art helmet 10, such as the traditional bell shaped helmets, including the ACH. A prior art helmet 10 is shown in FIGS. 11A-F. The bell shaped helmets get wider, as shown by directional arrows B in FIG. 11B, at the bottom with increased helmet size. This is in contrast to conformal shells of the helmet 134 which do not get wider at the bottom as the size of the helmet increases.

One reason why bell shaped helmets exist is that they are formed with a matching die set in a mold arrangement. The matching die set includes a male part and a female part, where the helmet is formed their between. A bell shaped helmet is required in such a mold otherwise the helmet could not be removed from the female shaped part of the mold—without great difficulty, if at all—because the conformal shape of the helmet was adhere to the female mold portion. However the conformal shell helmet 134 may be manufactured using a flexible bladder on at least one side of the mold so that the bladder may be collapsed after molding is complete and apart removed without any adherence problems to a female portion of the mold such as exists with match die type molds.

Figure 5:
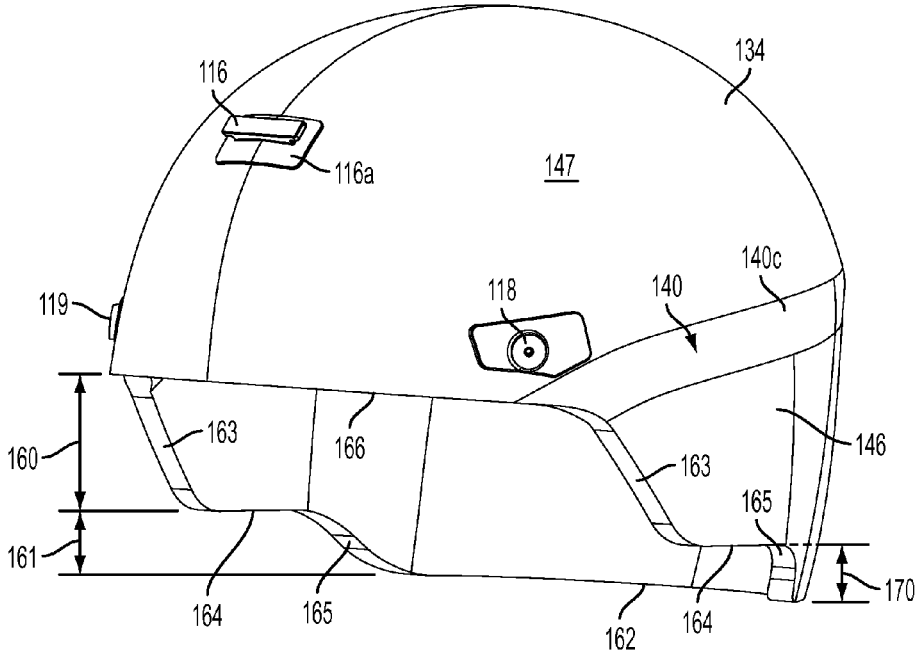
FIG. 5 is a perspective view of a helmet.
Figure 6:
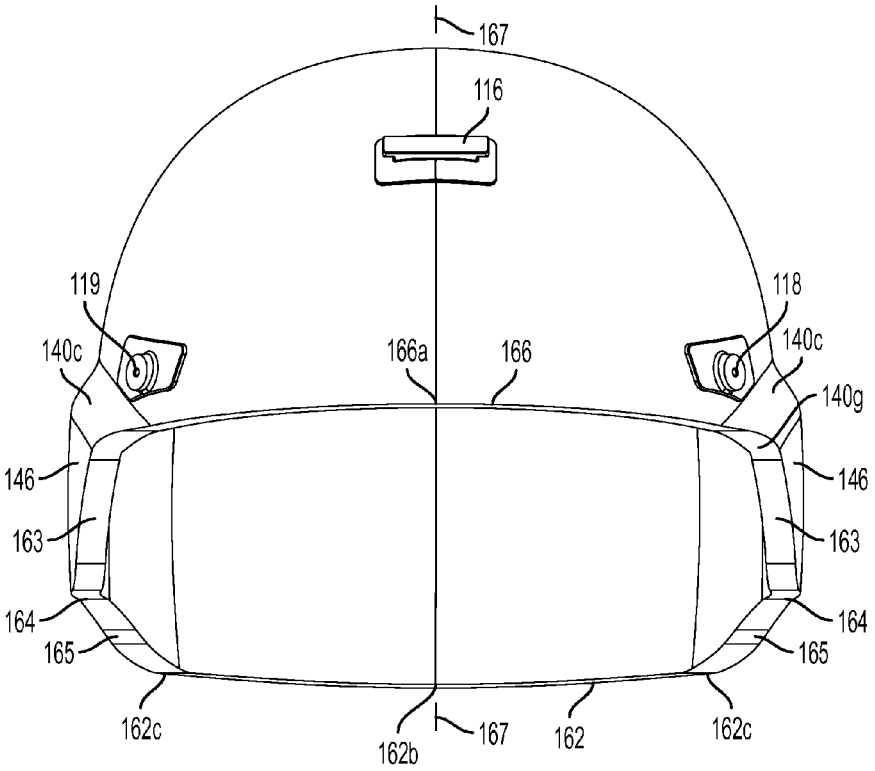
FIG. 6 is a front view of the helmet of FIG. 5.
Figure 7:
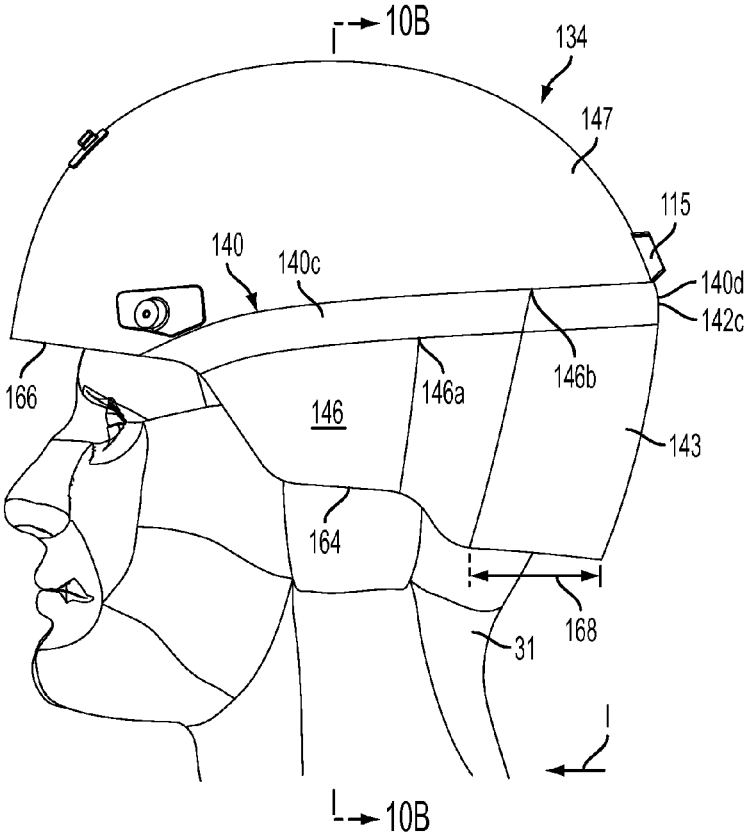
FIG. 7 is a left side view of the helmet of FIG. 5.
Figure 8:
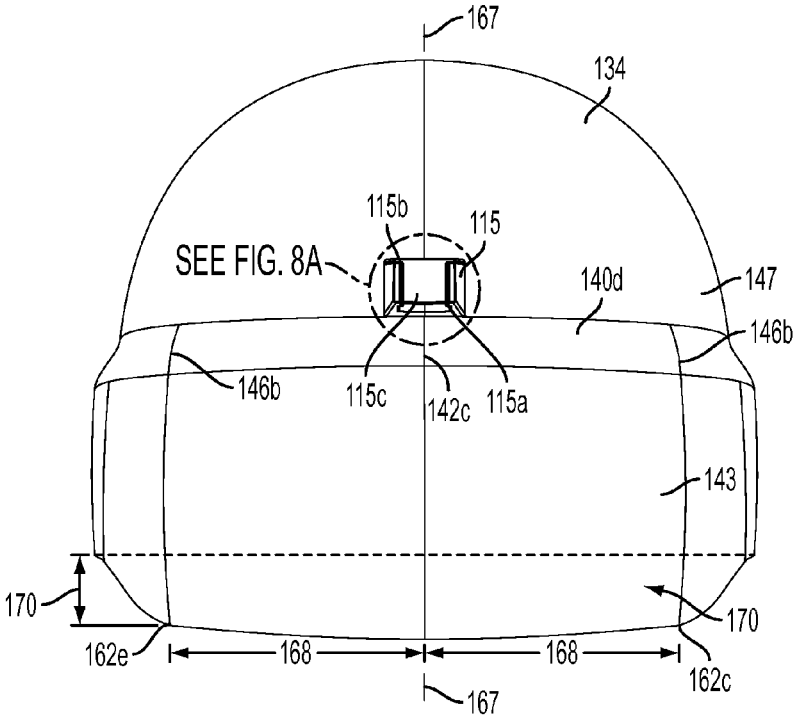
FIG. 8 is a rear view of the helmet of FIG. 5.

FIG. 5-10 shows the helmet 134 having, right and left ear coverage areas 146, an upper portion 147, a stiffening ridge 140, a lower rear portion 143, a bottom edge, and a plurality of anchors or mounts 115, 116, 118, 119. Although four mounts are shown, it is encompassed by the invention that one, two or three of the mounts are used. The ear coverage areas 146 and the lower rear portion 143 are contiguous with the upper portion 147 of the helmet via a stiffening ridge 140. The stiffening ridge 140 comprises opposite side stiffening ridge portions 140*c* and a rear stiffening ridge portion 140*d*. The rear stiffening ridge portion 140*d* extends between opposite rear stiffening ridge ends 146*b*. The side stiffening ridge portions 140*c* are continuous with the rear stiffening ridge portion 140*d*. The rear stiffening ridge 140*d* connects the lower rear portion 143 with the upper portion 147, as shown in FIGS. 7 and 8.

Figure 9:
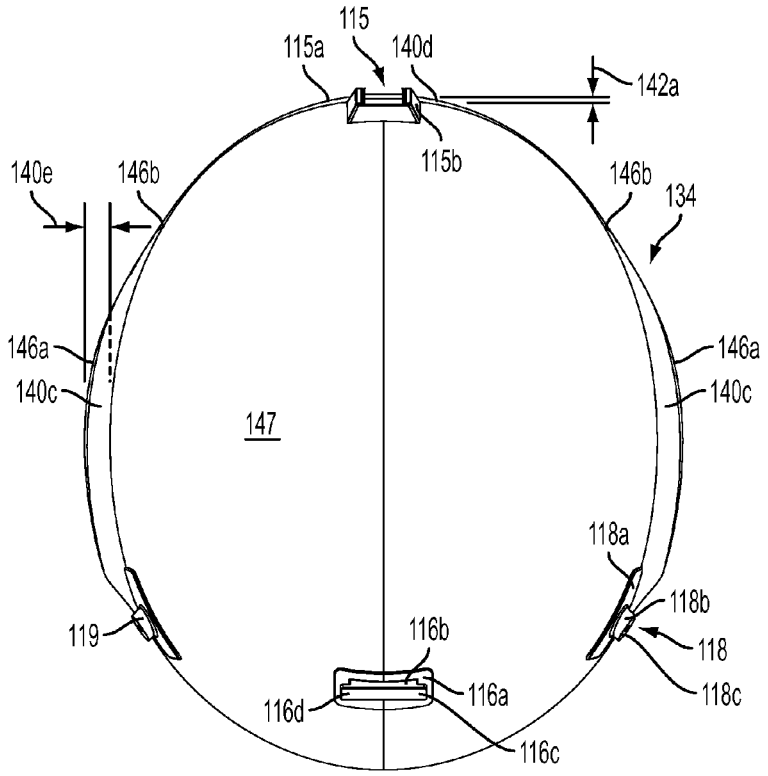
FIG. 9 is a top view of the helmet of FIG. 5.
Figure 10:
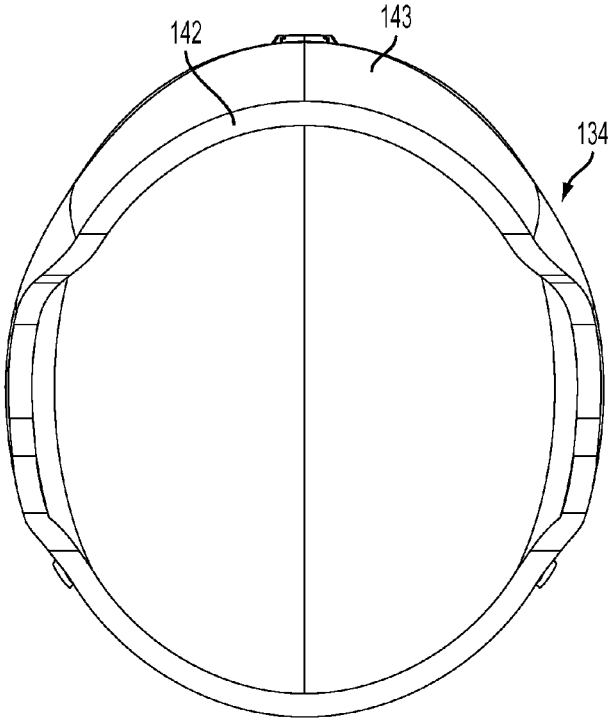
FIG. 10 is a bottom view of the helmet of FIG. 5.
Figure 10A:
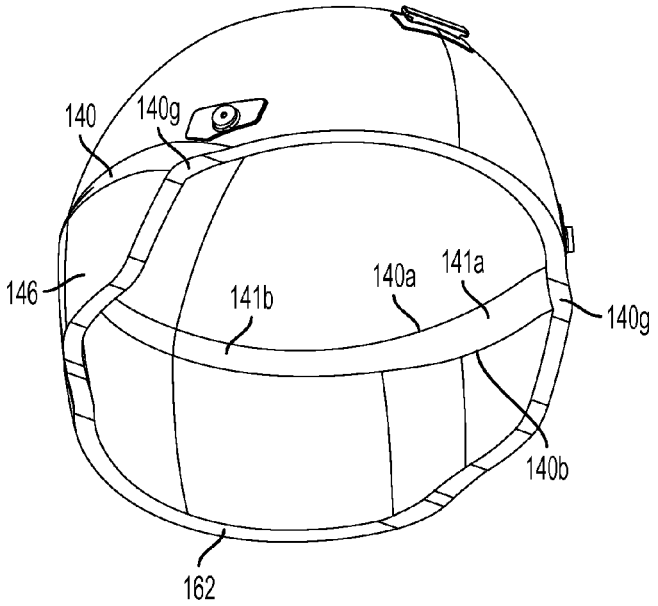
FIG. 10A is an alternate perspective view of the helmet FIG. 5.
Figure 10C:
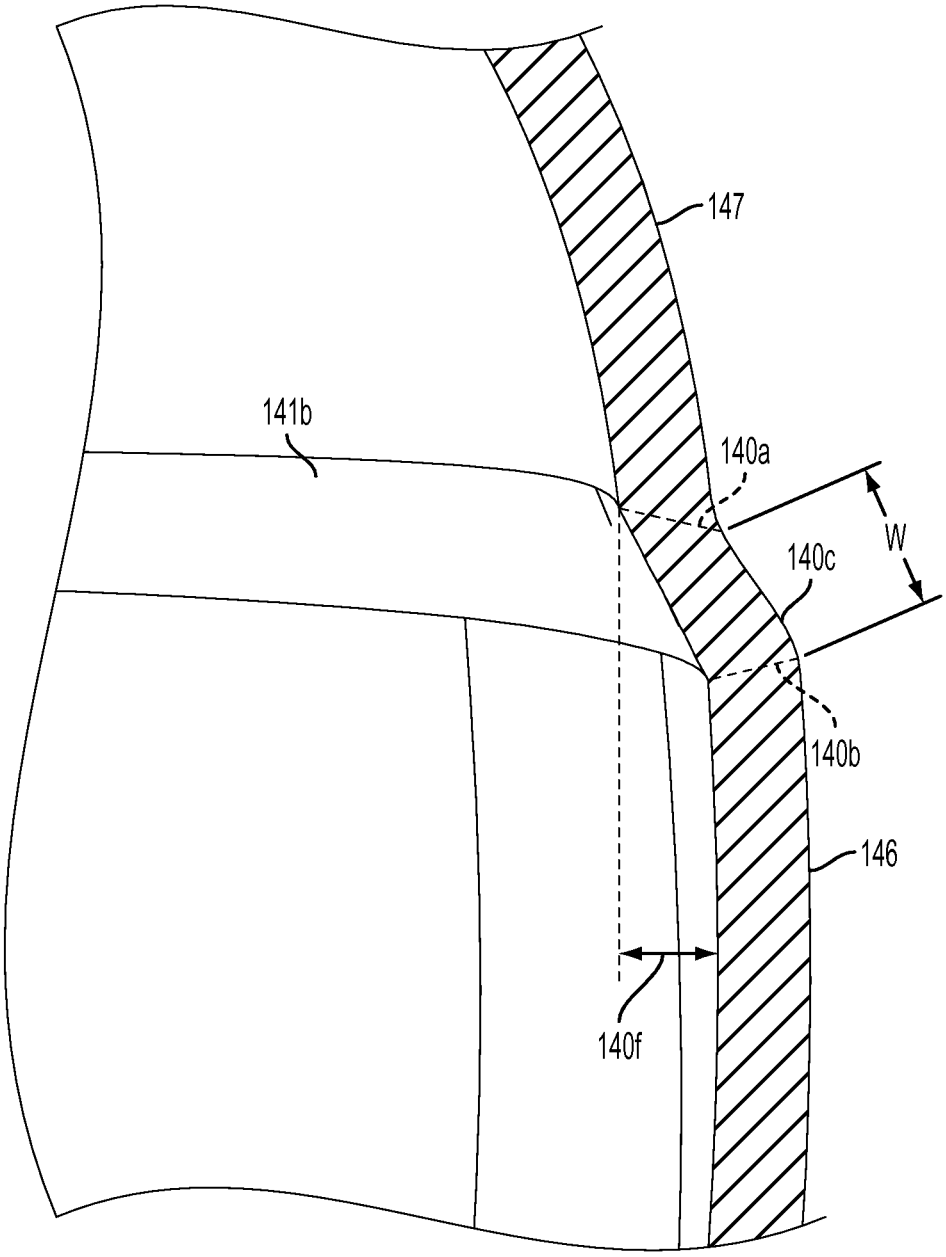
FIG. 10C is an exploded partial front sectional view of the helmet taken from FIG. 10B.
Figure 10D:
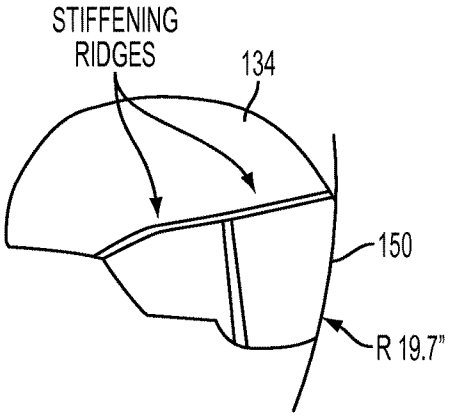
FIG. 10D is a left side perspective view of the helmet of FIG. 5.
Figure 10E:
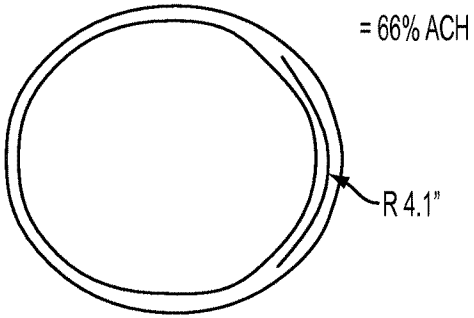
FIG. 10E is a bottom view of the helmet of FIG. 5.

The ear coverage areas provide addition space within the helmet to accommodate a user's ear and communication equipment that may be needed in the ear area. As shown in FIGS. 9, 10C, and 10G, an outside lateral offset 140*e* between an outside surface of the tipper portion 147 and an outside surface of the ear coverage areas 146 is greater than a rear outside offset 142*a* between an outside surface of the upper portion 147 and an outside surface of the lower rear portion 143. Similarly, the inside lateral offset 140*f* between inside surface of an upper portion 147 and inside surface of the ear coverage areas 146 is greater than rear inside offset 142*b* between the inside surface of the upper portion 147 and the inside surface of the lower rear portion 143.

The outside lateral offset 140*e* increases from the ends 146*b* toward the front of the helmet along the ear coverage areas to a max point in the ear coverage areas. The stiffening strength of the stiffening ridge 140 is enhanced by the fact that the side stiffening ridges 140*c* are contiguous and/or joined with the rear stiffening ridge 140*d*. The stiffening is achieved by the offset of the ear coverage areas 146 and the lower rear portion 143 from the upper portion 147.

Referring to FIGS. 5 and 6, the bottom edge of the helmet comprises a top eyewear area edge or upper brim edge 166, opposite eyewear area edges 163, opposite ear area lower recessed edges 164, opposite ear area to lower back edge transitions 165, and a lower back edge 162. The top eyewear area edge 166 is contiguous with the respective opposite eyewear area edges 163. The opposite eyewear area edges 163 are contiguous with the respective ear area lower recessed edges 164. The lower ear area to lower back edge transitions 165 are contiguous to the areas 164 and are contiguous with the lower back edge 162. FIG. 7 shows that his configuration results in the helmet having a two-step side profile created by the ear area lower recessed edges 164 and the lower back edge 162, Also, the stiffening ridge 140 has an upward slope from a top eyewear area edge 166 to the midplane 167 at the back of the helmet.

The side eyewear area edges 163 are recessed at a height and depth relative to the helmet to create compatibility with eyewear, such as goggles and visors, and to provide substantially an unobstructed view for the user. The maximum distance between the inside surface of the right ear coverage area 146 and the corresponding left ear coverage area 146 is less than the prior art ACH military helmet, improving conformity with a users head.

The helmet comprises an eyewear recessed area 160 and an under-ear recessed area 161. The eyewear recessed area 160 extends from the top eyewear area edge 166 to the bottom edge of the ear area lower edges 164. It will be understood that eyewear or visors may extend below the eyewear recessed area 160 when mounted to the helmet. The under-ear recessed area 161 extends from the ear area lower edge 164 to the lower back edge 162.

Referring to FIGS. 6-8, the top eyewear area edge 166 slopes upward from the opposite stiffening ridges 140*c* to the center 166*a* of the top eyewear area edge 166 at the midplane 167. The lower back edge 162 slopes downward from the ends 162*c*, 162*e* of the lower back edge transitions downward toward a center 162*b* of the lower back edge at the midplane 167. The center 162*b* is the vertically lowest point of the helmet when upright standard position. A span 168 exists between the ends 162*c*, 162*e* and the center 162*b*. The distance between the ends 162*c* and 162*e* is greater than the distance between the opposite ends 146*b* of the rear stiffening ridge portion 140*d*.

As shown in FIGS. 5, 7, 8, and 10F, the rear portion 143 of the helmet has a bottom band or portion 170 extending across the back of the helmet that corresponds to the under-ear recessed area 161. The bottom portion 170 is the portion of the rear portion 143 that extends below the ear area lower recessed edge 164. The bottom portion 170 provides addition rear head and neck protection.

Figure 11A:
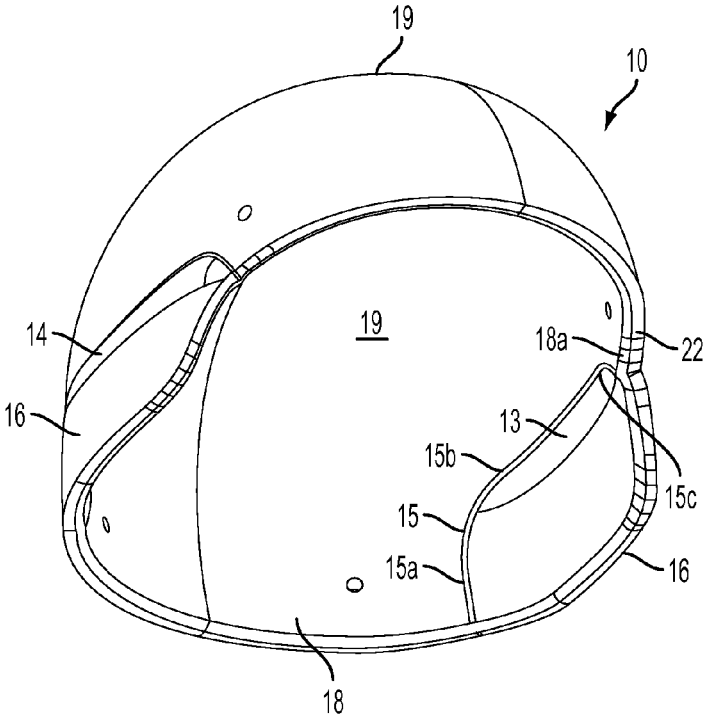
FIG. 11A PRIOR ART
FIG. 11A is a right side perspective view of a prior art helmet.
Figure 10B:
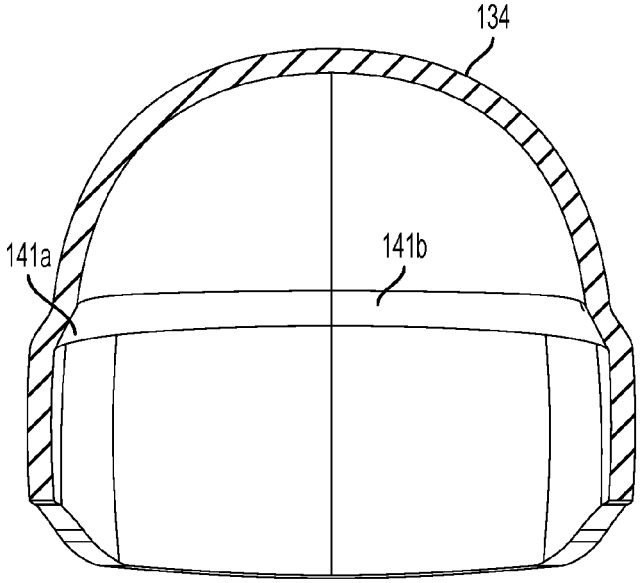
FIG. 10B is a front sectional view of the helmet of FIG. 5 taken along the line 10B-10B of FIG. 7.
Figure 11B:
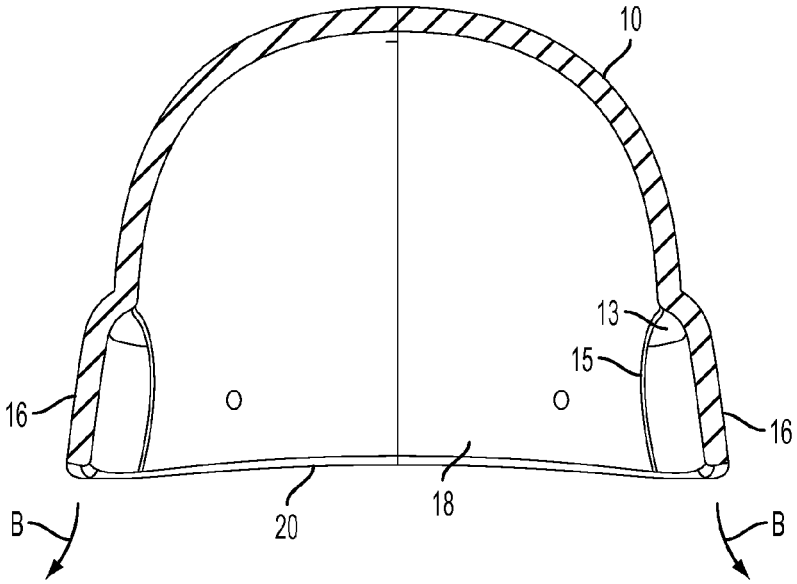
FIG. 11B PRIOR ART
FIG. 11B is a front sectional view of the helmet of FIG. 11A.
Figure 11C:
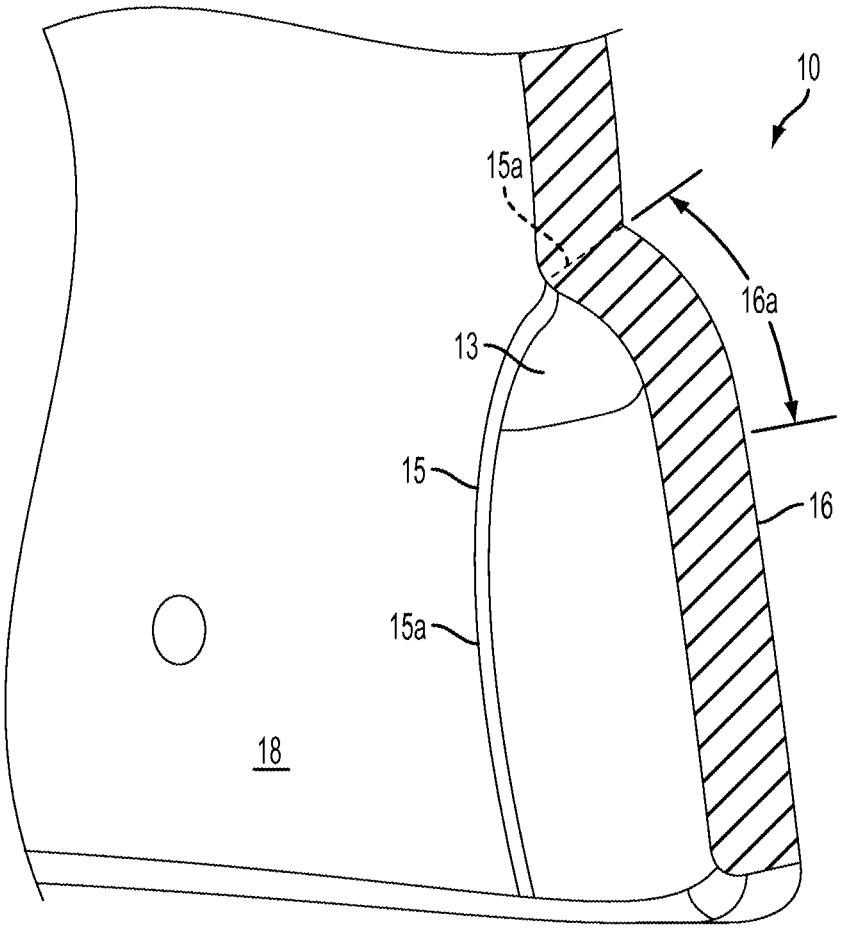
FIG. 11C PRIOR ART
FIG. 11C is an exploded partial front sectional view of the helmet taken from FIG. 11B.
Figure 11D:
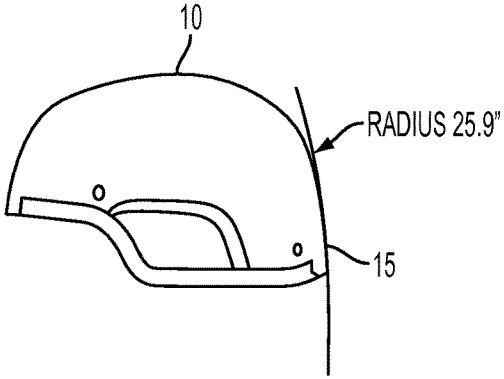
FIG. 11D PRIOR ART
FIG. 11D is a left side perspective view of the helmet of FIG. 11A.
Figure 11E:
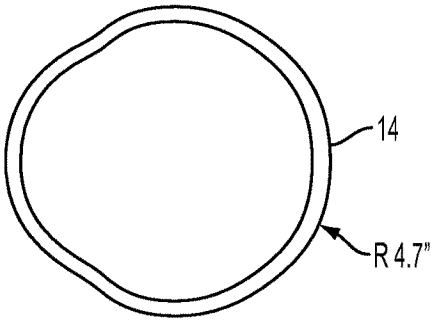
FIG. 11E PRIOR ART
FIG. 11E is a bottom view of the helmet of FIG. 11A.
Figure 11F:
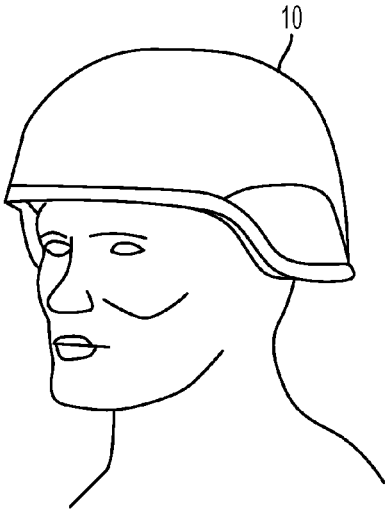
FIG. 11F PRIOR ART
FIG. 11F is a left side perspective view of the helmet of FIG. 11A.
Figure 10F:
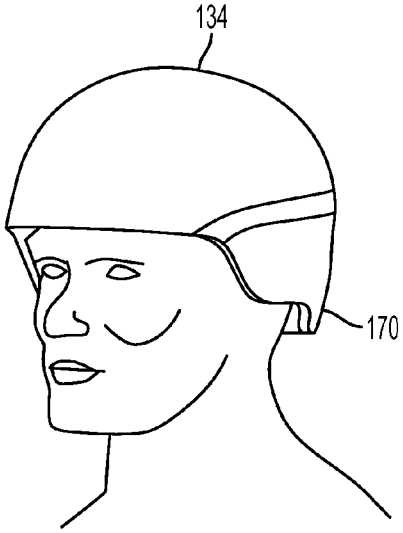
FIG. 10F is a left perspective view of the helmet of FIG. 5.
Figure 10G:
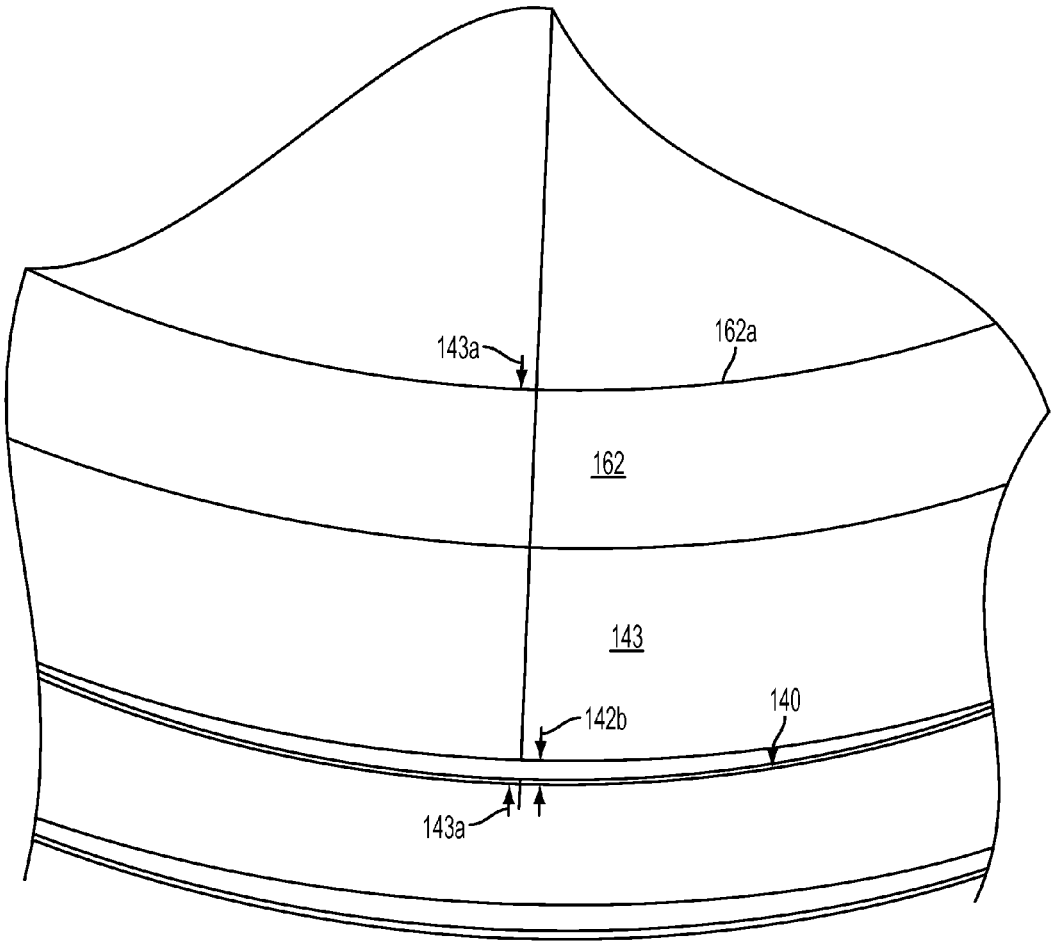
FIG. 10G is an exploded transparent bottom view of the rear of the helmet of FIG. 5 at the midplane with the transparent image of the rear mount removed for clarity.

As shown in comparison FIGS. 10F and 11F, die helmet 134 extends further down the neck of die wearer with die bottom portion 170 than the depicted prior art helmet.

As shown in FIGS. 7, 10, and 10G, die rear portion 143 has an inward curve toward the user in the direction I as the rear portion 143 extends downward from the rear stiffening ridge portion 140*d* to an inner back face 162*a* at the lower back edge 162. The inward curve provides for an offset 143*a* between the stiffening ridge and the inner back face 162*a* of the lower back edge 162.

The arc of the upper portion 147 meets the arc of the rear portion 143 in the rear stiffening ridge portion 140*d* at the rear most point 142*c*. The rear most point 142*c* of the helmet, when in the upright standard position, is located at the rear of the helmet in the stiffening ridge 140*d*. The rear most point 142*c* is located above the top eyewear area edge 166 when the helmet is in the upright standard position, as shown in FIG. 7. The rear stiffening ridge 140*d* at the midplane 167 is located above the top eyewear area edge 166 when the helmet is in the upright standard position. Therefore the rear portion 143 extends vertically from above top eyewear area edge 166 downward.

The location of the user ear recessed area is provided to allow situational awareness. The situational awareness is achieved by a closer conformity of the helmet 134 to the user's head as well as the extent to which the ear coverage areas 146 extend downward. Each of these attributes allows a user to detect activity in the peripheral part of their vision where that vision is not blocked by the helmet. The bottom portion 170 extends below the ear area lower edges 164 and provides additional protection to the head and neck area, while maintaining the needed amount of freedom of movement with respect the user's head. The bottom portion 170 extends laterally from the midplane 167 to the point where the ear area-to-lower back edge transitions 165 begin. Therefore, the bottom portion 170 extends around a user's neck to include a portion of the side of the user's neck as shown in FIG. 7.

In one embodiment, as shown in FIG. 10D, the rear portion 143 of helmet has a vertical radius 150 of about 19.7 inches. The slope of the rear portion has an inward trajectory with respect to the center of the helmet 134. As shown in FIG. 11D, at least one version of a prior art helmet has a rear portion with a vertical radius of about 25.9 inches. The slope of the rear portion has an outward trajectory with respect to the center of the helmet 10.

In one embodiment, as shown in FIG. 10E, the lower back edge 162 of the helmet 134 has a horizontal radius 148 of 4.1 inches. At least one version of the prior art helmet 10 has a lower edge with a horizontal radius of 4.7 inches.

In one embodiment, the area between the inside surface of the helmet 134 and an exemplary user's head is 0.162 square feet, whereas the area between the same exemplary user's bead and the inside surface of the helmet 10 is 0.200 square feet.

Figure 10H:
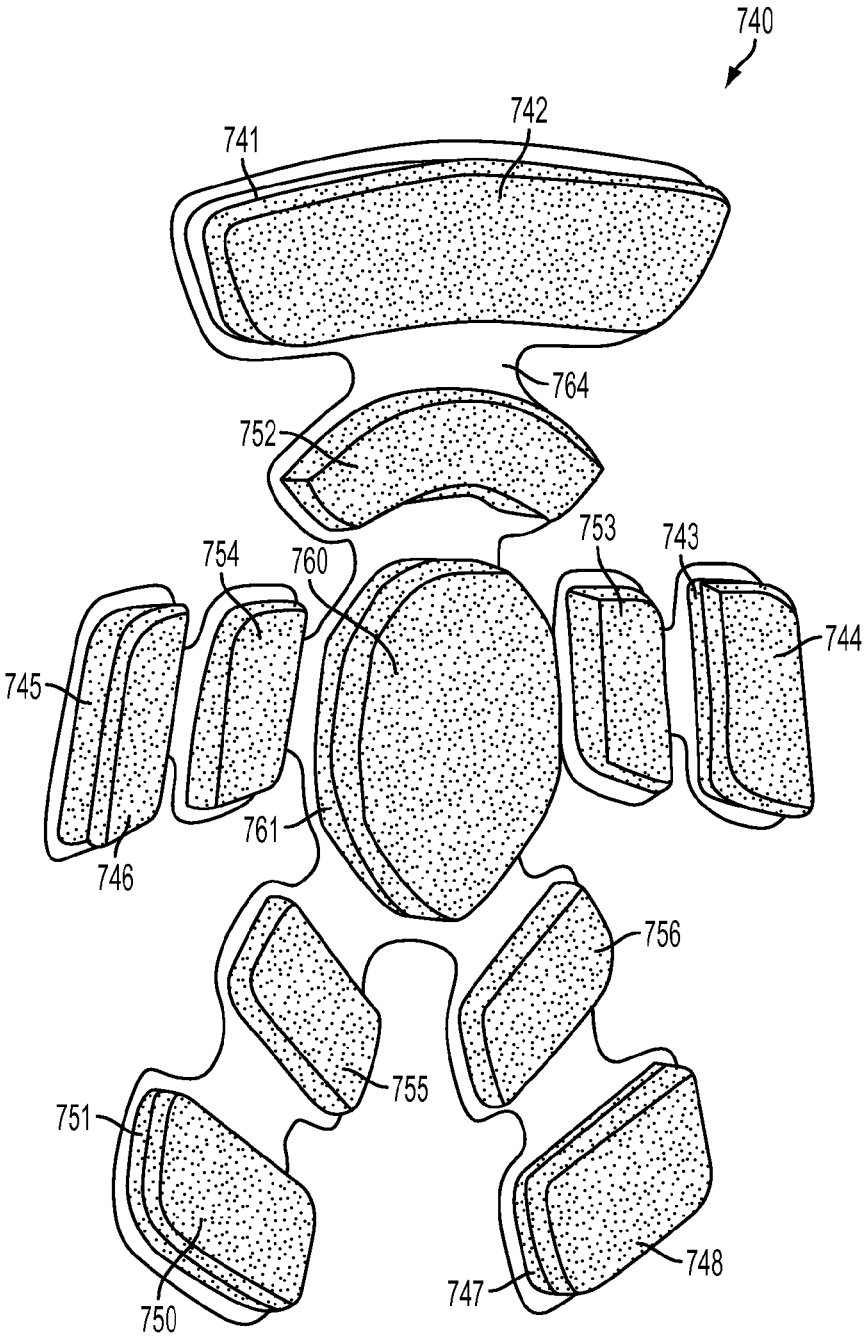
FIG. 10H is a perspective view of a padding for a helmet.

The inside surface of the helmet 134 is offset from a users head by about 0.75 inches. A padding 740, shown in FIG. 10H, provided on the inside of the helmet 134 creates the offset between the user's head and the inside surface of the hard portion of the helmet 134 when worn by a user. The padding may comprise an energy absorbing material 741, 743, 745, 747, 751, 761 and a comfort enhancing material 742, 744, 746, 748, 750, 760 such as a closed cell foam. In one embodiment, the energy absorbing material comprises one half inch in thickness, and the comfort enhancing material comprises a one fourth inch in thickness. The energy of absorbing material is attached to a carrier base 764 creating a one piece design that can be efficiently manufactured and installed. The carrier based may comprise fabric. The comfort enhancing material is mounted on, such as being adhered to, a top of the energy absorbing material.

Padding is provided in a forehead contact region 741, 742, two lateral side contact regions 744, 743, 746, 745, and two rear contact regions 748, 747, 750, 751. The lateral side contact regions are smaller than the forehead contact region as well as the rear contact regions. A top head central contact region 760, 761 is positioned substantially centrally with respect to the forehead contact region, the lateral side contact regions, and the rear contact regions. However, it is not required that the top head contact region may be located centrally. A forward intermediate region 752 is located on the carrier base 764 between the forehead region and the top contract region. Side intermediate regions 753,754 are located on the carrier base 764 between the opposite lateral side regions 744, 746 and the central region 760, respectively. Rear intermediate regions 755, 756 are located on the carrier base 764 between the two rear contact regions 748,750 and the central region 760, respectively.

The padding 740 forms a substantially star shape when laid flat. The carrier base material 764 of the padding 740 is flexible to conform the padding to the inside surfaces of the helmet when the padding is installed. The backside of the base material 764 may include an adhesive to secure the padding to the inside surface of the helmet 134.

The offset provided by the padding between the helmet and the user's head improves blunt force impact performance of the helmet as well as the backface deformation performance of the helmet. Backface deformation may be understood as the effect of a non-penetrating projectile on the rear face of a strike plate or surface being struck by the projectile.

Referring to FIGS. 5-10, the helmet has a plurality of anchors or mounts 115, 116, 118, 119, including an upper center anchor 116, rear anchor 115, and a font left anchor 118 and an opposite front right anchor 119. The anchors may be used to connect brackets, or accessories to the helmet. The anchors are formed into the helmet during manufacture and are permanently affixed to the helmet. This formation process eliminates the necessity of any through-holes through the shell of the helmet 134. The center anchor 116 has a base 116*a* and a T-projection 116*b* extending from the base. The T-projection 116*b* having left and right overhangs 116*c*, 116*d*. The right and left anchors are mirror image identical so only one will be described in detail. The left anchor 118 has a base 118*a* and a circular raised formation 118*b* having a top surface with a hole 118*c*. The hole may be threaded to receive a screw or bolt. In another embodiment, the anchors may comprise any type of connector, such as a snap connector, a rivet connection, an eyelet connection, a hook connection, etc.

Figure 8A:
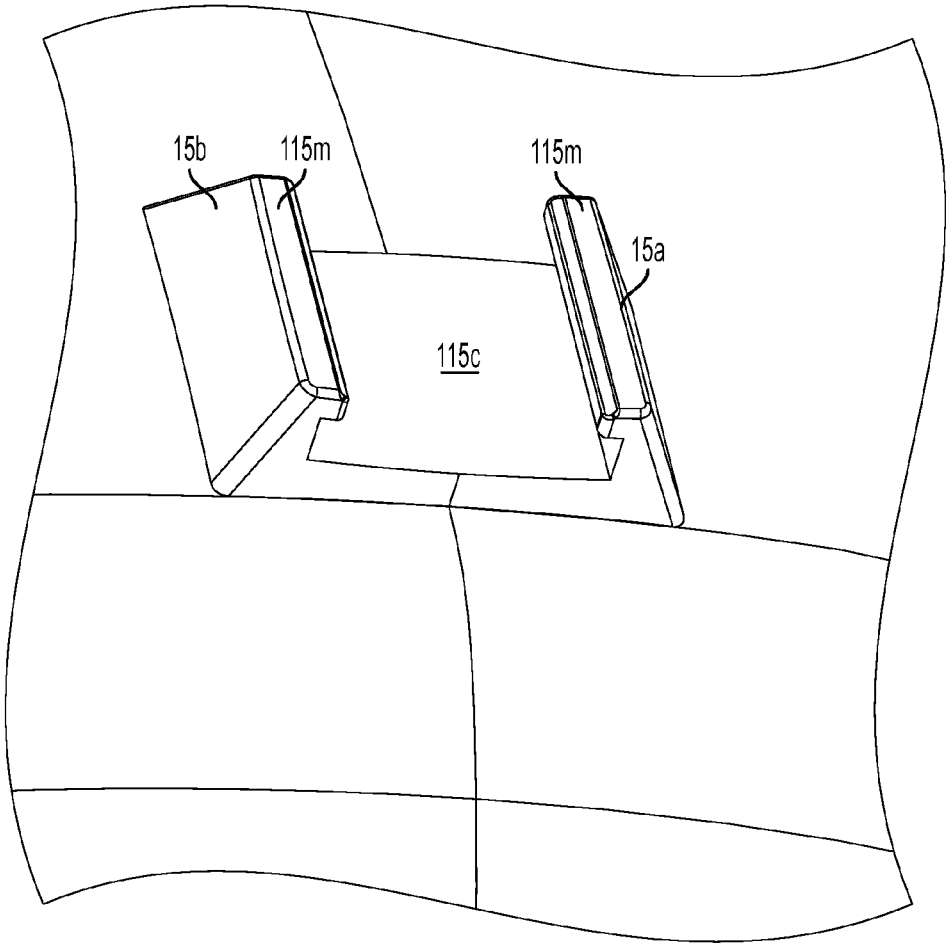
FIG. 8A is an enlarged fragmentary perspective view taken from FIG. 8.

The rear anchor 115 is shown more clearly in FIG. 8A. The rear anchor 115 is located above the rear stiffening ridge 140*d* and is centered about the midplane 167. Anchor 115 comprises a recess center channel 115*c* with an open top and bottom, adjacent opposite resilient right and left side claws 115*a*, 115*b* for retaining accessories to the anchor. Accessories can either be slid underneath the overhang portions 115*m* of the claws from above or below wherein the claws would overlying portions of the accessory with the overhang portions 115*m*, or the claws can be configured to resiliently separate from each other while an accessory is pressed forwardly onto the mount 115 wherein the claws would then snap back with the overhang portions 115*m* overlying portions of the accessory.

Prior art helmet 10 is shown in FIGS. 11A through 11F. The ACH helmet 10 has right and left ear bulges 16 that join with the main helmet shell portion 19. The helmet has a transition 15 that runs along the intersection of the ear bulge 16 and the main helmet shell portion 19. In FIGS. 11B and 11C, a cross-section view is provided of the transition 15. The outer ear bulge has a substantially continuous curve towards the main helmet shell portion 19 through a first curve area 16*a*. The transition 15 extends about the ear bulge 16 in a back portion 15*a*, in a top portion 15*b*, and in a front portion 15*c* as shown in FIGS. 11A and 11C.

As shown in FIG. 11A, the ear bulges 16 of the helmet 10 terminate before reaching the front edge of the helmet at an upper front area 18*a*. Therefore the front portion 15*c* of the transition 15 has a downward curve leaving the upper front area 18*a* to join the ear bulge to the front upper edge 22.

Referring to FIG. 10C, the helmet 134 has two angled transition areas 140*a*, 140*b* between the ear coverage areas 146 and the upper portion 147 of the helmet. The stiffening ridge 140 is a band that can have a substantially consistent width W between the two transition areas 140*a*, 140*b*. The transition area 140*b* enables the ear coverage areas to achieve a closer conformity with the use's head. Further, the stiffening ridge 140 extends to intersect the front top eyewear area edge 166 and the ear coverage areas. At the place of intersection between the stiffening ridge 140 and the front top eyewear area edge 166, the stiffening ridge face 140*g* of the stiffening ridge forms a portion of the front top eyewear area edge 166 (FIG. 10A), The stiffening ridge face 140*g* comprises a transition between the front top eyewear area edge 166 and the side eyewear area edges 163.

Front Mount

Figure 2:
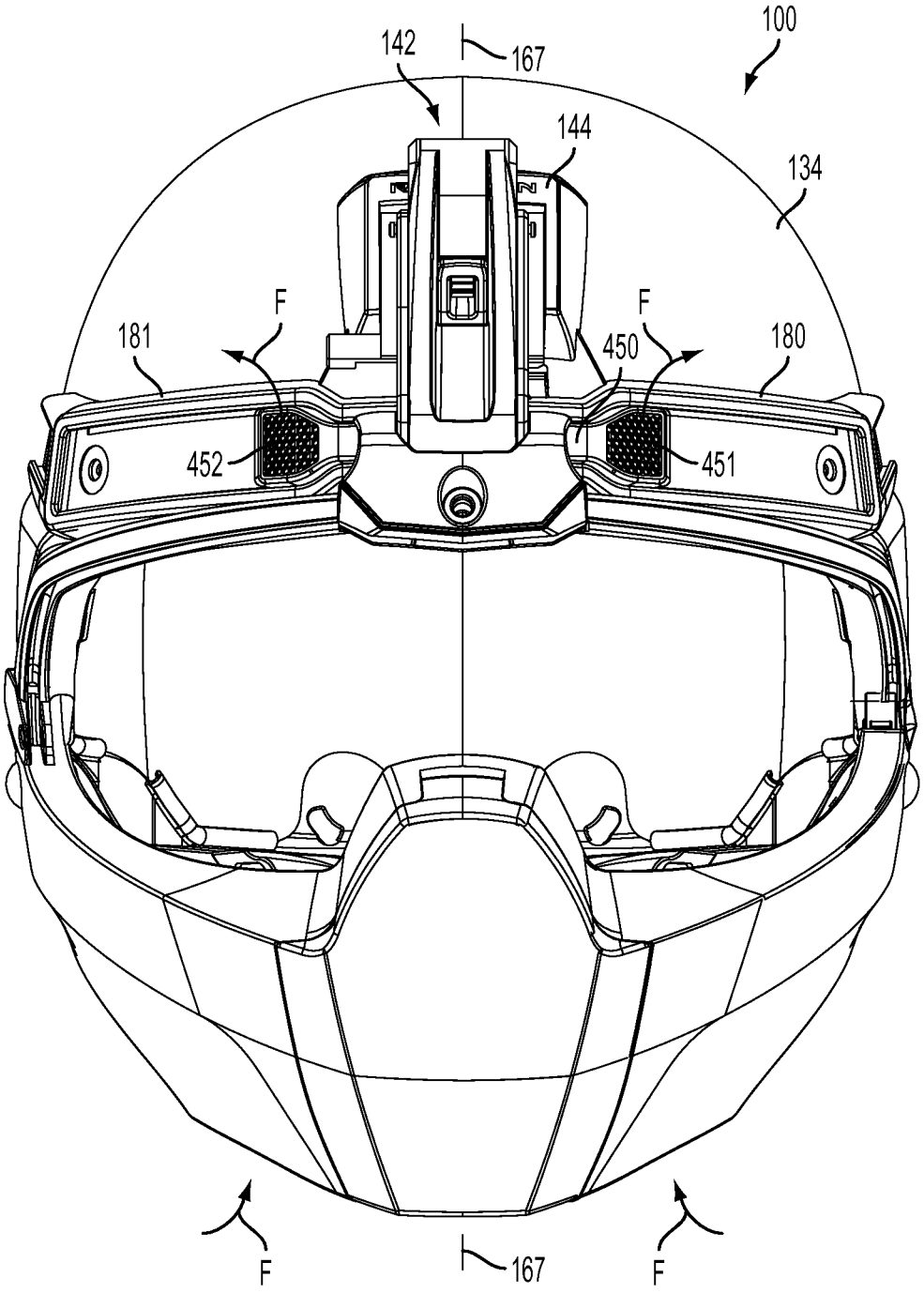
FIG. 2 is a front view of the helmet assembly a FIG. 1.
Figure 28:
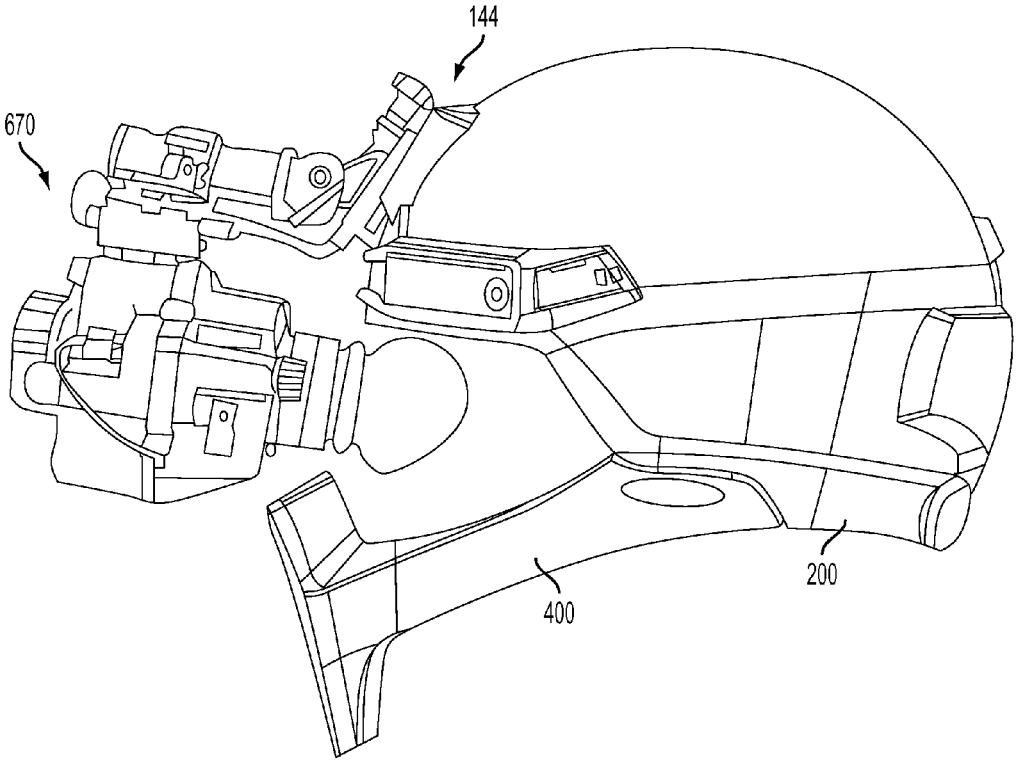
FIG. 28 is a left side view of the helmet assembly of FIG. 1 with a night vision enhancing apparatus attached and other parts removed.

The helmet assembly 100 comprises a front helmet mount 144. In one embodiment, the mounting arrangement 142 and the face shield 138 is the mounting arrangement and visors disclosed in U.S. patent application Ser. No. 12/875,106, filed Sep. 2, 2010, which is herein incorporated by reference to the extent not inconsistent with the present description. The helmet mount 144 secures the face shield 138 to the helmet 134 via mounting arrangement 142 to the helmet. Alternatively, the helmet mount 144 can attach a night vision unit 670 (FIG. 28) to the helmet As shown in FIGS. 1-3 and 12, the front helmet mount 144 extends across at least a partial width of the helmet and may be contiguous on the right and left sides of the helmet with a left side rail and a right side rail (not shown). The helmet mount 144 includes left and right rail portions or bracket portions 180, 181 connected by a center portion 182. The left and right bracket portions 180, 181 are mirror image identical across the midplane 167 (FIG. 2). The left and right bracket portions are substantially rectangular when viewed from the front of the helmet.

Figure 12B:
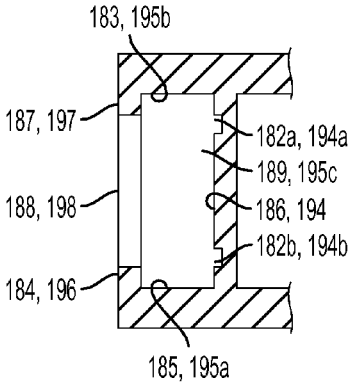
FIG. 12B is a schematic sectional view taken generally along line 12B-12B of FIG. 12.
Figure 12:
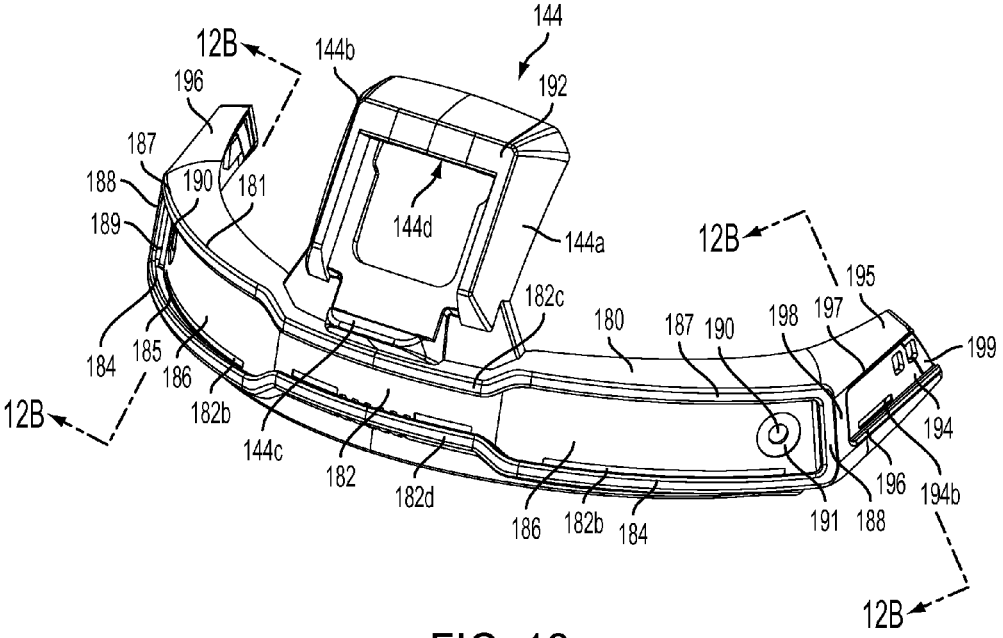
FIG. 12 is a right perspective view of the front mount.

As shown in FIGS. 12 and 12B, the right bracket portion 181 has a recess portion 186 surrounded on its sides by bracket edges defining the area of the recess portion, at least in part. The bracket edges for each bracket portion 180, 181 have a bottom inside wall 185, an end inside wall 189, and a top inside wall 183 extending forward from the recess portion 186 (top inside Avail not shown in FIG. 12), and a bottom lip 184 extending at a right angle from the bottom inside wall 185, a top lip 187 extending at a right angle from the top inside wall 183, and an end lip 188 extending at a right angle from the end inside wall 189. The lips extend inward from the respective inside walls slightly overlying the recess portion 186. In effect, the bottom lip 184 extends vertically toward the top lip 187, the top lip 187 extends vertically toward the bottom lip 184, and the end lip 188 extends towards a center of the mount, to create an accessory engaging configuration whereby an attachment member of an accessory can be captured and secured between the lips, the inside walls, and the recess portion. The recess portion of the right bracket portion is enclosed at the right end by the inside wall 189 and the corresponding lip 188. The right and left bracket portions 181,180 may have stops 180*a*, 180*b* (FIG. 3) that block at least part of the passage between the recessed portion of the left or right bracket portions and the center portion 182.

The center portion 182 has a substantially vertical height which is narrower than of the recessed portion of the right and left bracket portions. The center portion 182 has top and bottom walls with top and bottom lips 182*c*, 182*d*. At the lateral ends of the left and right bracket portions is a mounting hole 190 within a recess 191 for receiving the head of a screw, bolt, rivet or other fastener. The mounting holes 190 are configured to align with the left and right anchors 118, 119 of the helmet for securing the mount 144 to the helmet. Additionally the mount 144 and center upper portion 192 has a T-shaped receiving area for engaging with the upper center anchor 116. The T-shaped receiving area engages the top upper center anchor 116, particularly portions of the overhangs 116*c*, 116*d* of the T-projection 116*b*.

Extending from the right and left bracket portions 181, 180 are corresponding lateral accessory engagement portions 195. The lateral accessory engagement portions 195 can be formed in unitary fashion with the rest of the mount or can be engaged or fastened to the bracket portions 180,181. The edges for each lateral accessory engagement portion 195 define a recess portion 194 and include a bottom inside wall 195*a*, a front inside wall 195*c*, and a top inside wall 195*b* extending laterally from the recess portion 194, and a lower lip 196 extending at a right angle from the bottom inside wall 195*a*, an upper lip 197 extending at a right angle from the top inside wall 195*b*, and a front lip 198 extending at a right angle from the front inside wall 195*c*. The lips 196, 197, 198 extend inward from the respective inside walls slightly overlying the recess portion 194. In effect, the lower lip 196 extends vertically toward the upper lip 197, the upper lip 197 extends vertically toward the lower lip 196, and the front lip 198 extends towards a rear of the helmet, to create an accessory engaging configuration whereby an attachment member of an accessory can be captured and secured between the lips, the inside walls, and the recess portion. The lateral end or rearward extending area 199 of each lateral accessory engagement portions is open to receive and secure accessories or side rails.

The cross-sections of the engagement portions 180, 181 and the lateral engagement portions 195 are shown in FIG. 12B.

Figure 12A:
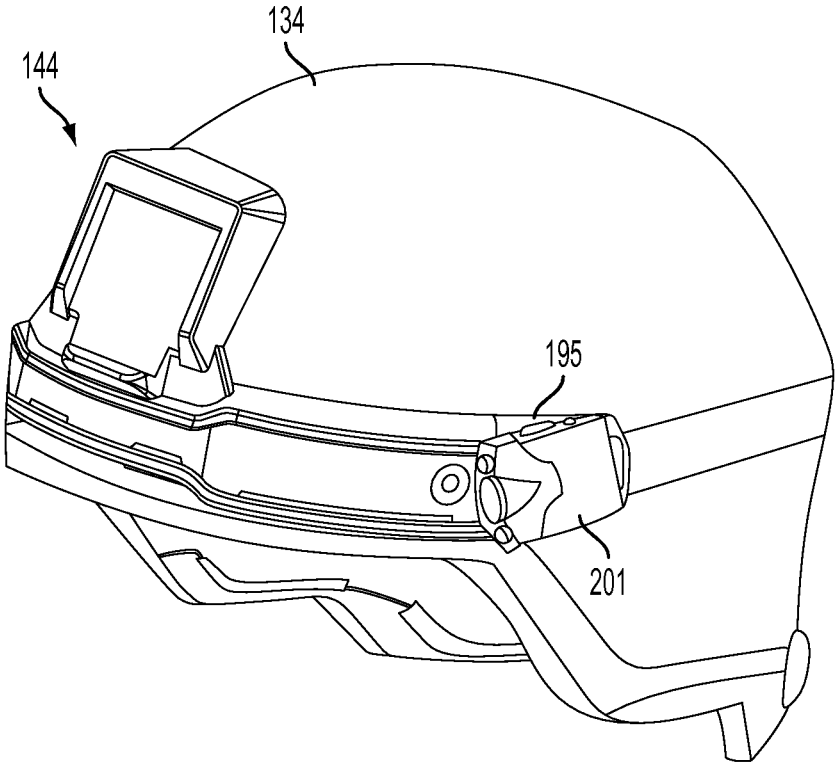
FIG. 12A is a right perspective view of the helmet assembly of FIG. 1 with elements removed and an accessory attached.

As shown in FIG. 12A, a tactical FED 201 array may be mounted to either of the lateral accessory engagement portions 195. The lateral accessory engagement portions 195 may also receive a camera, strobe light, or other accessory. The accessories mounted to the lateral accessory engagement portion lips 196, 197 may connect with power and data conduits provided on or in the accessory-mounting rim portion as for powering or receiving data therethrough. Power and data ports (not shown) may be provided in the recess 194, the lips 196 or other areas of the lateral accessory engagement portions for transmitting power or data to and/or from the accessory.

Each of the right and left bracket portions 180, 181 may comprise recess grooves 182*a*, 182*b*, in the respective recess portions 186, along the respective bottom bracket inside wall 185 and top bracket inside wall 183. The recess grooves 182*a*, 182*b* may be used to secure an accessory to the left or right bracket portion 180, 181.

Each of the lateral engagement portions 195 may comprise recess grooves 194*b*, 194*a*, in die respective recess portions 194, along die respective bottom inside wall 195*a* and top inside wall 195*b* (see FIGS. 12, 12B, 20 and 21). The recess grooves 194*b*, 194*a* may be used to secure an accessory to the lateral engagement portion 195.

The front mount 144 may comprise electrical and computer data conduits. The conduits are for transferring power and or computer or electronic data from an accessory through the accessory-mounting rim portion 200 to a power source and/or auxiliary computing or storage device. Each of the left and right bracket portions may comprise electrical and computer data conduit connector pad for providing a connection between one or more conduits contained within the mount 144 and an accessory and for facilitating the transfer of power or data therebetween. Further, the mount 144 may contain any connector known to provide a detachable connection between a conduit and an accessory or a conduit and another conduit.

In one embodiment, the helmet mount may have a vent member 450 with two vents 451,452, as shown in FIG. 2. The vent member attaches to the center portion 182 and extends laterally to position the vents 451, 452 in the left and right bracket portions 180,181 of the mount. The vent is configured to draw air in the direction F up through the inside of the helmet assembly and out the vents 451, 452. The vents are in flow channel communication through a passage (not shown), with the area inside of the face shield, i.e., between the face shield and the helmet.

Accessory-Mounting Rim Portion

Figure 3:
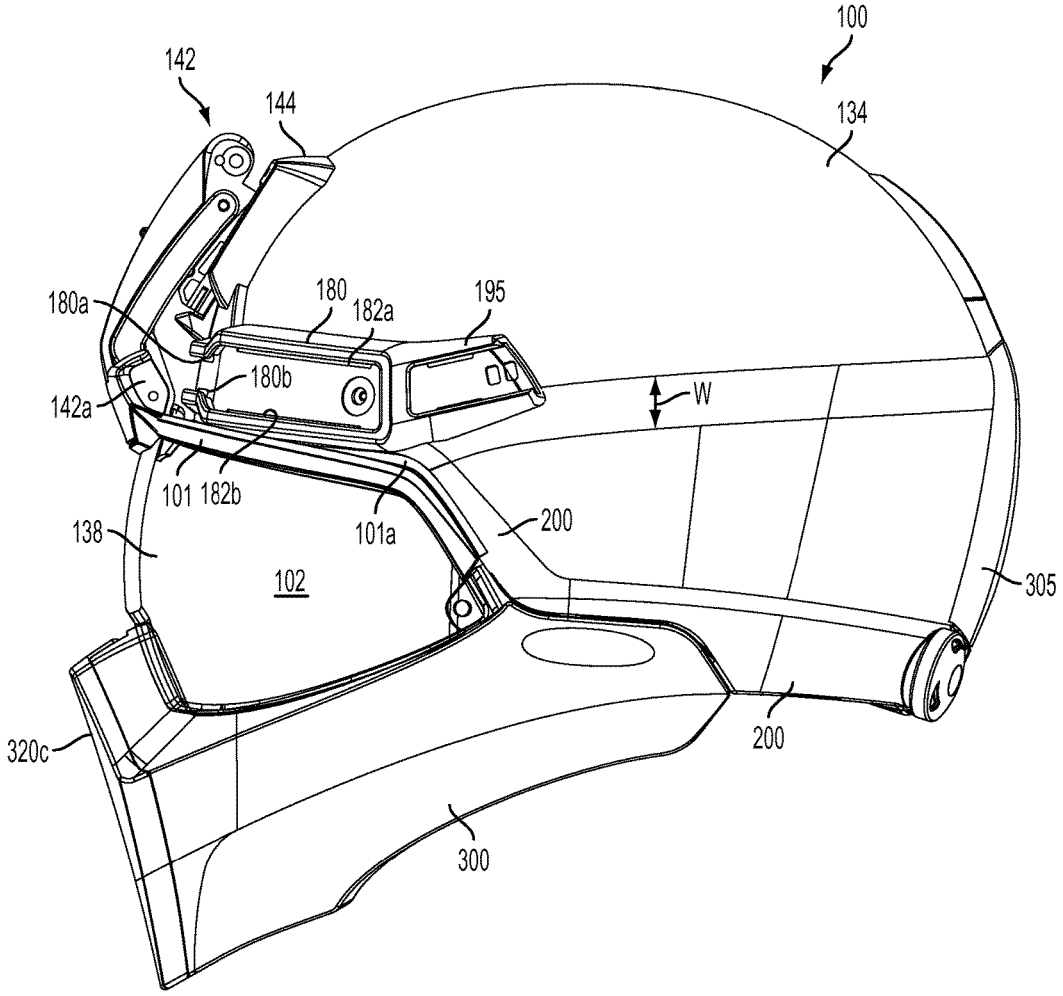
FIG. 3 is a left side view of the helmet assembly of FIG. 1.
Figure 13:
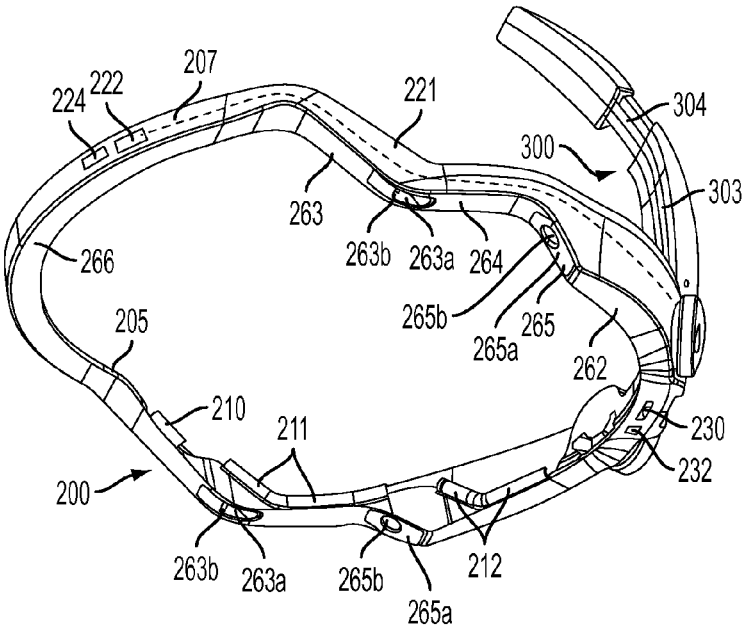
FIG. 13 is a lower perspective of the accessory-mounting rim portion with a rear tower attached.
Figure 14:
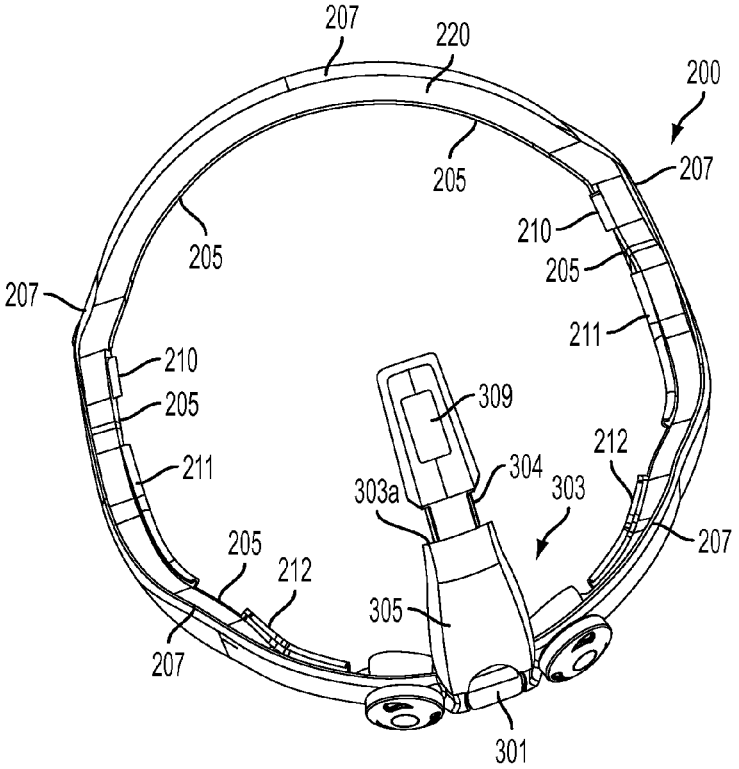
FIG. 14 is an upper perspective view of the accessory-mounting rim portion of FIG. 13.

Referring to FIGS. 3, 13, and 14, the helmet assembly 100 comprises an accessory-mounting rim portion 200, such as a halo, that can be configured to conform to the bottom edge of the helmet 134. The lower edge or bottom wall has a top eyewear area edge or wall 266, side eyewear area edges or walls 263, ear area lower edges or walls 264, ear area-to-lower back edge transitions or walls 265, and a lower back edge or wall 262 all of which are configured to be fit over the corresponding portions of the bottom edge 166, 163, 164, 165, 162 of the helmet 134. The top side of the accessory-mounting rim portion 200 has an inner channel 220 surrounded by an outer wall 207 and an inner wall 205, and the bottom wall of the accessory-mounting rim portion. The inner wall comprises a number of lips 210, 211, 212 that can be used for positioning the accessory-mounting rim portion to the helmet. In one embodiment, the accessory-mounting rim portion is affixed to the lower edge of the helmet with a glue or adhesive.

The accessory-mounting rim portion comprises hook anchor holes 263*a* at the intersection of the side eyewear area edges 263 and the ear area lower edges 264. The hook anchor holes are configured to receive anchor hooks 340 to secure the mandible 300, 400 in a pivotal manner to the accessory-mounting rim portion. The accessory-mounting rim portion also comprises locking pin holes 265*b* located on the ear area to lower back edge transitions 265. The locking pin holes 265*b* are located on a pin strike plate 265*a*.

The accessory-mounting rim portion 200 has electrical power and/or computer data conduits 221. While the conduits are shown as a single dashed line 221, it is understood the conduits 221 can represent multiple wires or conduits each carrying electrical power, or data, or both. The conduits are designed to transport data and power to and from the rear of the accessory-mounting rim portion to the front and/or sides of the accessory-mounting rim portion. The conduits may comprise wires that are integral in the accessory-mounting rim portion positioned between the upper and lower surfaces of the accessory-mounting rim portion. Alternatively, wires could be run in the channel 220. In another embodiment, the materials which comprise the accessory-mounting rim portion may be suitable for conducting electricity and/or transferring power and/or data. The accessory-mounting rim portion may comprise one or more power contact pads 222 and one or more data contact pads 224 for connecting with a front or side mounted, which may include the front mount 144. While the contact pads 222, 224 are shown on the front right portion of the accessory-mounting rim portion, they may be placed elsewhere on the accessory-mounting rim portion where it is desired to provide a power or data connection. It is recognized that accessories like a night vision unit may be attached to the mount 144 and that the mount 144 may comprise conduits which carry power and data through the mount from the accessory-mounting rim portion to the accessory. The mount may comprise contact pads (not shown) that contact the surface of the accessory-mounting rim portion 200 at the contact pads 222, 224. Further the accessory-mounting rim portion may comprise any connector known for connecting power conduits for data conduits. The connector may be utilized at the front of the accessory-mounting rim portion, at the side of the accessory-mounting rim portion, or any other position along the accessory-mounting rim portion where it is desired to utilize data or power for an accessory.

Figure 14A:
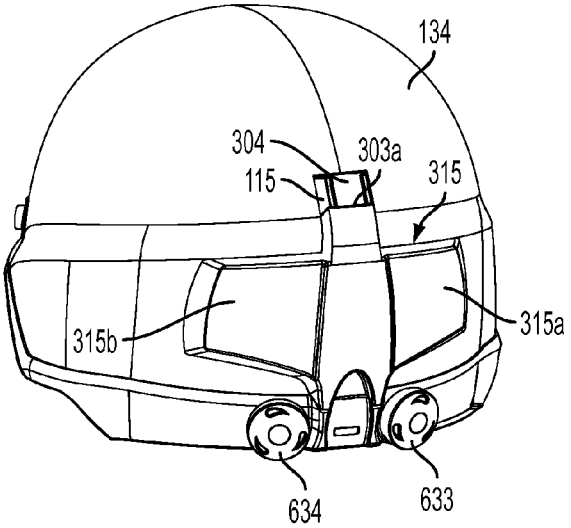
FIG. 14A is a rear perspective view of the helmet assembly showing the helmet, the accessory-mounting rim portion and the rear battery.
Figure 14C:
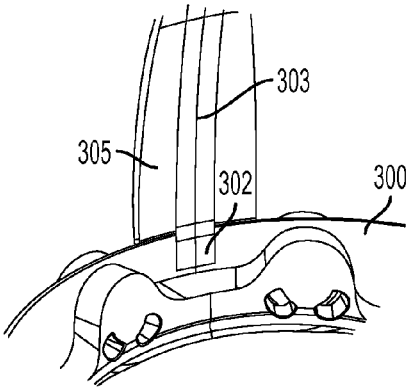
FIG. 14C is an inside perspective view of the connection between the accessory-mounting rim portion and a battery.

In one embodiment, a rear tower 303 is attached to the rear of the accessory-mounting rim portion 200, as shown in FIGS. 13-14C. The tower may comprise a battery or battery pack 305 as shown in FIGS. 4, 13, 14, and 14C, and a securing tab, hook or other connection 302, and an accessory compartment 309. The securing connection 302 allows connection between the rear tower 303 and the accessory-mounting rim portion by fitting between the helmet and a front edge (closest to the helmet) of the accessory-mounting rim portion or by fitting into a top hole in the accessory-mounting rim portion. The accessory compartment 309 may comprise a GPS unit which may be capable of working with a global positioning system (GPS) block 11F satellite system or other global positioning system protocols. The battery 305 may be detachable from the tower 303 or may be integrated therewith. The battery may have a snap in connection with the accessory-mounting rim portion 200 which may be releasable by pressing the button 301 near the base of the tower. The battery is signal connection with the conduit 221 of the accessory-mounting rim portion when the battery is connected to the accessory-mounting rim portion. The battery may also be signal connected with the port 230 in the back of the accessory-mounting rim portion. The battery and the tower are configured to conform to the shape of the rear portion of the helmet 134. Therefore the battery in the tower will be positioned against the helmet or closely in relation thereto to support the tower and the battery. In addition, the tower 303 has a catch strip 304 that is configured to lay in the recess center channel 115*c* of the rear anchor 115 and be retained by the right and left side claws 115*a*, 115*b* of the rear anchor. Thus, the tower is captured at its lowest end by the tab 302 into the accessory-mounting rim portion and prevented from vertical dislodgement by the catch strip 304 being held horizontally by the claws 115*a*, 115*b* of the top mount 115 and prevented from vertical movement by the shoulders 303*a* of the tower abutting a bottom of the mount 115.

Figure 14B:
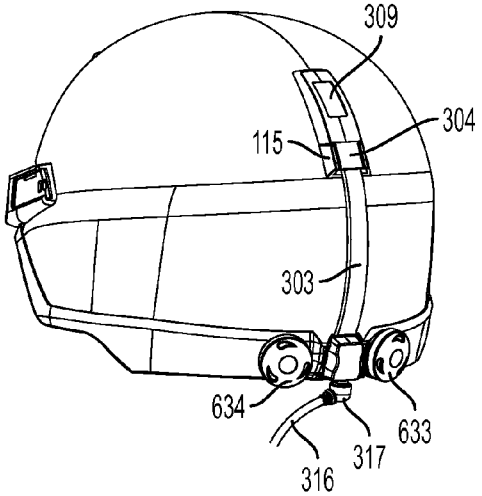
FIG. 14B is the helmet assembly showing the helmet, the accessory-mounting rim portion, and the rear mounted accessory.

FIG. 14A shows an alternative arrangement utilizing a larger extended life battery 315. The battery has lateral wings 315*a*, 315*b* that extend laterally from the tower and conform to the contour of the helmet. FIG. 14B shows a further alternative embodiment where the battery is not used with the tower but instead a power cable 316 is connectable to the port 230 of the accessory-mounting rim portion with the connector 317, which is attached to the cable 316. Alternative power may be provided from an external power source and conveyed through the cable 316. An alternative embodiment, the cable 316 may carry data from an external data source such as a computer data storage or computing unit. When data is conveyed via the port 230, it may be transferred via the data conduit 221 to and from an accessory via the accessory-mounting rim portion. The cable may be used to charge the batteries 305, 315 when they are attached to the accessory-mounting rim portion.

Mandible

The helmet assembly 100 may include a mandible, such as mandible 300, 400. The mandible 300 is that shown in FIGS. 1-4, and 15-17, The mandible 300 has left and right opposite side portions 330, 331 connected by a center portion 310. The center portion 310 is configured to cover the mouth area of a user when mounted to a helmet. The center portion may also cover a portion of the nose of a user when the mandible is mounted to a helmet. The center portion 310 extends vertically higher than the side portions 330, 331. The side portions 330, 331 are configured to cover a cheek area of the user. The side portions 330, 331 are configured to be positioned below the eyes of a user and may extend below the jaw line of user when the mandible is attached to a helmet worn by user. The side portions 330, 331 each comprise scooped lower edges 333, 337 in order to provide maneuverability to a user and compatibility with weapons that may be shoulder mounted. The compatibility with shoulder mounted weapons, such as a rifle enables the user to aim the weapon while at the same time wearing the mandible.

The scooped lower edges 333, 337 are higher or raised as compared with the lower front edges 339. The left and right portions 330, 331 comprise an upper portion 334 and a lower portion 332. The upper portion 334 tapers from a side ridge 336 inward as it extends to an upper edge 338. The lower portion 332 tapers from the side ridge 336 inward as it extends to the bottom including the scooped lower edge 333 and the lower front edges 339. The upper edge 338 and the upper surface of the center portion 310 may be configured to engage the face shield 138 as shown in FIGS. 1-3. A gasket may be provided on the upper edge 338 and the upper surface of the center portion 310 for a sealing engagement with the face shield 138 or a lens carrier or frame, when the lens is in the deployed position as shown in FIG. 1.

Figure 15A:
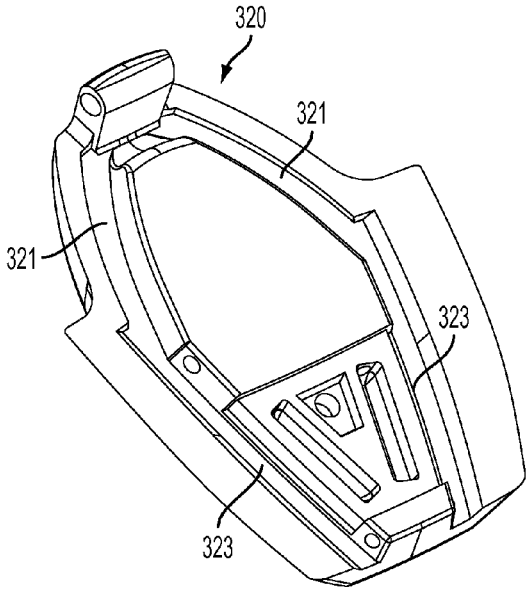
FIG. 15A is a transparent perspective view of the inside surface of the cover of FIG. 15.
Figure 15:
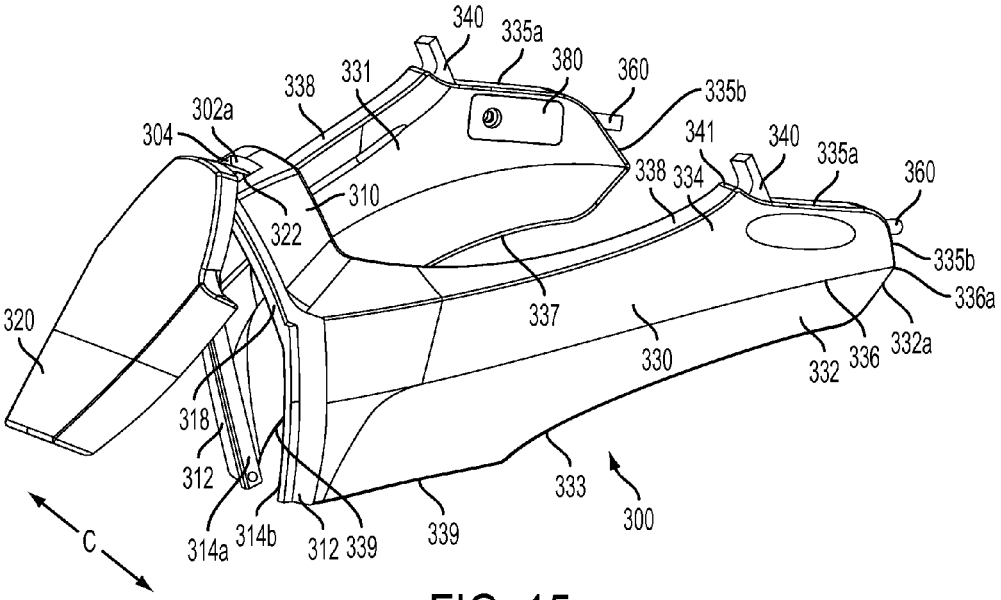
FIG. 15 is a left perspective view with a mandible having a cover in an open position.
Figure 16:
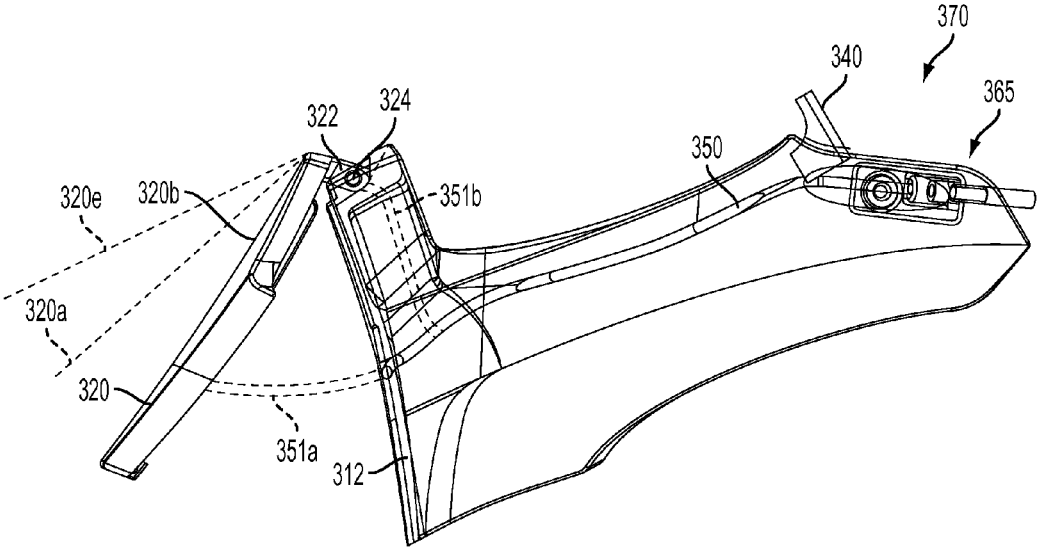
FIG. 16 is a transparent left side view of the mandible of FIG. 15.
Figure 17:
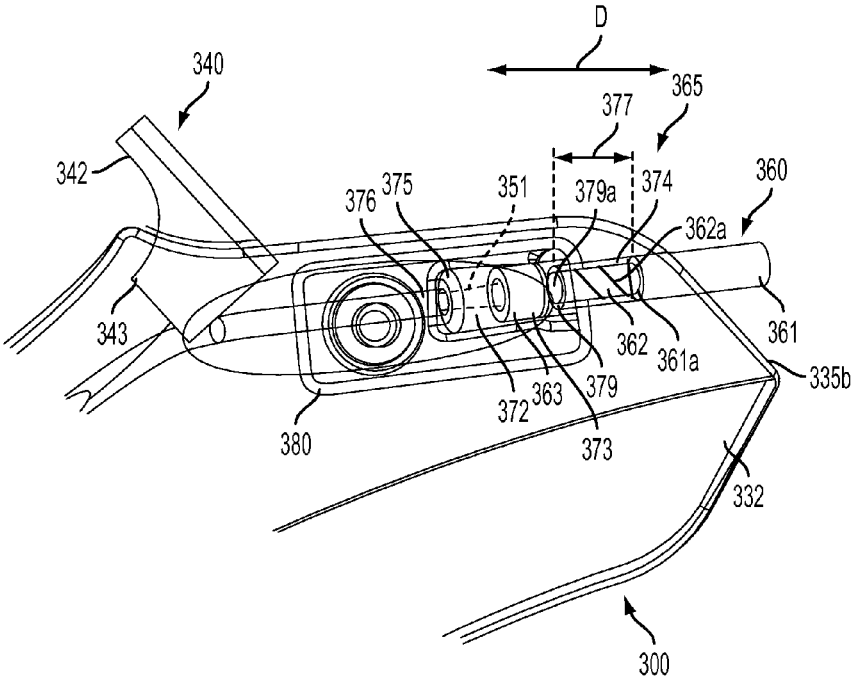
FIG. 17 is an enlarged transparent fragmentary view of a portion of the mandible mounting system taken from FIG. 16.

The cover 320 is pivotally connected to the center portion 310 and configured to cover the front of the mandible to provide protection to a user's mouth and chin areas. The cover has a least three positions, a closed position 320*c* such as shown in FIG. 3, and open position 320*b* such as shown in FIGS. 15 and 16, and a mandible start-to-release position 320*a* shown in FIG. 16 where the cover is moved to a higher position than is shown in FIG. 15. In one embodiment, the cover is continuously movable and positionable between the closed position and a maximum open position. The cover 320 has a pivot bar 322. The bar 322 extends horizontally from the vertical face of the cover in the closed position. The bar 322 pivots about pin 324 as shown in FIG. 16. The bar 322 is positioned within a recess 302*a* and extends from opposite sides 304 of the recess 302*a*.

The center portion 310 has a front surface 312 with ridges 314*a*, 314*b*, 318, which may be continuous. The ridges extend about a least three sides of the front surface 312. A cover 320 has recesses 321, 323, which may be continuous, which corresponds to the ridges 314*a*, 314*b*, 318 whereby the ridges engage the recesses of the cover when the cover is in the closed position. The ridges engagement with the recesses secures the cover against lateral movement in the direction C shown in FIG. 15 when the cover is in the closed position. A gasket may be provided on the front surface 312, the ridge, or on the front cover to seal the connection between the cover and the mandible when the cover is in the closed position.

The upper edge 338 of the side portions 330, 331 extends inward until a breakpoint or inflection 341. The inflection 341 is the point at or after which the mandible is configured to contact with the accessory-mounting rim portion 200 or a helmet edge. A mounting contact surface 335*a*, 335*b* extends from the inflection 341 rearward and downwards to a side ridge 336. The upper mounting contact surface 335*a* is configured to contact the ear area lower edges 264 of the accessory-mounting rim portion 200 and the lower mounting contact surface 335*b* is configured to contact the ear area to lower back edge transitions 265 of the accessory-mounting rim portion 200. Below the side ridge 336 the rear of the mandible has a forward sloping section 332*a* which connects the side edge 336 to the scooped lower edges 333.

Referring to FIGS. 15-19, the mandible comprises a mandible mounting system 370. Only one side of the mandible mounting system 370 will be described with the understanding that an identical configuration would be present on the opposite side of the helmet and mandible, i.e., there would be two pins, two books, two cords, etc. The mounting system 370 comprises an anchoring hook 340 and pin engagement system 365, and the cover 320. The pin engagement system 365 comprises a pin 360. The pin 360 comprises an engagement portion 361, a recess portion 362, and an anchor portion 363. The recess portion 362 connects the engagement portion 361 to the anchor portion 363. Engagement portion 361 and the recess portion 362 are configured to operate in the pin channel 374 of the mandible. The pin channel 374 extends to the rear of the mandible to exit holes in mounting contact surfaces 335*b* so that the pin can engage locking pin holes 265*b* of the accessory-mounting rim portion 200. The pin channel 374 is open to a reduced diameter channel portion 379*a* through an opening in a base end wall 379 opposite to the exit holes. The reduced diameter channel portion 379*a* opens into a slide channel 372. The slide channel 372 allows the anchor 363 of the pin to move longitudinally within this slide channel as shown by the arrow D, in FIG. 17. The slide channel limits the movement of the anchor 363 and thereby limits the travel of the pin 360.

The pin engagement system 365 comprises a spring 362*a* (shown schematically). The spring is fit around the recess portion 362 of the pin within the pin channel 374 braced between a wall 361*a* of the engagement portion 361 of the pin and the base end wall 379 of the channel. The slide channel extends between a rear end 373 and a front end 375 of the slide channel. The rear end 373 is open to the reduced diameter channel portion 379*a* to receive the recess portion 362 of the pin therethrough. The spring 362*a*, by being compressed, pushes between the base end wall 379 and the wall 361*a* of the engagement portion 361 to draw the anchor 363 against the rear end 373 of the slide channel 372. The anchor 363 is attached to a cable element, such as a cord 351 of the cable 350. The cable element 351 may be attached around the anchor 363 or may be attached to a front surface of the anchor 363. The cable element 351 is movable within the cable 350.

The cable element is moved within the cable 350 by the cover 320. In one embodiment shown in FIG. 16, the cable element 351*a* extends between the front surface 312 and the inside surface of the cover 320. The cable element may have a slack portion at an end opposite the pin. The cover may house the slack portion. The slack portion has an end with an anchor. The anchor is retained within a container portion of the cover when the cover is in a closed position. The slack portion reels from the cover as a cover moves upwards towards an open position. When the cover reaches a predefined release position 320*a*, the anchor of the slack portion engages an anchor stop of the cover 320 and the cable element 351 is drawn through the cable 350 to draw the pin 360 forward. Once the cover is moved past the release position, the cable element begins to be drawn forward which draws the pin 360 forward releasing it from engagement with the locking pin holes 265*b* of the accessory-mounting rim portion. When the pin is released, the mandible may be pivoted about the hooks 340 temporarily and then moved back down to re-engage the pins 360 with the locking pin holes 265*b* of the accessory-mounting rim portion. Alternatively the hooks may be disengaged with the hook anchors 263*b* and the mandible may be removed from the accessory-mounting rim portion.

A user is allowed to open the cover and permit hydration or access to the mouth without releasing the mandible from the accessory-mounting rim portion by moving the cover anywhere between the closed position and a full release position 320*e*. Because the cover operates to release the pin engagement system 365, a user may remove the mandible by using only one hand. This is accomplished by the user lifting the front cover from the start-to-release position 320*a* to the full release position 320*e*, where the pins disengage with the locking pin holes and then user continues lifting the cover or other part of the mandible to release the hooks from the book anchors 263*b*.

In another embodiment, the cable 351*b* runs up the center portion 310 and connects to a winding mechanism that is attached to the pin 324. The winding mechanism pulls the cable element towards the front of the mandible when a user draws the cover 320 between the release position 320*a* and the full release position 320*e*. And this draws the anchor portion 363 forward in the slide channel 372 to draw the pin 360 forward. In one embodiment, the winding mechanism has a detent mechanism. The detent mechanism prevents the cable element from being pulled through the cable 350 until the cover reaches the release position 320*a*. Once the cover is moved past a predefined released position, the cable element begins to be drawn forward which draws the engagement portion of the pin 360 forward releasing it from engagement with the accessory-mounting rim portion.

Figure 18:
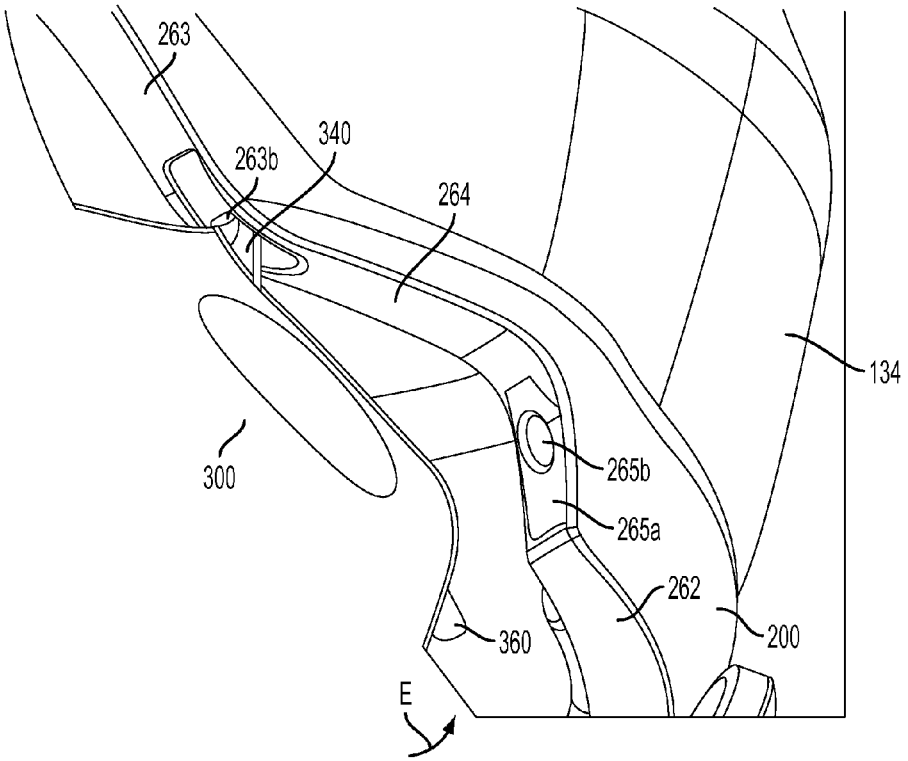
FIG. 18 is a fragmentary left side perspective view of the attachment of a mandible the lower edge halo.

Referring to FIG. 18, to attach the mandible to the accessory-mounting rim portion 200, the front of the mandible is raised up toward the top eyewear area edge 266 of the accessory-mounting rim portion and the anchor hooks 340 engage the hook anchor holes 263*a* of the accessory-mounting rim portion. Then the front of the mandible is pivoted down away from the top eyewear area edge 266 and at the same time the rear of the mandible is pivoted up about the anchor hook 340 in the direction E shown in FIG. 18 until the pin 360 engages the locking pin holes 265*b* and the mounting contact surface 335*a*, 335*b* contact or are in close proximity to the ear area lower cut edges 264 and ear area to lower back edge transitions 265 of the accessory-mounting rim portion, correspondingly. Before the pins 360 engages the locking pin holes 265*b* the pins contact the strike plate 265*a* there the movement of the mandible relative to the accessory-mounting rim portion compresses the pin inwards towards the mandible until the pin is in line with the locking pin holes 265*b*. When the pins engage the locking pinholes and springs into the pinholes under the force of the spring, the mandible is secured against the accessory-mounting rim portion between the hook anchor and the pin.

Figure 19:
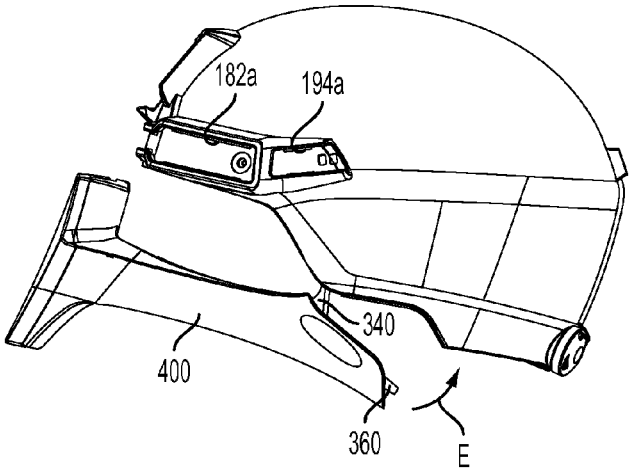
FIG. 19 is a left side view showing the attachment of an alternative mandible to the lower edge halo.
Figure 20:
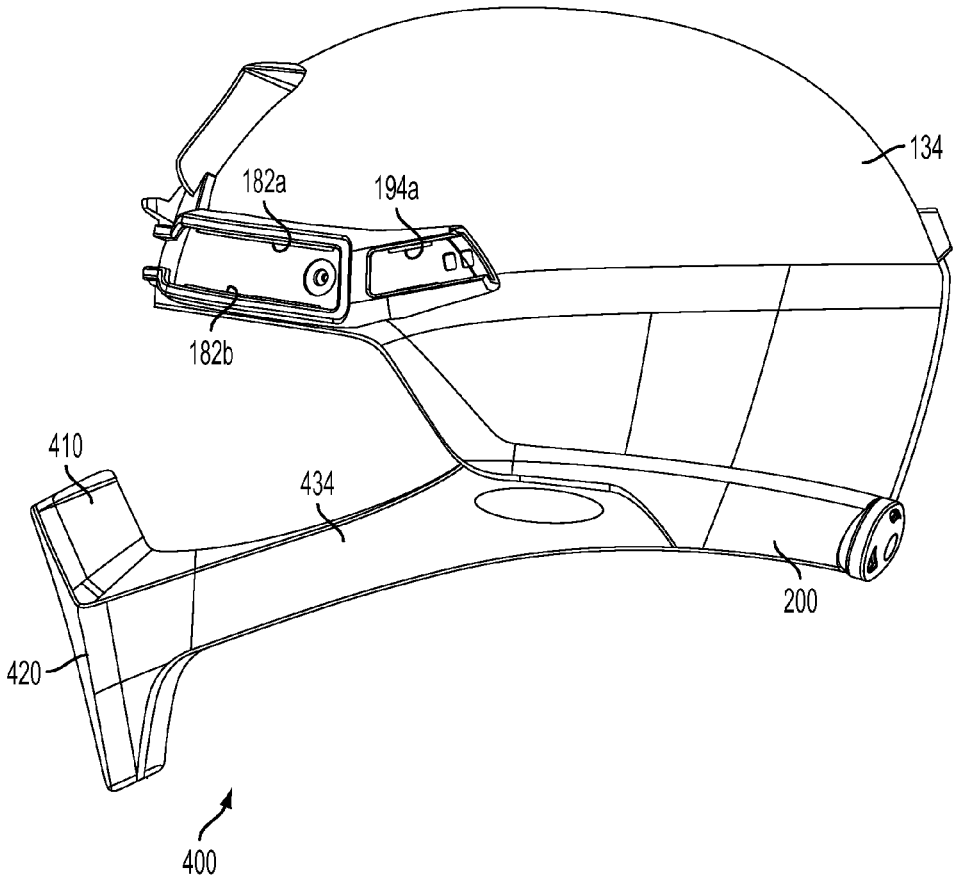
FIG. 20 is a left side view of the mandible shown in FIG. 19, with the mandible in the fully attached position.

FIGS. 19 and 20 show an alternate shorter profile mandible 400 which is similar to mandible 300 except as described and shown. The alternate mandible 400 is similar to the first full mandible 300 except that the alternate mandible 400 does not have the lower portion 332 found on the first mandible 300. The shorter profile of the mandible 400 allows increased compatibility with shoulder mounted weapons. Further, it provides additional freedom of movement to the user. The upper portion 434 of the mandible 400 is similar to the upper portion 334 of the mandible 300. Correspondingly, the center portion 310 of the mandible 300 is similar to the center portion 410 of the mandible 400. The cover 420 of the mandible 400 is configured and operates in the same manner to the cover 320 of the mandible 300. The mandible 400 has the same mounting system as the mandible mounting system 370 of the mandible 300. The mandible provides ballistic resistance, impact resistance, and blast resistance to the user's cheek, mandible, and partial neck regions.

The mandible may be made of a rigid material and or may carry a removable ballistic fabric that is carried around a frame structure. In other embodiments the mandible may comprise a wireframe guard without any ballistic protective material surrounding it. In one embodiment the lower portion 332 comprises they semi-flexible frame or material. Semi flexible frame mandibles or guards provide the benefit of conforming to a weapon when the wearer is aiming with a stock of the weapon proximate the cheek of a user to enhance the user's ability to use citing functions of weapons. In one embodiment, the mandible extends downward to cover a least a portion of the user's neck.

In one embodiment, the mandible is any of the mandibles disclosed in U.S. patent application Ser. No. 12/875,106, filed Sep. 2, 2010, which is herein incorporated by reference to the extent not inconsistent with the present description.

Head's Up Display

Figure 22:
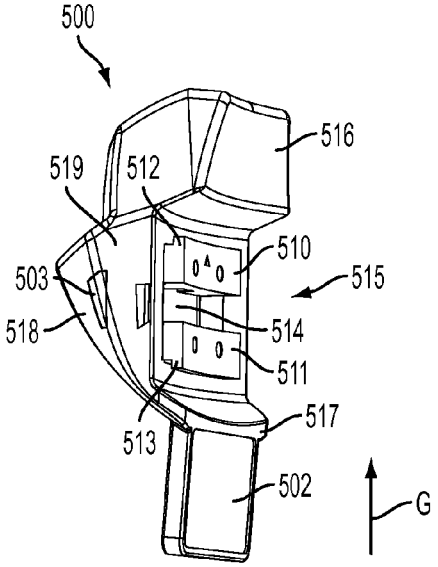
FIG. 22 is a rear perspective view of the heads-up display shown in FIG. 21.
Figure 21:
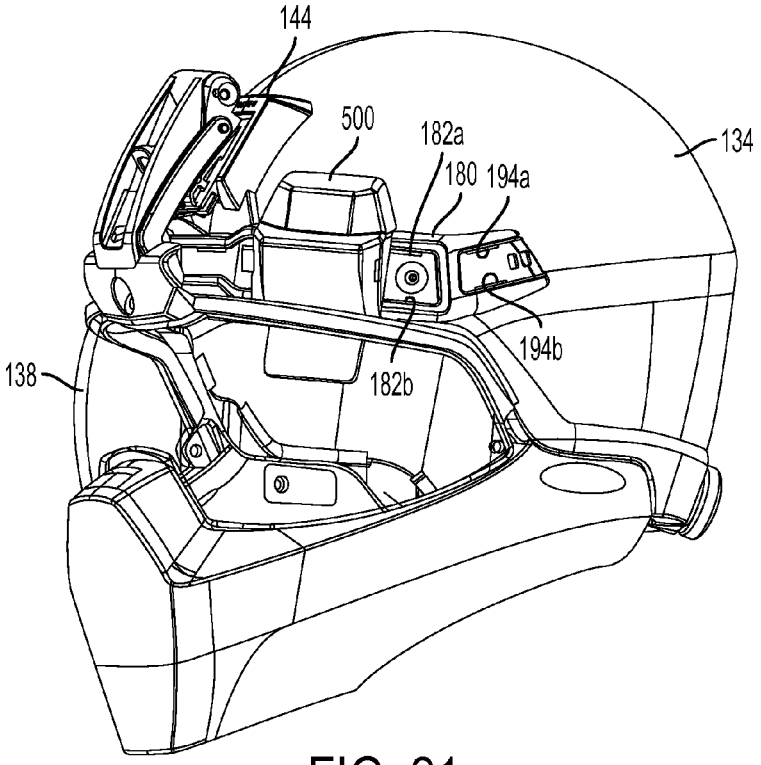
FIG. 21 is a front perspective view of the helmet assembly of FIG. 1 with a heads-up display attached.
Figure 22A:
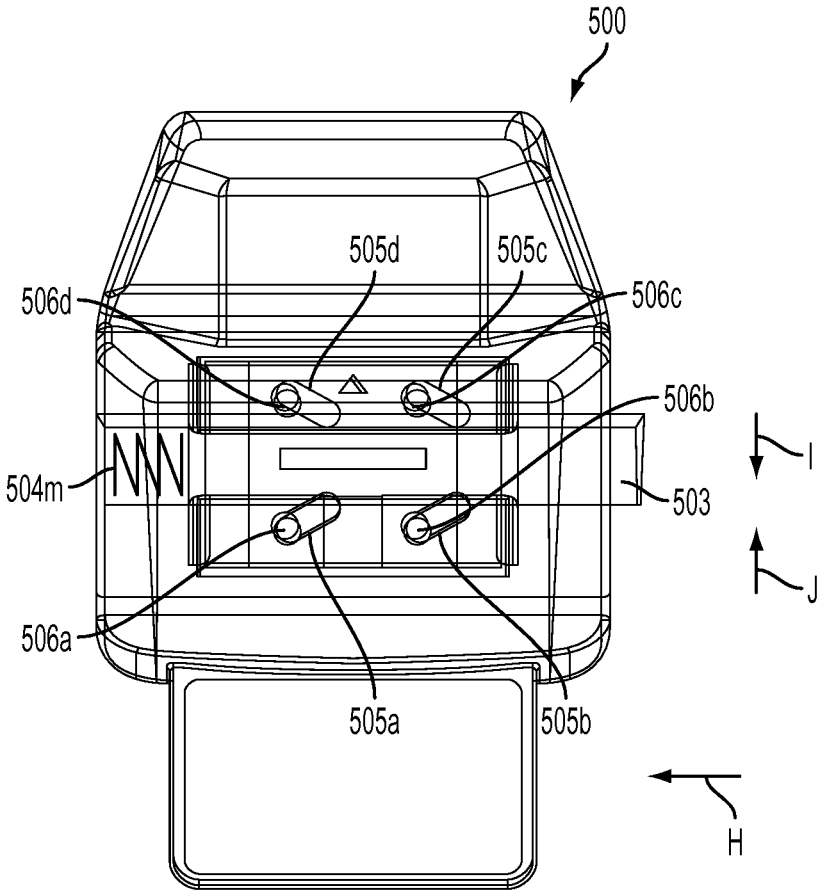
FIG. 22A is a rear transparent view of the heads-up display shown in FIG. 22 with internal components shown.
Figure 22B:
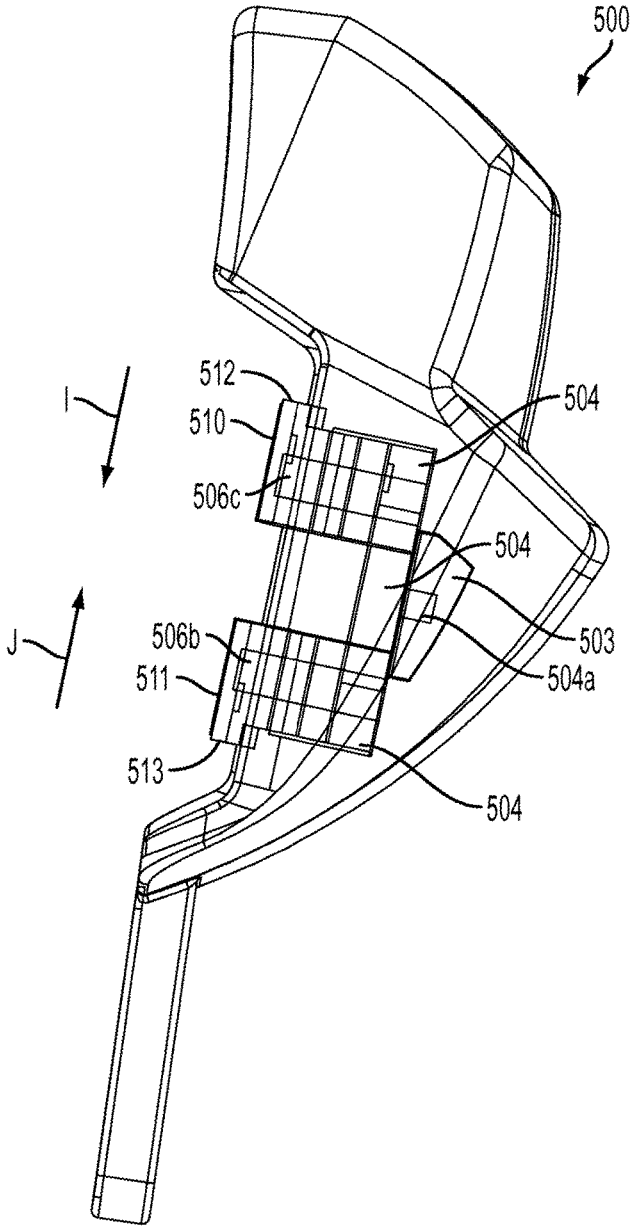
FIG. 22B is a side transparent view of the heads-up display shown in FIG. 22 with internal components shown.

The helmet assembly 100 may comprise a heads-up display usable with the front mount 144 as shown in FIGS. 21, 22, 22A, 22B. FIGS. 22A and 22B show the heads-up display transparently so that some internal components are visible. The heads-up display 500 has a recessed area 515 with an upper engagement rail 510 and a lower engagement rail 511 for engaging the right or left bracket portions 180, 181 of the front mount 144. The heads-up display 500 has a display screen 502. The display screen 502 has a deployed position as shown in FIGS. 21 and 22 and a retracted standby position (not shown) where the display screen 502 is retracted upward in the direction G as shown in FIG. 52 to withdraw the screen from the user's view and to withdraw the screen within a heads-up display 500 or within a slotted or recessed area (not shown) in the front mount 144, such as in the side bracket portion 180 or 181.

An upper portion of the upper engagement rail 510 comprises an upper rail lip 512 and a lower portion of the lower engagement rail 511 comprises a lower rail lip 513. The upper rail lip 512 engages the inside surface of lip 187 of the front bracket and the lower bracket lip 513 engages the inside surface of lip 184 of the front bracket portion to secure the heads-up display 500 to one of the left or right bracket portions 180, 181. A heads-up display has a release mechanism which when the release mechanism is activated, for example via button 503, the upper engagement rail 510 and the lower engagement rail 511 draw closer to each other in the gap area 514 to release the lips 512, 513 from the lips 184 and 187 of the front bracket portion.

In some embodiments, the release mechanism is that shown in FIGS. 22A and 22B. The release mechanism comprises the button 503 that is connected to a guide plate 504 by a protruding connecting bar 504*a* that are securely connected in a recess of the button 503. The guide plate has lower diagonal guide slots 505*a*, 505*b* and upper diagonal guide slots 505*c*, 505*d*. The lower engagement rail has two lower guide rods 506*a*, 506*b* that are fixed to the lower engagement rail. The upper engagement rail has upper guide rods 506*c*, 506*d* that are fixed to the upper engagement rail. The guide rods extend transversely to the longitudinal orientation of the guide plate 504 and pass through the respective guide slots. When the button 503 is pushed in the direction H the guide plate 504 moves in direction H relative to the body 519 of heads-up display 500 and the lower guide rods 506*a*, 506*b* are driven upward in the direction J by the lower edge of each of the lower diagonal guide slots 505*a*, 505*b*. Simultaneously, the upper guide rods are driven downward in the direction I by the upper edge of each of the upper diagonal guide slots 505*c*, 505*d*. As the upper and lower guide rods are fixed to the upper and lower engagement rails, then likewise the upper engagement rail 510 is driven downward in the direction I and the lower engagement rail 511 is driven upward in the direction J by the movement of the guideplate relative to the guide pins. In this way the upper engagement rail 510 and the lower engagement rail 511 draw closer to each other in the gap area 514 to a contracted position to release the lips 512, 513 from the lips 184 and 187 of the front bracket portion. In some embodiments the upper and lower engagement rails contact each other in the gap area 514 when in the contracted position. In some embodiments there a spring 504*m* (shown schematically) that biases the button 503 and/or the guide plate 504 relative to the body 519 of heads-up display 500 in the direction opposite of direction H so that the upper engagement rail 510 and the lower engagement rail 511 are biased toward the expanded position as shown in FIGS. 22, 22A, and 22B.

The heads-up display 500 has data and power connections (not shown) that are connectable with power and data connections within the front mount or bracket portions 180, 181 which are in turn in communication with the accessory-mounting rim portion 200 and the power and data connections provided therethrough.

As is shown in FIG. 21 the display screen 502 can be positioned behind the face shield 138 when the display screen is in the deployed position. The face shield or the frame or gasket thereof and/or the mount 144 are configured to have a gap or slot to allow the display screen to slide between the face shield or visor and the helmet. In this configuration, the visor, such as a visor with a tint, would not obscure the data or images being displayed on the display screen 502. In addition, the visor will protect the screen from environmental hazards. In one embodiment the display screen 502 is a transparent so that the display screen does not create a blind spot in the field of view of the user. In this configuration the user may be able to see through the data and images displayed on the transparent display to maintain awareness of the user's environment. The heads-up display 500 may be amounted on either the right or left side bracket portions 180, 181 of the front mount 144. Alternatively, the display screen can remain outside the face shield in the deployed position.

A recessed area 515 allows the heads-up display 500 to be a mounted in close conformity with the helmet in a low-profile design. Therefore the top portion 516 may be in close proximity or in contact with the helmet 134 and likewise the display screen support 517 positions the display screen 502 on the interior side of the face shield 138 and the visors support frame. In addition the center portion 518 has a curved profile so as to allow the upward movement of the visor.

Figure 23:
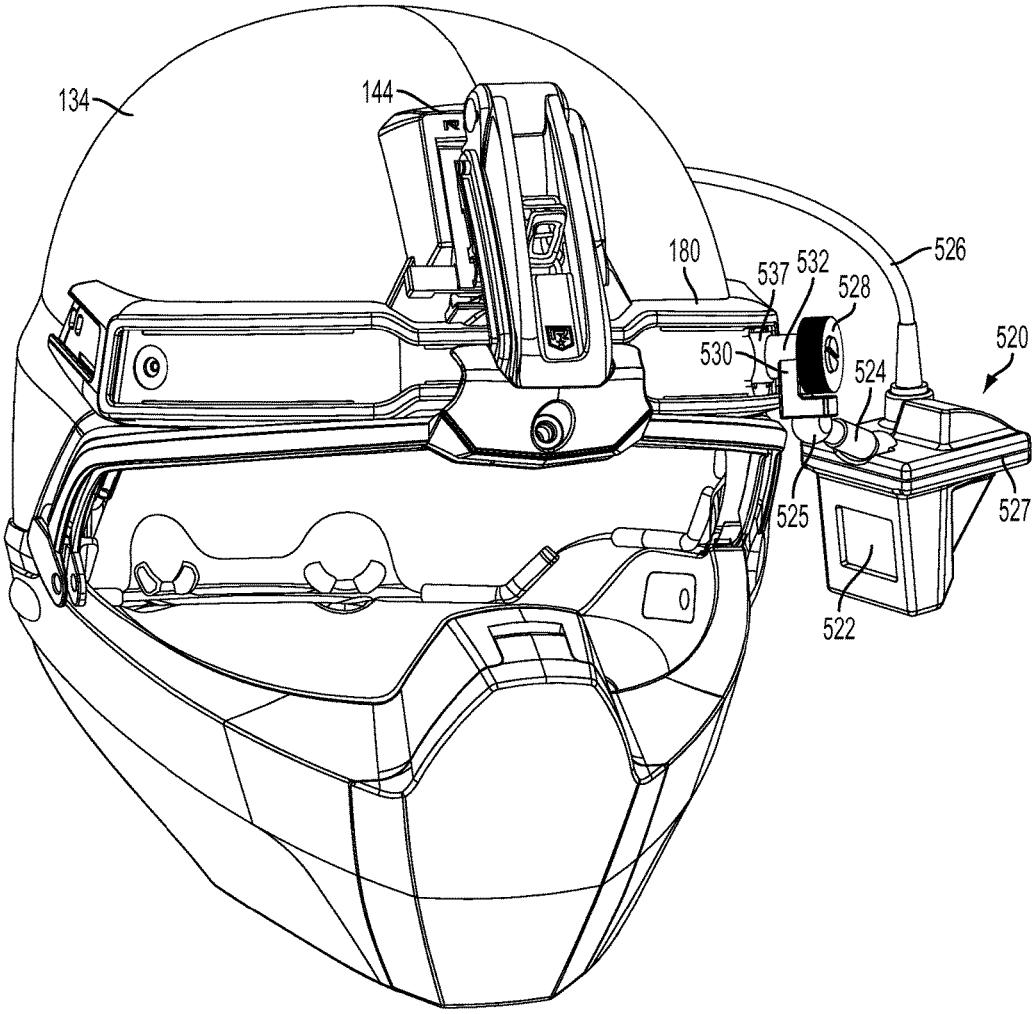
FIG. 23 is a front perspective view of the helmet assembly of FIG. 1 with an external beads up display attached.
Figure 23A:
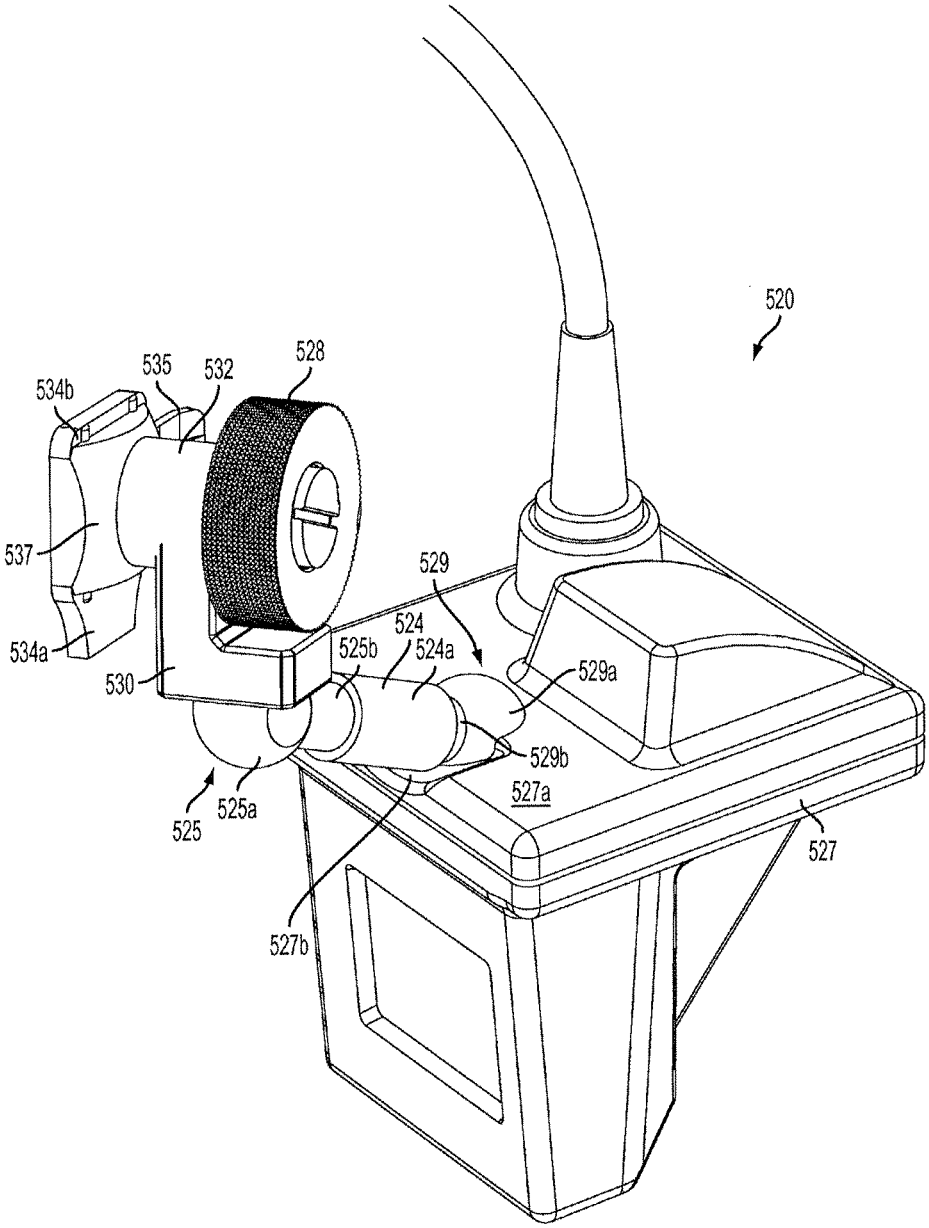
FIG. 23A is an enlarged perspective view of the external heads up display of FIG. 23.
Figure 23B:
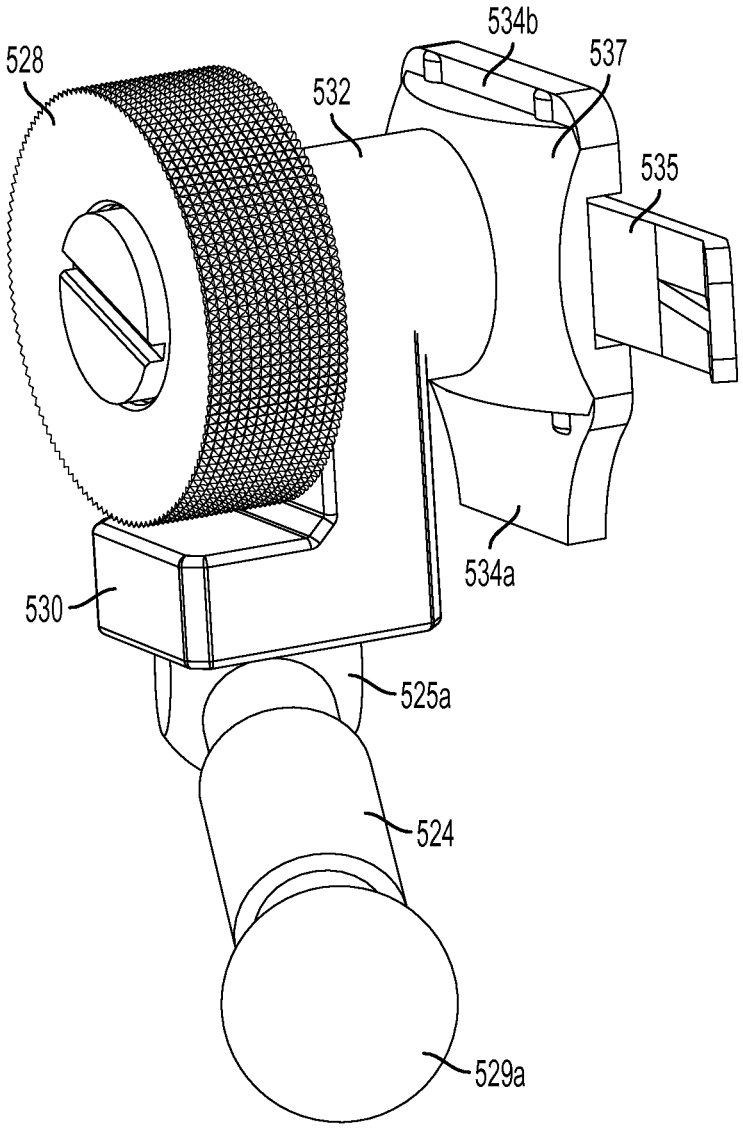
FIG. 23B is an enlarged perspective view of mount components of the external heads up display of FIG. 23.

An external heads-up display 520 is shown in FIGS. 23, 23A. The external heads-up display 520 has a base unit 527 with a display screen 522. A cable is connected to the base unit 526. The cable is capable of carrying data and electrical power the unit. The cable may connect to the rear of the accessory-mounting rim portion or may connect to an external source. The base unit 527 is supported by a supporting mechanism which includes a first arm 524 having a first ball mount connection 525 to a first base 530 and a second ball mount connection 529 connected to the base unit 527. Each ball mount comprises a ball 525*a*, 529*a*, a ball support shaft 525*a*, 529*b* extending from each respective ball, and a ball receiving recess. Each ball is received in the respective ball recess on either the base unit 527 or the first base 530. Each ball recess surrounds the ball 525*a*, 529*a* a sufficient amount to retain the ball 525*a*, 529*a* in the respective ball recess.

The first arm 524 has the second ball mount connection 529 at an end opposite the first ball mount connection 525, The second ball mount connection is received in the ball recess in the top surface 527*a* of the base unit 527. Extending from the ball recess is an arm accommodation depression 527*b*. The arm accommodation depression is recessed below the top surface 527*a* of the base unit 527. The arm accommodation depression allows a greater range of movement of the base unit relative to the arm.

In some embodiments, the first arm 524 may comprise a hollow portion 524*a* that receives the ball support shafts 525*b*, 529*b* at opposite ends. The support shafts are of a lesser diameter than the hollow portion 524*a* to allow a greater range of motion at the first and second ball mounts.

The first base 530 has a thumbscrew 528. The first base 530 connects to a connecting cylinder 532 which connects to an attachment base 537. In some embodiments, the first base 520 is integrally formed with the connecting cylinder 532. The first base 530 is pivotable about the axis of the cylinder 532. The thumbscrew provides compression friction to secure the first base 530 in a user selected position about the axis of the cylinder after it's been manipulated into the desired position by the user between the thumbscrew and the attachment base 537. The attachment base 537 has a lower attaching lip 534*a* and an upper attaching lip 534*b* at the bottom and top for engaging the lips 184, 187 of the front bracket portion to secure the external heads up display to the front bracket portion. In some embodiments the upper attaching lip is shorter than the lower attaching lip.

In some embodiments, the lower attaching lip 534*a* is drawn upward by pressing the button 535 so that lower attaching lip 543*a* comes out from behind lip 184 and the attachment base 537 can be removed from the front bracket portion. In some embodiments, the upper attaching lip 534*b* is drawn downward into the attachment base 537 by pressing the button 535 so that attaching lip 543*b* comes out from behind lip 187 and the attachment base 537 can be removed from the respective front bracket portion 180,181. In some embodiments, both the upper and lower attaching lips are drawn downward and upward respectively when the button 525 is pressed to release the attachment base 527 from the front mount. The movement of either or both of the lower and upper attachment lips 534*a*, 534*b* may be achieved with the button 535 attached to a mechanism (not show) similar or identical to that used in beads up display 500 for moving the upper and lower engagement rails 510, 511 relative to each other.

Communications System

Figure 24:
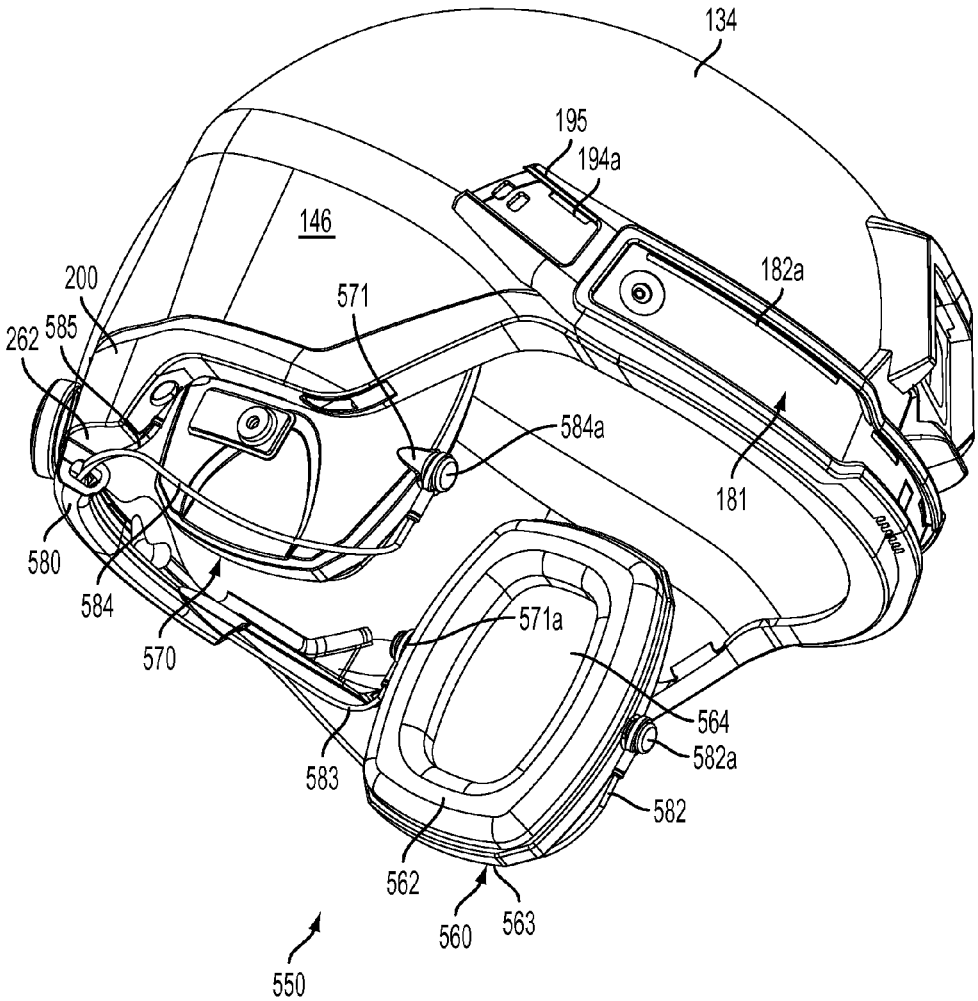
FIG. 24 is a right side perspective view of the helmet assembly of FIG. 1 with a communication system attached, and other parts removed.
Figure 31A:
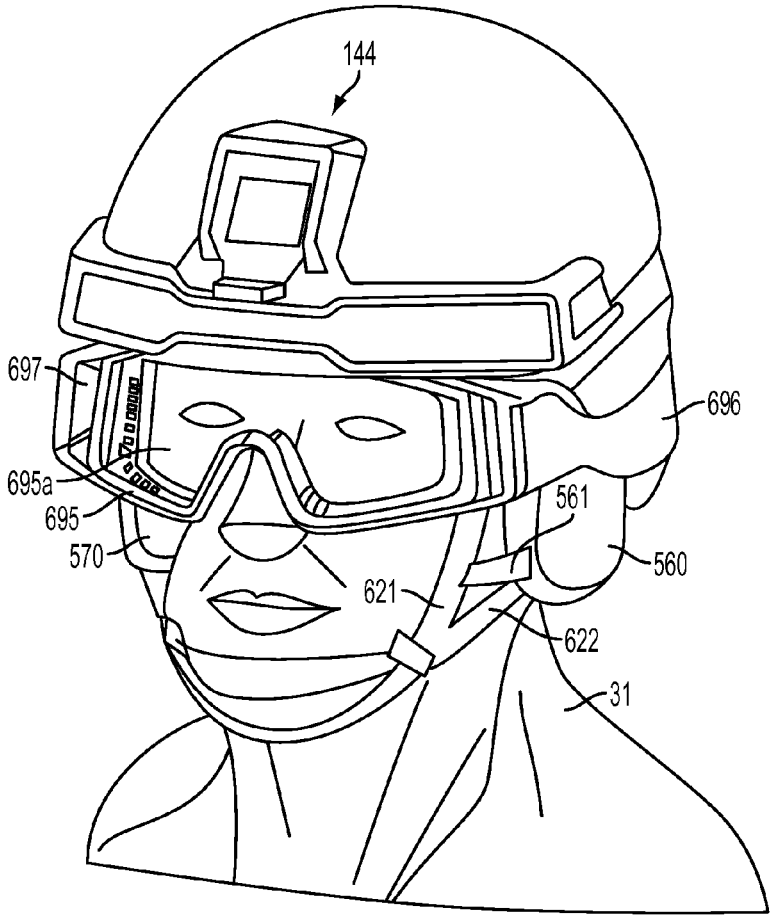
FIG. 31A is a front perspective view of the helmet assembly used with goggles and other parts removed.

The helmet assembly 100 may have a communications system 550 as shown in FIGS. 24 and 31A. The communication system 550 has a pair of ear cups 560, 570 and power wires 582, 584, data wires 583, 585, and an optional microphone 561. The power wires and data wires connect to power and data ports at the rear of the accessory-mounting rim portion. The wires are carried in the wiring conduit 580 that follows the lower back edge 262 of the accessory-mounting rim portion 200. The wiring conduit 580 may be comprised of a rubber or other flexible material. In one embodiment power and data is carried over at a single wire. In another embodiment, ear cups are battery powered and communicate wirelessly with the data source. The power and or data ports 571, 571*a* are located on opposite lateral sides of the ear cups. The wires have connectors 582*a*, 584*a* that are connectable to die power and/or data ports.

The ear cups 560, 570 have a padded region 562 that defines a perimeter of the ear cups and surrounds a recess portion 564. A padded region 562 may be configured to closely conform around a user's ear. The ear cups may be configured to provide ear protection against predefined decibel levels of audio sound originating outside the ear cups, such as might be created by machine operating noise, gunfire, or explosions. The recess portion 564 may comprise one or more speakers for delivering sound to a user's ear. The speakers may be connected to a communication device for communicating with other soldiers or a command center.

As the bulge of the ear coverage areas 146 is reduced in comparison with certain prior art helmets to achieve a closer conformity of the helmet with a user's head, the ear cups 560, 570 must have a lower profile in order to fit between the helmet and a user's head. Therefore the ear cups have a reduced thickness as compared with ear cups useable with certain prior art helmets. The thickness being die distance between the outermost surface of the padded region 562 and the outermost surface of the opposite side 563 of the ear cups. A microphone 561 may be mounted to one or more of die ear cups and extent a distance toward a user's mouth as shown in FIG. 31A. Alternatively, a microphone may be mounted to an inside surface of the mandible or other convenient place. Microphone wiring may be routed through the mandible to communicate with the conduit of the accessory-mounting rim portion.

Helmet Retention System

Figure 4:
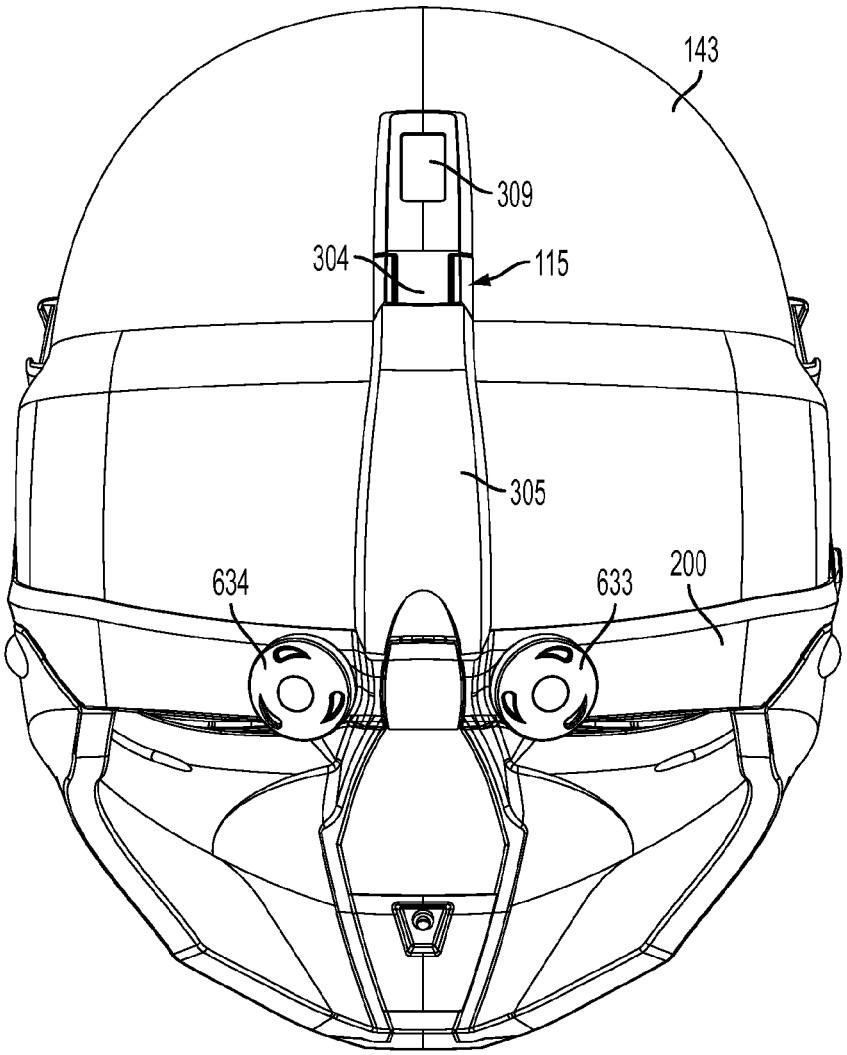
FIG. 4 is a rear view of die helmet assembly at FIG. 1.
Figure 25:
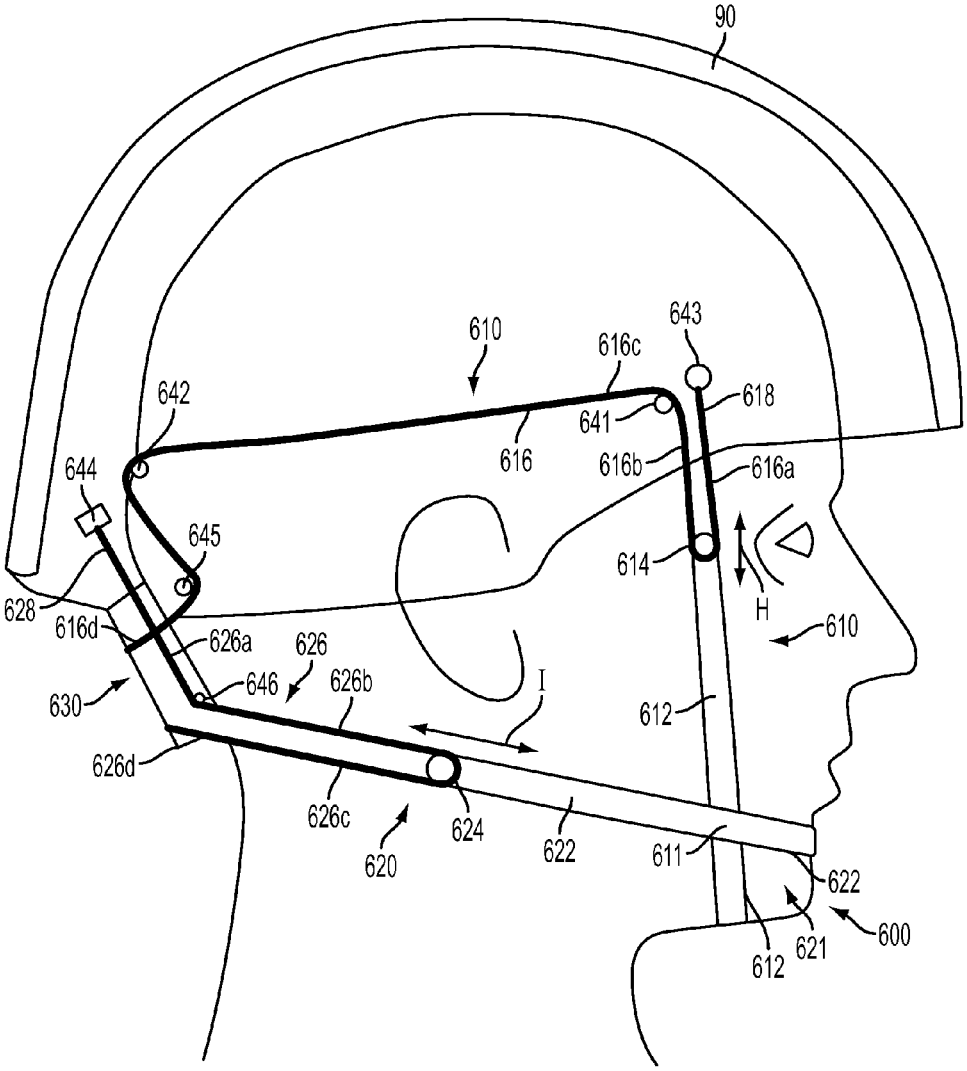
FIG. 25 is a right side schematic view of a helmet retention system.
Figure 26B:
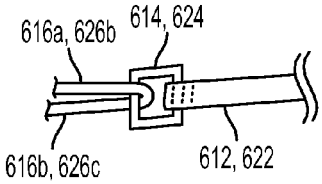
FIG. 26B is a front fragmentary schematic view of a contact strap, loop and reeling straps of the helmet retention system.
Figure 26A:
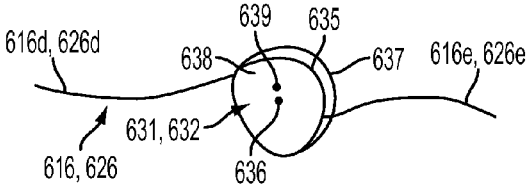
FIG. 26A is a perspective, schematic view of a reel of the helmet retention system.
Figure 26:
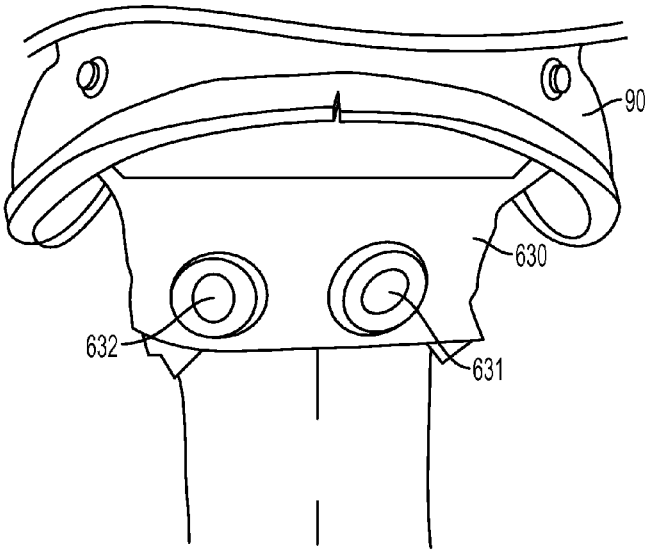
FIG. 26 is a rear view of a reel housing of the helmet retention system of FIG. 25.
Figure 27:
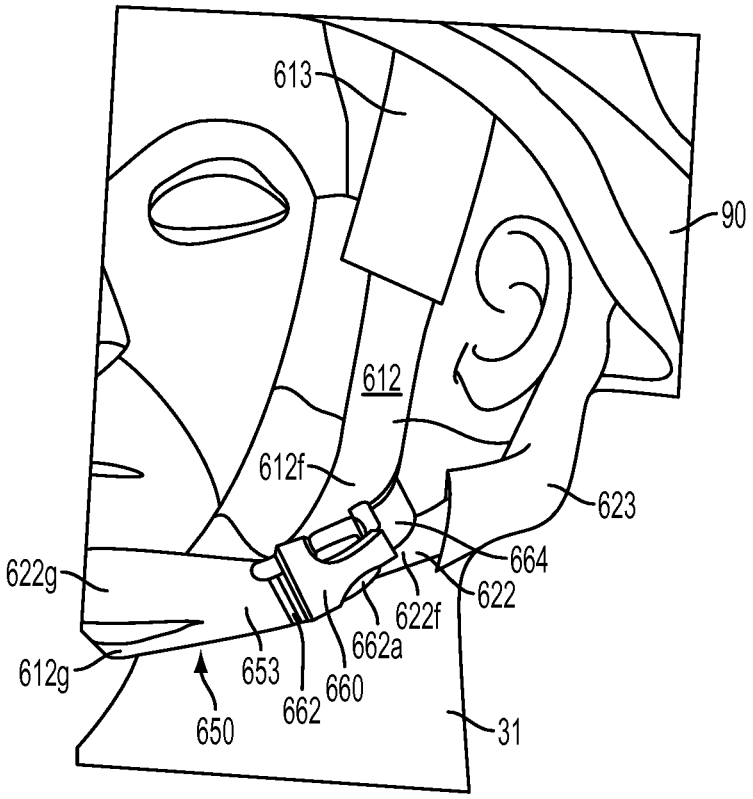
FIG. 27 is a perspective left side view of one embodiment of the helmet retention system.
Figure 29:
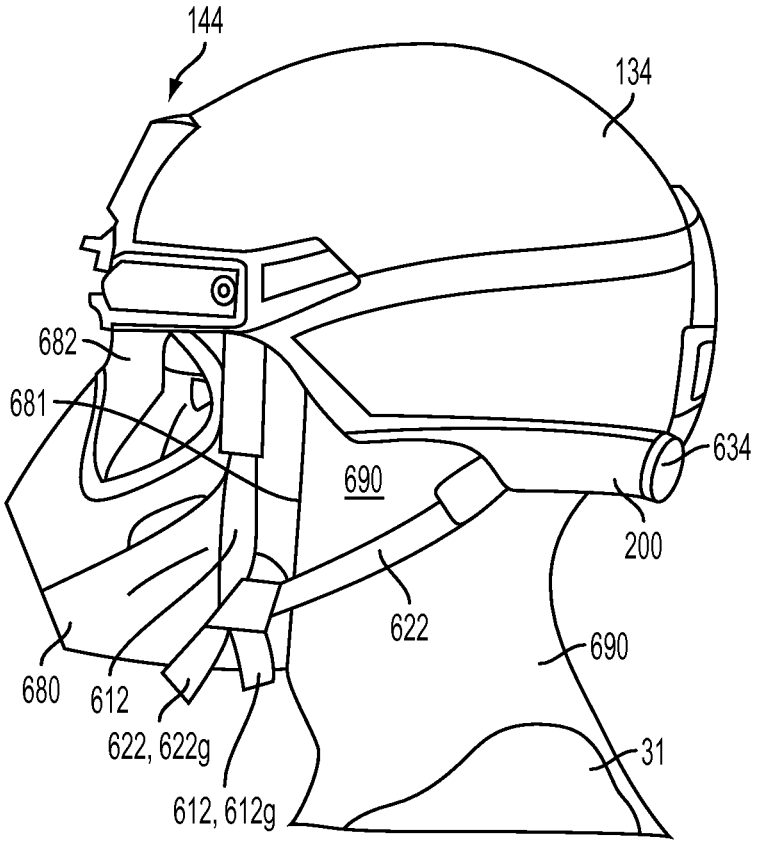
FIG. 29 shows a portion of the helmet assembly of FIG. 1, with the helmet retention system, a mask, a balaclava, and other parts removed.
Figure 30:
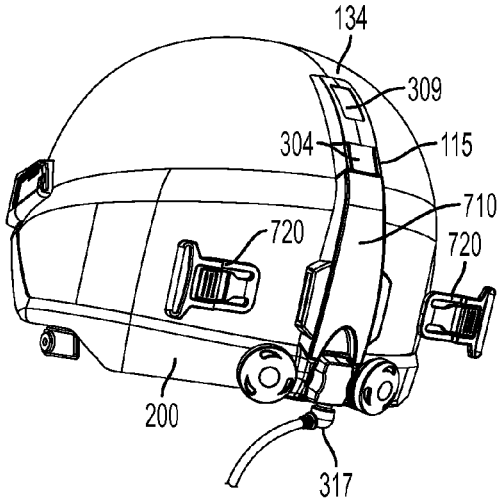
FIG. 30 is a rear perspective view of the helmet assembly with the goggle attachment system, with some parts not shown.

A helmet retention system 600 may be used with helmet 134 as shown in FIG. 29, or other helmets, such as helmet 90 shown in FIGS. 25-27. The helmet retention system is substantially a mirror image identical across the midplane 167 of the helmet, therefore a description of one side will explain the other. The helmet retention system 600 comprises a front strap system 610 and a lower strap system 620. The front strap system 610 has a first reeling strap 616, a first contact strap 612, and a first reel 631. The lower strap system 620 has a second reeling strap 626, a second contact strap 622, and a second reel 632. The first and second reels are housed in a reel housing 630. The reel housing 630 is enclosed in a soft armor neck pad for contacting the rear of a user's neck and/or head. In another embodiment, the reel housing may comprise the accessory-mounting rim portion such as shown in FIG. 4, with a first real 633, and a second reel 634.

Referring to the front strap system 610, the first reeling strap 616 is anchored at one end 618 to the helmet at a forward location adjacent a user's temple by a front anchor 643 at both sides of the helmet. In one embodiment, the front anchor is located on the accessory-mounting rim portion 200. Whether located on die helmet or on die accessory-mounting rim portion the front anchor is generally located between a user's eye and a user's ear, such as shown in FIG. 25. A downward extending portion 616*a* extends downward and is fed through a loop 614 attached to the first contact strap 612 (see FIG. 26B). After the loop 614, an upward extending portion 616*b* extends upward from the loop adjacent to, and in some versions substantially parallel to, the downward extending portion 616*a* until the first reeling strap reaches a first front system block 641. The first reeling strap 616 slides over the first block 641 and thereafter the first reeling strap extends rearward along a rearward extending portion 616*c* toward the rear of the helmet on a slightly declining angle to second front system block 642. The reeling strap 616 slides over the second block 642 and downward and forward to a third block 645 then rearward to the reel housing 630 and then to the first reel 631 with a reeling strap portion 616*d*.

The reels 631,632 are substantially the same and an exemplary reel indicated 631, 632 is shown in FIG. 26A. Both reels 631, 632 comprise a center hub 636 about which each reel spins. Both reels 631, 632 are circular and have a channel 635 defined by the outer disk walls 637, 638. The channel is for reeling, holding, and releasing the respective reeling straps 616, 626.

In one embodiment, the reel 631 may also include an anchor or fixation where a reeling strap is held at some place along a length of the reeling strap that is not an end of the reeling strap. The reeling strap 616 can be anchored at a midpoint along its length in the reel, where the length includes the reeling strap 616 on both sides of the helmet. Turning the reel 631 in a first direction draws both portions 616*d*, 616*e* of the reeling straps 616 located on opposite sides of the helmet into the reel and thereby increase the tension on the reeling strap 616 on both sides of the helmet and the associated contact straps 612, by raising the loops 614 on both sides of the helmet. Turning the reel in a second direction, opposite of the first direction, will spool out the reeling strap portions 616*d*, 616*e* in both direction and thereby release tension on the reeling straps 616 on both sides of the helmet and release tension on the contact straps 612 by lowering the loops 614 on both sides of the helmet.

As the reeling strap enters the reel 631 with reeling strap portion 616*d*, it can be anchored to the real as just described, and/or just wound around the reel a predetermined number of turns, and may be further/or lesser wound around the reel a number of times depending on the desired rotary position of the reel. The reeling strap portion 616*e* will extend out of the reel along to the opposite side of the helmet as shown in FIG. 26A. The reeling strap portion 616*e* is wound on the reel 631 in similar fashion in a same rotary direction. On the opposite side of the helmet, the reeling strap 616 continues from the strap portion 616*e* in a configuration mirror image identical to that shown in FIG. 25 and the reeling strap end is anchored in place in a mirror image identical location opposite that shown in FIG. 25. Therefore, opposite ends of the reeling strap 616 are anchored to the helmet in opposite front temple areas of the helmet or accessory-mounting rim portion. Likewise, the first contact strap 612 continues under a user's chin as shown in FIG. 25 to engage the first reeling strap 616 at a loop 614 on the opposite side of the helmet.

The front strap system 610 is configured to increase or decrease the downward tension in a forward area between a helmet 10 and the user's head. Turning the first reel will move the reeling strap 616 and the position of the loops 614 to move up or down in the direction H shown in FIG. 25 depending on the direction that the first reel 631 is turned.

The lower strap system 620 operates similar to that of the front strap system 610 but the lower strap system 620 is positioned differently than the front strap system. The second reeling strap 626 is anchored at one end 628 at a rear position of the helmet by a rear anchor 644. The anchor 644 may be positioned on the helmet behind the rear of a user's head when viewed from the side as shown in FIG. 25. In one embodiment, the anchor 644 is located on the accessory-mounting rim portion in an area on or near the lower back edge 262. The second reeling strap 626 extends from the anchor 644 downward along a downward extending portion 626*a* and forward to a first lower system block 646. The first block may be on the helmet, on the accessory-mounting rim portion, on the reel housing. The second reeling strap 626 then extends forward toward a users ear, on a forward portion 626*b* to a loop 624 attached to the second contact strap 622. The second reeling strap 626 loops back around loop 624 (see FIG. 26B) and extends rearward along rearward portions 626*c*, 626*d* to the second reel 632. The rearward portion 626*c* travel adjacent, and some configurations, substantially parallel to the forward portion 626*b*.

As the second reeling strap 626 enters the reel 632 with strap portion 626*d*, it can be anchored or fixed to the reel at some place along its length, and/or just wound around the reel a predetermined number of turns, and may be further/or lesser wound around the reel a number of times depending on the desired position of the reel, and reeling strap portion 626*e* will extend out of the reel along to the opposite side of the helmet as shown in FIG. 26A. On the opposite side of the helmet, the reeling strap 626 continues in a configuration mirror image identical to that shown in FIG. 25 and the reeling strap end is anchored in place to an anchor 644 in a mirror image identical location opposite that shown in FIG. 25. The reeling strap portion 626*e* is wound on the reel 632 in similar fashion in a same rotary direction. On the opposite side of the helmet, the reeling strap 626 continues from the strap portion 626*e* in a configuration mirror image identical to that shown in FIG. 25.

Therefore, opposite ends of the reeling strap are anchored to the helmet in opposite rear areas of the helmet. Likewise the second contact strap 622 is configured to continue over the front of a user's chin as shown in FIG. 25 to engage the second reeling strap 626 at a loop 624 on both, opposite sides of the helmet. The open area chin cup 621 configuration provided by the first contact strap 612 and the second contact strap 622 and the gap therebetween below the contact or cross point 611 secures the contact with the users chin while leaving an open area of the users chin for a more comfortable fit. Further, the open configuration in the chin area does not interfere with weapons sighting and is accessible with the visor deployed and/or the mandible deployed.

The lower strap system 620 is configured to increase or decrease the downward tension in a rear area between a helmet 90 and the user's head.

The reeling strap 626 can be anchored at a midpoint along its length in the reel 632, where the length includes the reeling strap 626 on both sides of the helmet. Turning the reel 632 in a first direction draws both portions 626*d*, 626*e* of the reeling straps 626 located on opposite sides of the helmet into the reel 632 and thereby increase the tension on the reeling strap 626 on both sides of the helmet and the associated contact straps 622, by moving rearward the loops 624 along the direction I on opposite sides of the helmet. Turning the reel in a second direction, opposite of the first direction, will spool out the reeling strap portions 626*d*, 626*e* in both direction and thereby release tension on the reeling straps 626 on both sides of the helmet and release tension on the contact straps 622 by moving forward the loops 624 along the direction I on both sides of the helmet.

Each of the front strap system 610 and the lower strap system 620 are adjustable by turning the corresponding reels 631, 632. Therefore the helmet retention system 600 may be adjusted by a user using only one hand. This is an improvement over the prior art systems that require several buckles where the strap may be threaded and adjusted their through. Some prior art retention systems have as many as five buckles or points of adjustment for adjusting the various straps use to secure the helmet to a user's head.

In one embodiment, the contact straps 612, 622 may be divided as shown in FIG. 27 to provide for a detachable chin contact portion 650. In this arrangement portions of the contact straps may disconnect from one another on opposite lateral side of a user's face. The chin contact portion 650 has a lower chin contact strap 612*g* and a front chin contact strap 622*g*. The lower strap 612*g* and the front strap 622*g* join at a first junction 653 the end of which has a loop that engaged a male portion 662 of a buckle. The male portion 662 is releasably engageable with a female portion 660 of the buckle. A lower left side portion 612*f* of the first contact strap 612 joins with a forward left side portion 622*f* of the second contact strap 622 at a second junction 664. The second junction 664 attaches to the female portion 660 of the buckle. In one embodiment, a substantially mirror image identical buckle is used on the right side of the user's face, so that the chin contact portion 650 may be released from either side. In another embodiment, a buckle is only provided on one side and the contact straps extend to connect at the buckle and are joined thereby.

The connection of the reeling straps to the contact straps may be covered by sleeves 613, 623 as shown in FIG. 27 to prevent chaffing or irritation of a user's skin by the movement of the reeling straps or the contact straps and the loop 614, 624. Further, other portions of the reeling straps may be covered by a sleeve or may be contained in a conduit to prevent user contact with the reeling straps.

Mask

The helmet assembly 100 may be used with a mask 680 as shown in FIG. 29. The front inside surfaces of the helmet positively contact the top of the mask, providing stability. The inside surface contact may include contact with helmet padding. The open area chin cup 621 is compressed so that both the contact straps extend under the chin. The mask may have one or more lenses 682 allowing a user to see through. The mask extends rearward to a back edge 681. The mask may protect against chemical, biological, nuclear, and/or radiological exposure or threats. Mask may be used with or without a balaclava 690 for covering the whole head of a user exposing only part of the face, which may be covered by a mask. The balaclava may protect against chemical, biological, nuclear, and/or radiological exposure or threats.

Goggle Attachment System

The helmet assembly 100 may have a goggle attachment system 700 shown in FIGS. 30, 31A-31D to secure protective goggles 695 with a protective lens 695*a* to a user's face. The goggles may be those made commercially available by Revision Military Ltd. of Vermont and known as DESERT LOCUST goggles, ASIAN LOCUST goggles, WOLFSPIDER goggles, or BULLET ANT goggles.

The goggle attachment system 700 has an anchor tower 710 with goggle clip receivers 702, 704 on opposite lateral sides of the anchor tower. The goggle clip receivers 702, 704 each have a slot 701 to receiving a goggle clip 720. The anchor tower 710 may include a battery such as contained in battery pack 305 and therefore the anchor tower may be used in place of battery pack 305. The anchor tower 710 when used with the helmet and/or accessory-mounting rim portion will be positioned along the midplane 167 of the helmet at the rear as shown in FIG. 31E. The anchor tower 710 includes the snap-in tab or securing connection 302 and the catch strip 304 as previously described for attaching the rear tower of FIG. 14C. Thus, the tower is captured at its lowest end by the tab 302 into the accessory-mounting rim portion and prevented from vertical dislodgement by the catch strip 304 being held horizontally by the claws 115*a*, 115*b* of the top mount 115 and prevented from vertical movement by shoulders 710*a* of the tower abutting a bottom of the mount 115.

The clip 720 has a peripheral edge 728 surrounding a flexing portion 723. The flexing portion is connected to the peripheral edge by a bridge 729. The peripheral edge has a step 728*c*, an inset portion 728*a*, and a raised portion 728*b*. The raised portion 728*b* is closer to the strap loop opening 725 than the inset portion. The inset portion is adjacent the bridge 729. The raised portion 728*b* connects to a loop bar 724 that defines a portion of the strap loop opening 725. A goggle strap 696 or other eyewear or accessories strap may be secured around the strap loop opening 725. The oppose end of the goggle strap may be attached to a goggle as shown in FIG. 31A. There is a gap 721 on three sides of the flexing portion between the flexing portion and the peripheral edge.

The flexing portion 723 has a first portion 727 separated by a recess 726 from a second portion 722. The boundary 726*a* between the recess 726 and the second portion 722 is substantially coplanar with the step 728*c*. The first portion 727 rises or slopes rearward (out of the page of FIG. 31D) from the bridge 729 towards the recess 726. The second portion 722 rises or slopes rearward (out of the page of FIG. 31D) from an end 722*a* opposite the bridge, toward the recess 726. The first portion rises (out of the page of FIG. 31D) more aggressively than the second portion. The second portion 722 rises to a more outward position (out of the page of FIG. 31D) than the most outward position (out of the page of FIG. 31D) of the first portion 727.

Figure 31C:
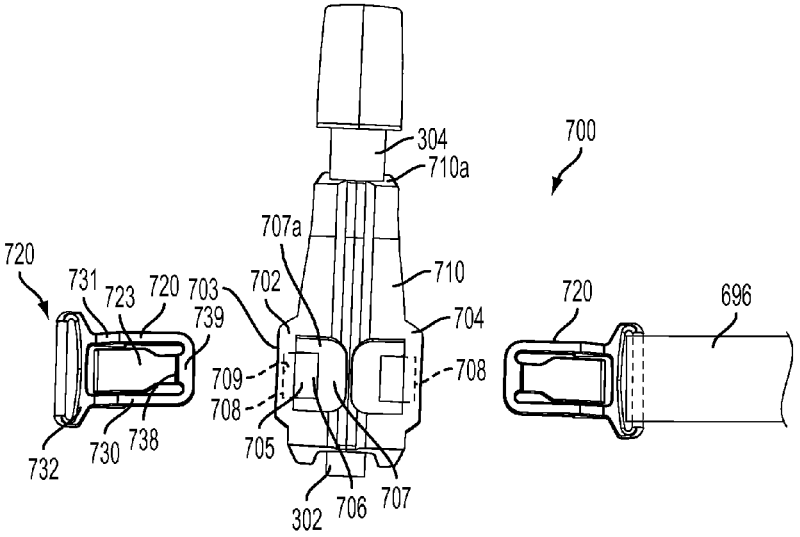
FIG. 31C is a front view of the goggle attachment system of FIG. 31B.
Figure 31D:
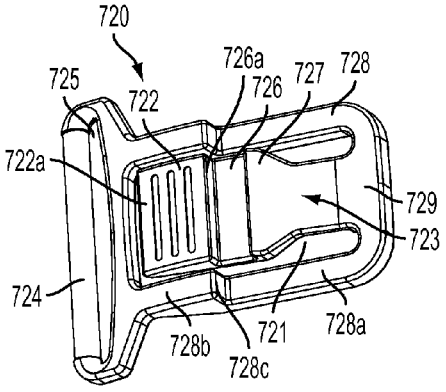
FIG. 31D is a perspective rear view of a clip of the goggle attachment system of FIG. 31B.
Figure 31B:
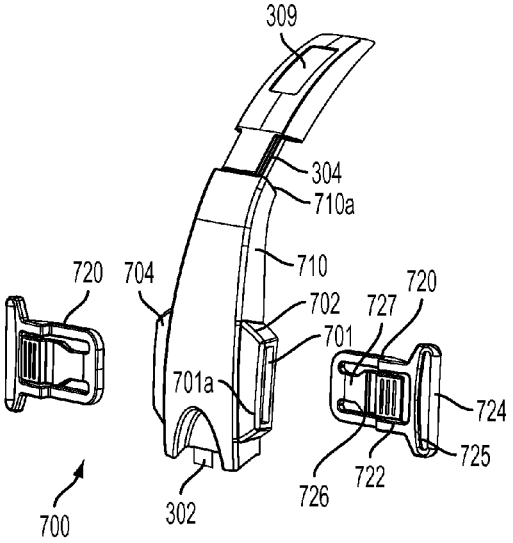
FIG. 31B is a rear perspective view of a goggle attachment system of FIG. 30.

The front face (with respect to the front direction of the helmet) of the clips 718 and anchor tower 710 are shown in FIG. 31C. The front peripheral edge surface 730 is substantially flat. The front surface of the bridge portion 739 is substantially flat. A step 738 is located where the bridge portion connects with the flexing portion 723 on the front side of the clip. Therefore, the flexing portion 723 is positioned more rearward (into the page of FIG. 31C, out of the page of FIG. 31D) than the bridge portion on the front side of the clip and the step 738 provides the connection. The flexing portion 723 has a default position which is more rearward (extending into the page of FIG. 31C, out of the page of FIG. 31D) than the front peripheral edge surface 730. This configuration allows the flexing portion 723 to flex forward (out of the page of FIG. 31C, into the page of FIGS. 31D and 31B) as the clip is pressed into the clip receiver.

Only one of the goggle clip receivers 702, 704 will be described as they are mirror image identical across the midplane 167. The slot 703 has peripheral engagement surface 707*a* continuous with an end engagement surface 707 and an entry raised portion 708. The entry raised portion 708 extends forward from one side off the slot 703. The entry raised portion 708 is sized and shaped to fit into the recess 726 of the clip 720. It can be a rectangular block shape. The peripheral engagement surface 707*a*, the end engagement surface 707, and the side raised portion 708 surround a recessed portion 705. The peripheral engagement surfaces 707*a* are configured to contact the inset peripheral edge portion 728*a* of the goggle clip.

As the clip is inserted into the slot of the clip receiver, the first portion 727 contacts the entry raised portion 708 of the clip receiver. As the clip is further inserted into the slot 703, the entry raised portion 708 of the clip receiver forces the flexing portion 723 of the clip forward (into the page of FIGS. 31B and 31D) as the first portion 727 continues contact with the entry raised portion 708. The flexing portion 723 of the clip continues to be pushed forward to the point where the recess 726 of the clip registers with the entry raised portion 708. When this occurs, the entry raised portion 708 is received in the recess 726 and secures the clip in the clip receiver as this spring force of the flexing portion 723 pushes the recess 726 rearward (out of the page of FIGS. 31B and 31D) to capture the entry raised portion 708. In this configuration, the entry raised portion is secure between the first portion 727 of the clip and the second portion 722 of the clip. In addition, when the clip is secured in the clip receiver, the entry raised portion 708 of the clip receiver is located in the recess 726, the step 728*c* of the clip is engaged against, or in close proximity to a face 701*a* of clip receiver.

To release the clip from the clip receiver, the second portion 722 of the flexing portion of the clip is pressed forward (into the page FIG. 31D) by a user to release the entry raised portion 708 of the clip receiver from the recess 726 of the clip. The forward pressure continues until the rear most portion (out of the page FIG. 31D) of the first portion 727 is depressed forward (into the page FIG. 31D) of the entry raised portion 708 of the clip receiver. Once the first portion 727 is depressed forward of the side 709 of the entry raised portion 708 of the clip receiver, the clip can be withdrawn laterally from the clip receiver.

Face Shield and Mounting Arrangement

The details of the face shields 38, 138 and the mounting arrangement 142 are shown in FIGS. 32-46. FIGS. 33, 35-38, and 38B show the mounting arrangement 142 used on mount 44 which is attached or attachable to helmet 34 as provided in U.S. patent application Ser. No. 12/875,106, filed Sep. 2, 2010. However, mounting arrangement 142 is adapted to attach and readily attachable to the front mount 144. Further, FIGS. 33, 34, 36-38, 38B, 38C, and 40-43 show the mounting arrangement 142 used with face shield 38 having a frame 95 and a lens 94. However, the face shield 38 can be replaced by face shield 138 having frame 101 and attached to the mounting arrangement 142 so that the frame may be held against or in close proximity to the front top brim of the accessory-mounting rim portion 200 and may hold the lens 102 adjacent thereto. The mounting arrangement 42 of U.S. patent application Ser. No. 12/875,106, filed Sep. 2, 2010, is substantially the same as mounting arrangement 142.

Figure 32:
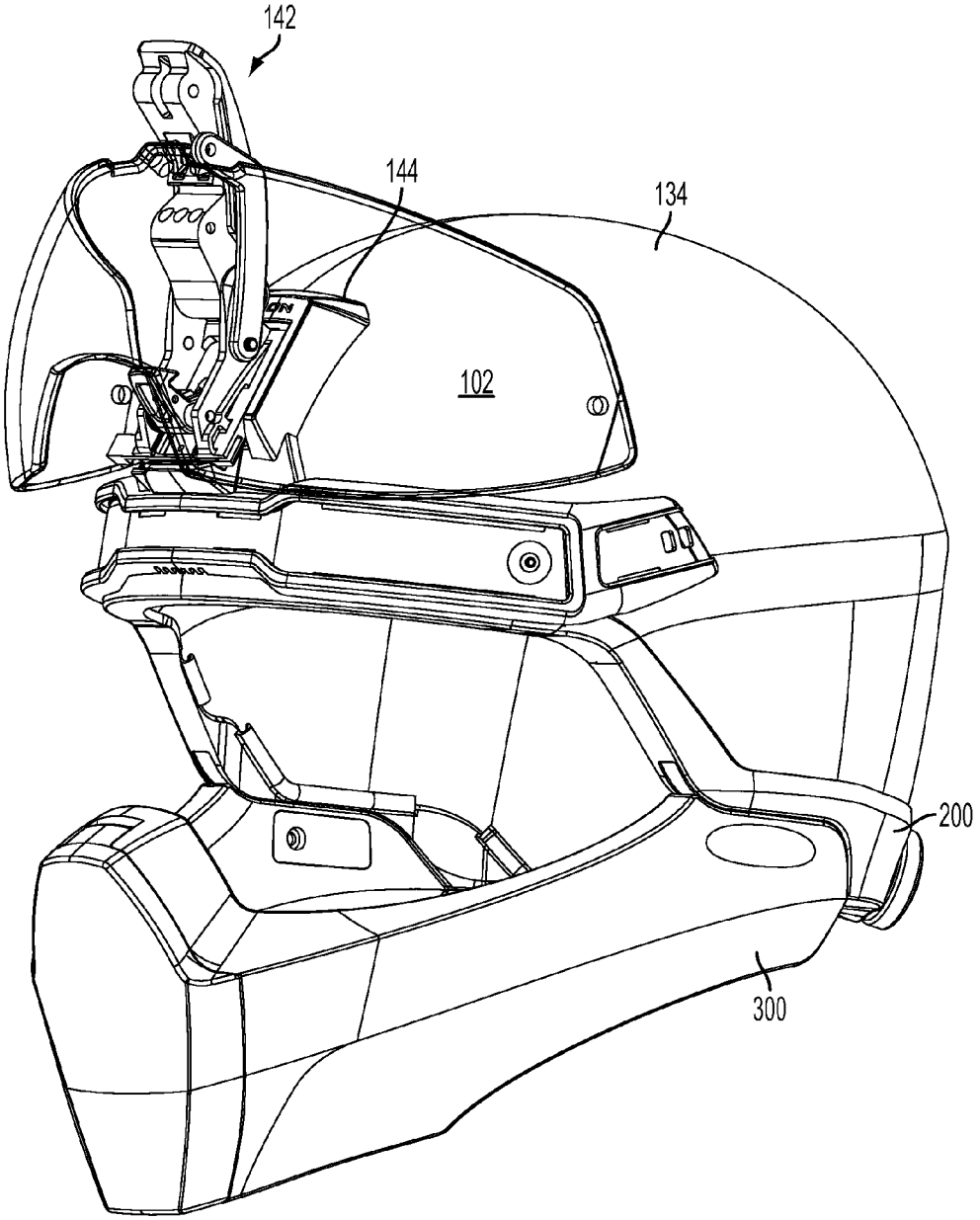
FIG. 32 is a left side perspective view of the helmet assembly of FIG. 1 with the face shield and the mounting arrangement in the standby raised position.

FIG. 32 shows the mounting arrangement 142 and the lens 102 attached to front mount 144 and in a raised standby position above the user's eyes. The frame 101 for attaching with arms 1114*a*, 1114*b* is not shown.

Figure 33:
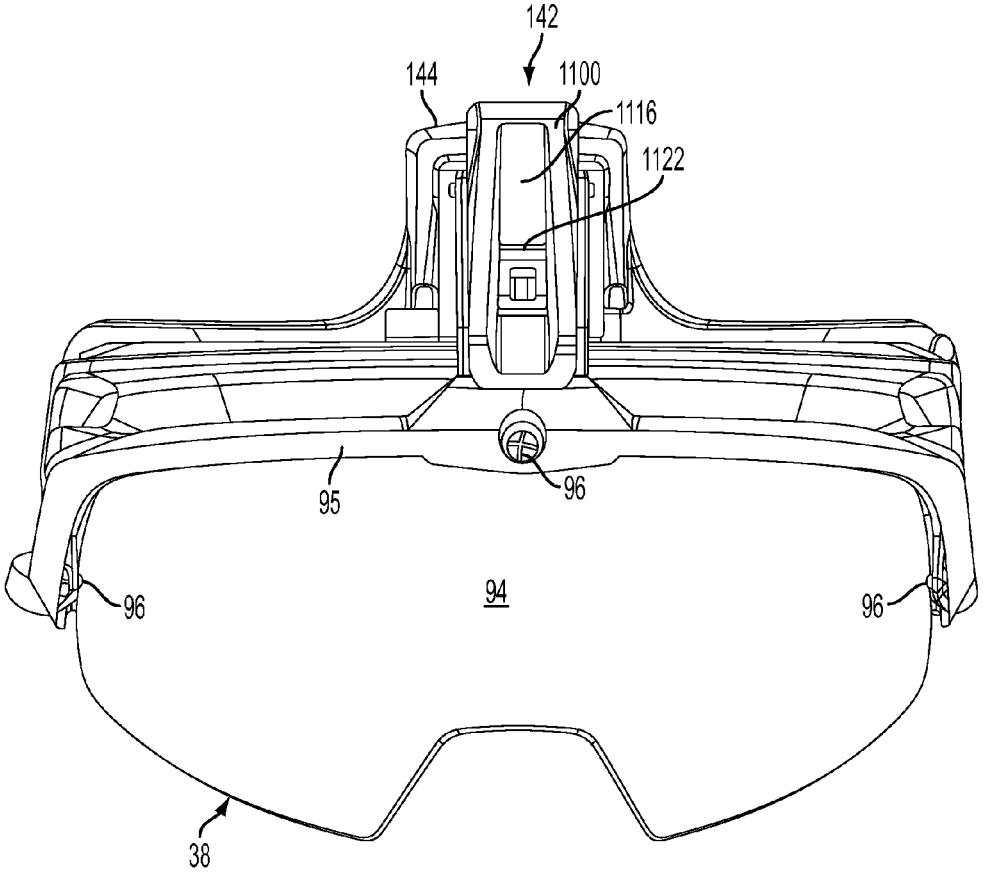
FIG. 33 is a front view of a mounting arrangement attached to an alternate front mount.
Figure 39:
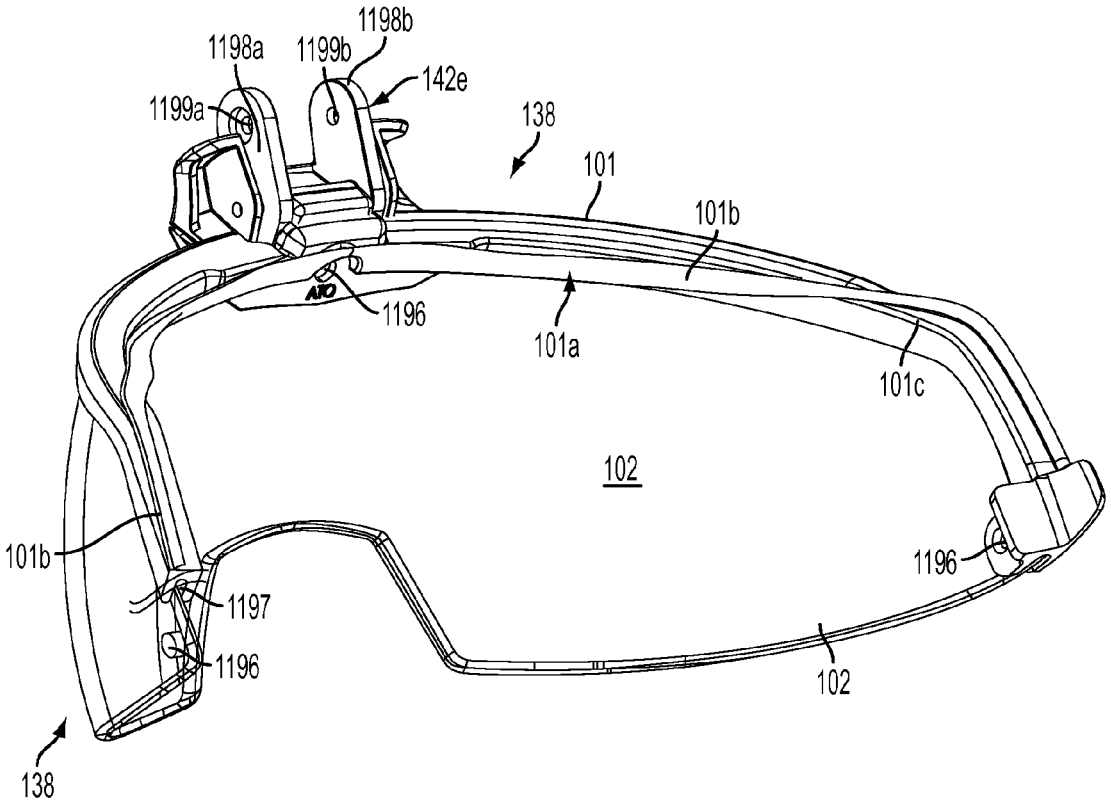
FIG. 39 is a rear perspective view of a face shield assembly shown in FIG. 1 with portions removed for explanation of underlying features.
Figure 40:
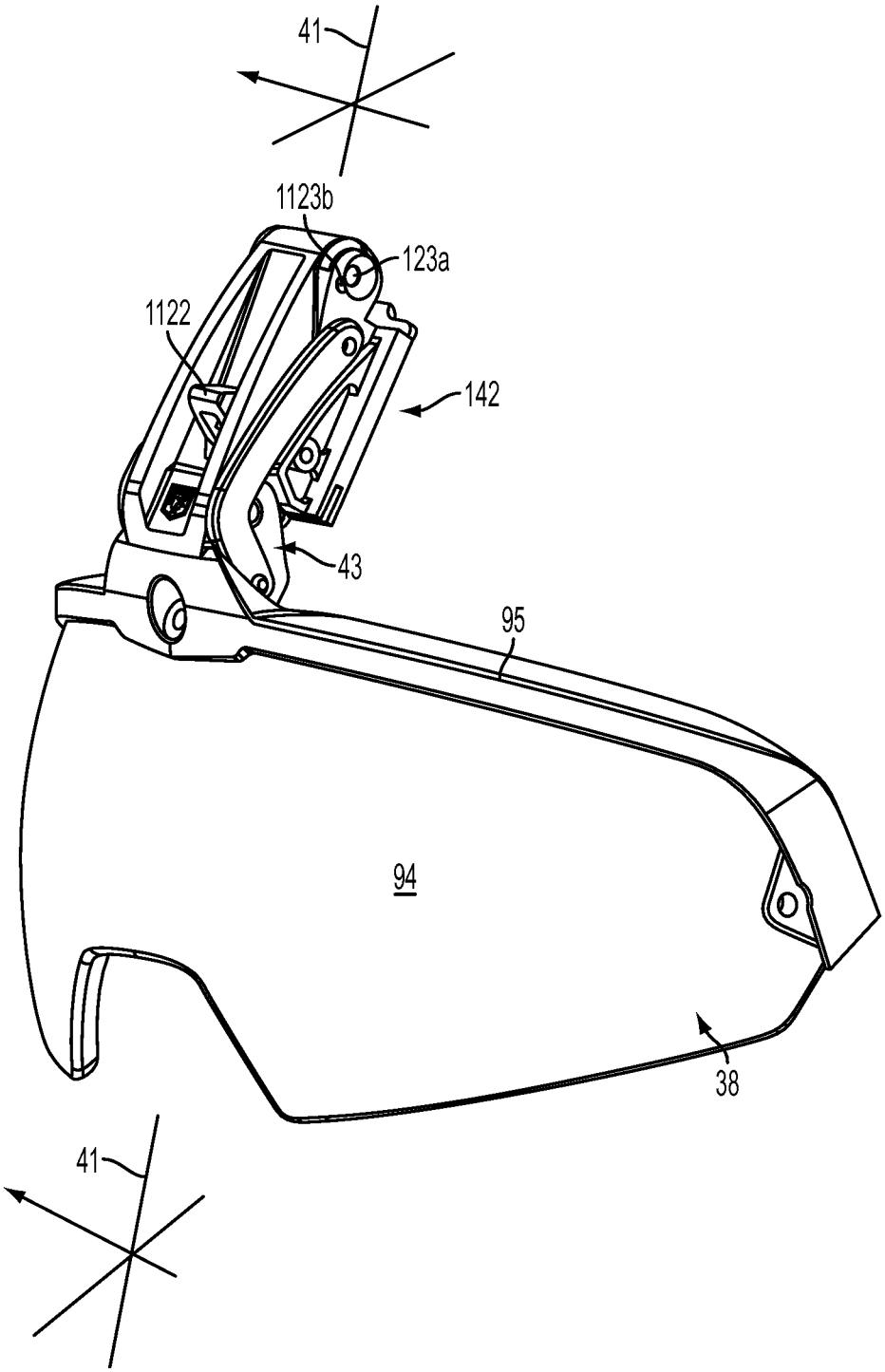
FIG. 40 is a perspective view of the face shield and mounting arrangement in a lowered, use position, but slightly open for ventilation.

In one embodiment, the face shield 38 comprises a lens 94 and a frame 95. In another embodiment, the face shield 138 comprises lens 102 and frame 101 as shown in FIG. 39. The lens 94 fits within a groove 97 (FIG. 34) in the frame 95 and is fixed to the frame by three screws 96 (FIG. 33).

The lens 102 fits within a groove 1197 (FIG. 39) in the frame 101 and is fixed to the frame by via three holes 1196 where screws (not shown) may be provided. For military use particularly, the face shield lens 94, 102 should be ballistic impact resistant. It can be of a laminated construction and can feature a variable light transmission system. Such a variable light transmission system can incorporate an electronic control system to vary the light transmission according to the ambient light conditions.

The face shield frame 95 is mounted to the mounting arrangement 142 via the shield mount 43. The shield mount 43 comprises parallel lugs 98*a*, 98*b* (FIG. 38). The lugs 98*a*, 98*b* include holes 99*a*, 99*b* for receiving pins 99*c* (only one shown, FIG. 38). Each pins 99*c* passes through a hole 1101 (FIG. 37) formed through sides in a base portion 1102 (FIG. 36) of a lever 1100, and are held in place by the head of the pin and a circlip or lock washer 99*d*. The lever 1100 includes a hole 1103 (FIG. 36) through a distal end thereof. A pivot pin 1107 (FIG. 37) is fit though the hole 1103 and is fixed to sidewalls 1110*a*, 1110*b* (FIG. 38) which extend outward from a baseplate 1112. L-shaped side links 1114*a*, 1114*b* are pinned at one end to the lugs 1110*a*, 1110*b* and at an opposite end to the lugs 98*a*, 98*b*.

Face shield frame 101 is mounted to arrangement 142 via the shield mount 142*e* in a substantially similar manner to the configuration mounting the shield frame 95 to the mounting arrangement 142 via the shield mount 43. The shield mount 142*e* comprises parallel lugs 98*a*, 98*b* (FIG. 38). The lugs 1198*a*, 1198*b* include holes 1199*a*, 1199*b* for receiving pins 1199*c* (only one shown, FIG. 38). Each pins 99*c* passes through a hole 1101 (FIG. 37) formed through sides in a base portion 1102 (FIG. 36) of a lever 1100, and are held in place by the head of the pin and a circlip or lock washer 99*d*.

Figure 36:
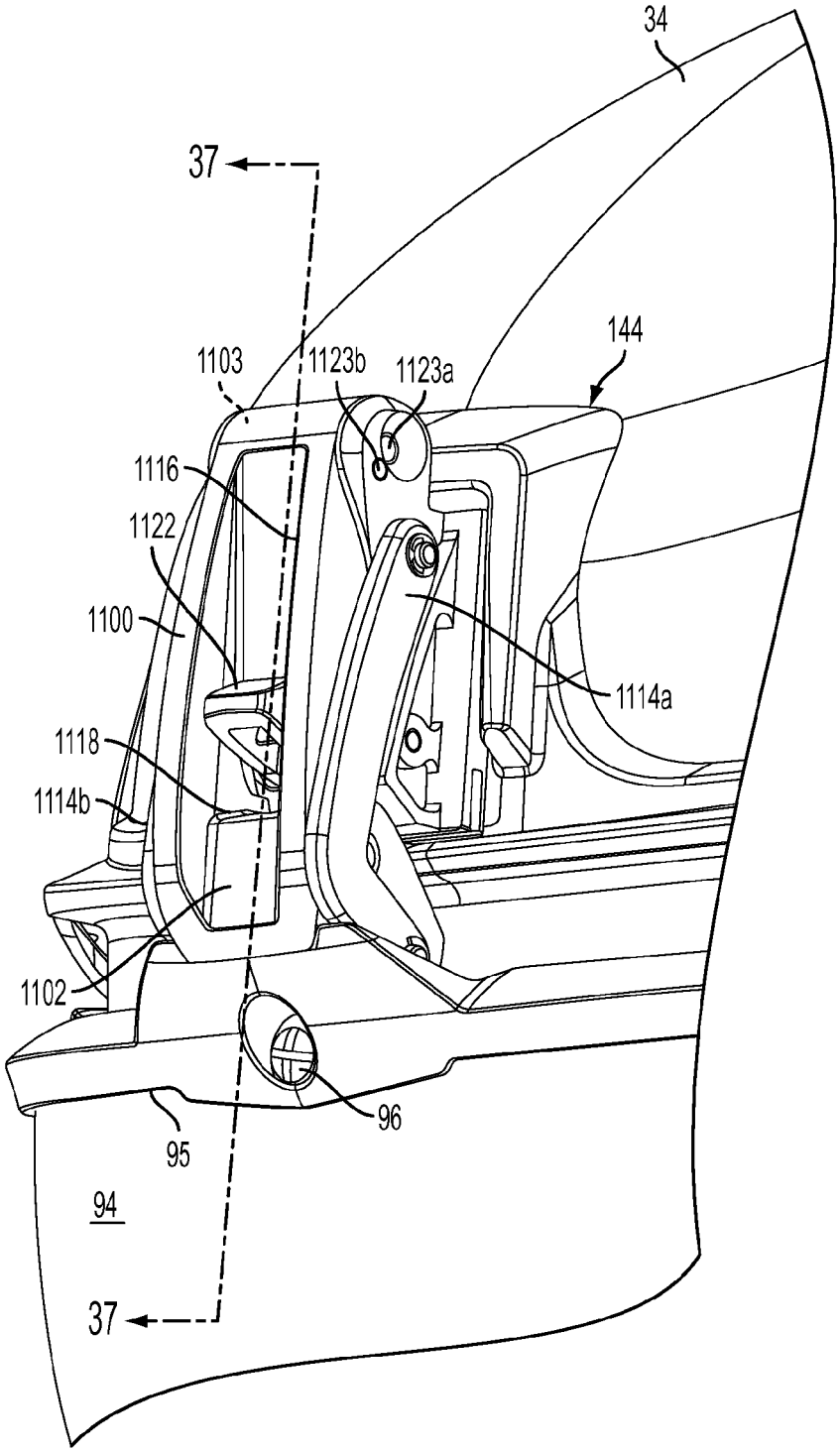
FIG. 36 is a front perspective view of the mounting arrangement attached to an alternate front mount.
Figure 37:
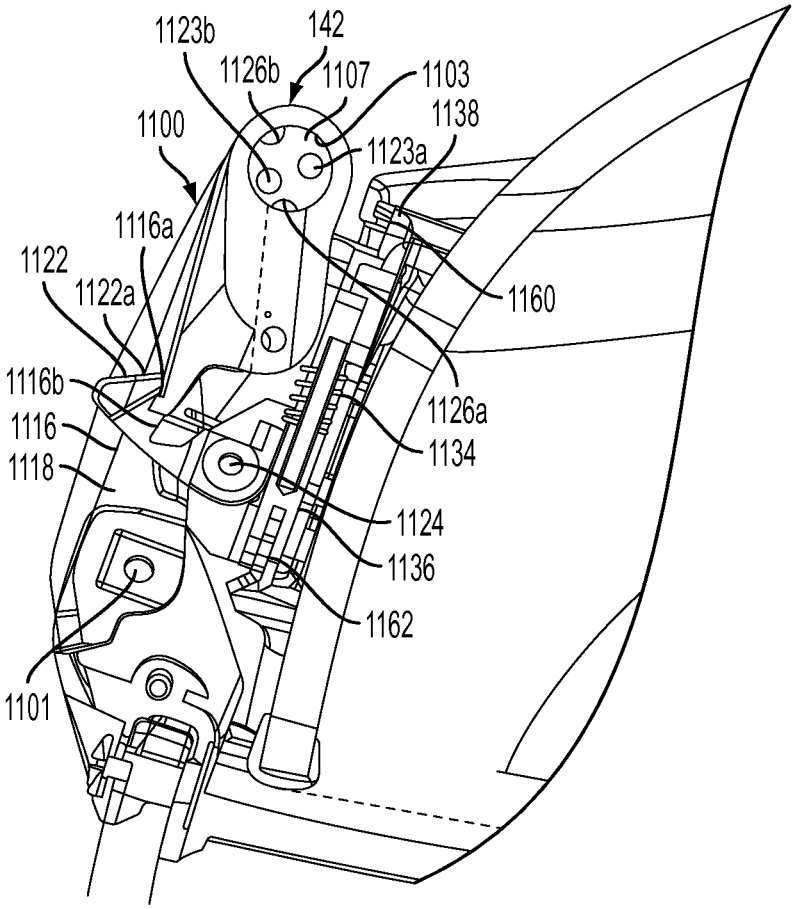
FIG. 37 is a sectional view taken generally along line 37-37 of FIG. 36.
Figure 38:
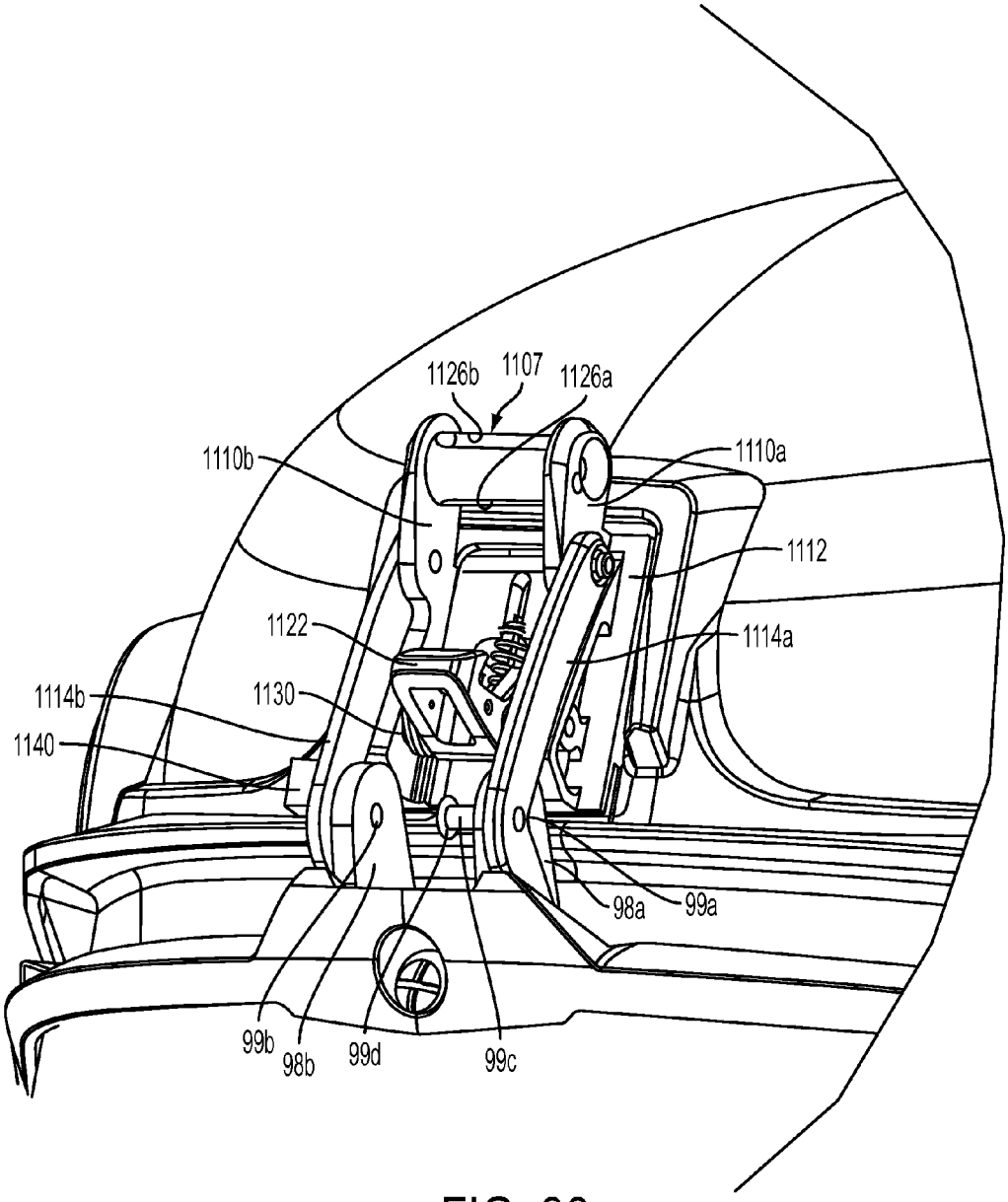
FIG. 38 is a front perspective view of the mounting arrangement shown in FIG. 36 with portions removed for explanation of underlying features.

The lever 1100 has a central recess 1116 (FIGS. 36 and 37). An opening 1118 is provided within the central recess 1116. A hook-shaped latch 1122 (FIGS. 36, 37 and 38) has a base end pivotally attached to the sidewalls 1110*a*, 1110*b* by a through pin 1124 (FIG. 37). The latch extends outwardly through the opening 1118. The latch is biased to rotate upward to a latched position by a torsion spring 1130 (FIG. 38). When the face shield is moved from the upward, non-use or standby position down to the deployed position as shown in FIG. 1, the lever slides over the angular face 1122*a* of the latch, which causes rotation of the latch downward as the book end passes through the opening 1118. Once the hook end of the latch is through the opening 1118, the latch rebounds by the urging of the torsion spring to rotate upward and the hook end overlies a first recessed surface 1116*a* of the lever adjacent to the opening 1118. The latch 1122 holds the lever 1100 and the face shield 38, 138 in the deployed position. The latch 1122 can also be made to overlie a second recessed surface 1116*b* to hold the face shield in a slightly open position with respect to the helmet and mandible. To move the face shield 38, 138 to the slightly open position or the tilted up, non-use position, the hook end 1122*a* of the latch must be depressed downward by a finger to release the latch from the lever and the face shield can be pivoted upward.

The pivot pin 1107 is fixed to the sidewalls 1110*a*, 1110*b* by use of a threaded screw 1123*a* and a spring pin 1123*b* on each end of the pivot pin 1107 for each sidewall 1110*a*, 1110*b*, The spring pin 1123*b* is a pin having a portion that is larger than a hole in the pivot pin 1107 such that it must be resiliently or deformable forced into the hole to hold the pivot pin 1107 fixedly to the sidewalls 1110*a*, 1110*b*. The use of a spring pin prevents unscrewing of the screw 1123*a* due to the repetitive raising and lowering of the face shield.

Figure 41:
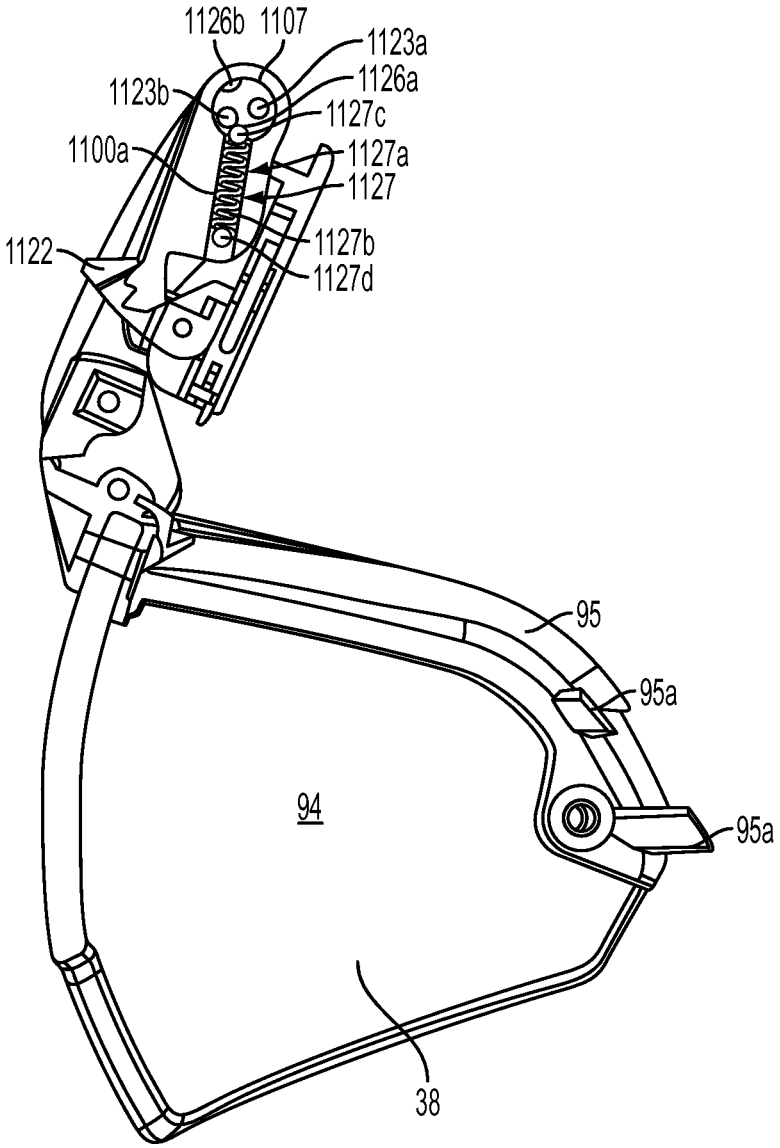
FIG. 41 is a sectional view taken generally along line 41-41 shown in FIG. 40.
Figure 42:
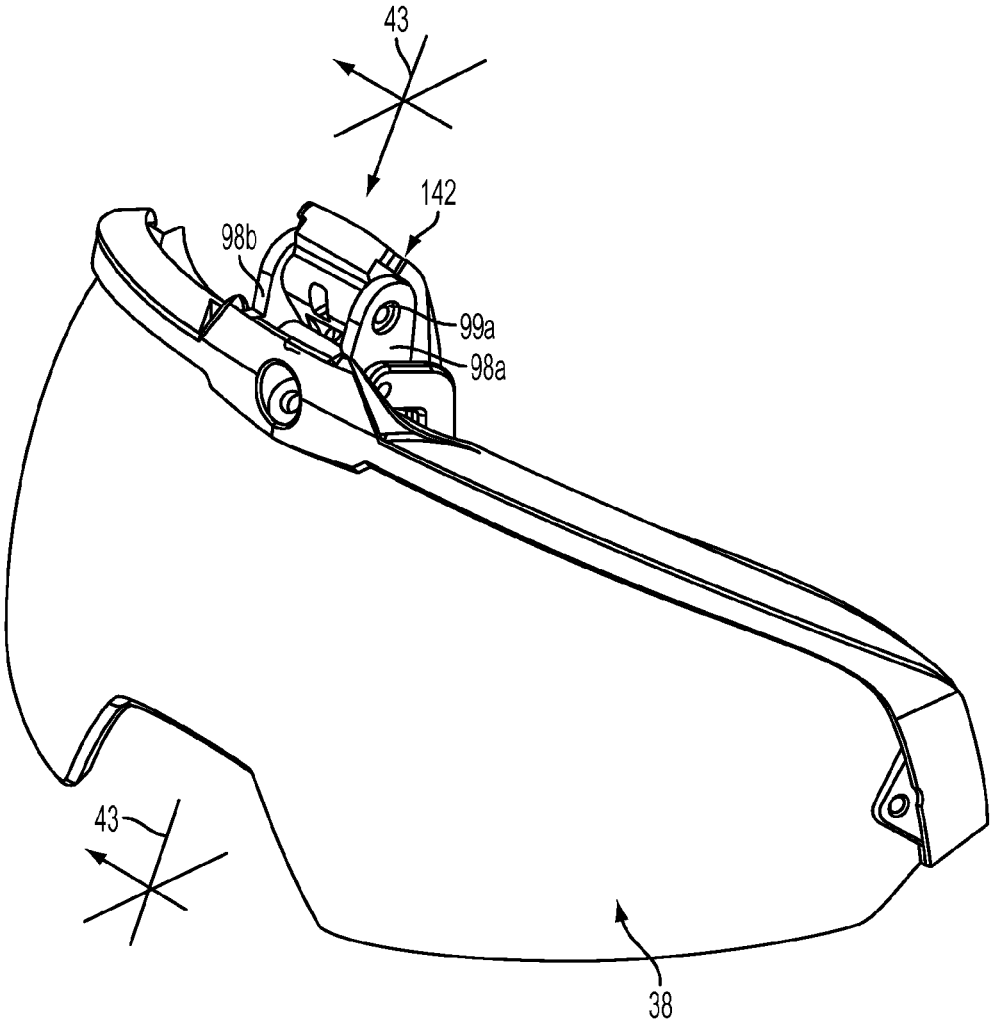
FIG. 42 is a perspective view of the face shield and mounting arrangement shown in a raised, non-use position, such as shown in FIG. 32.
Figure 43:
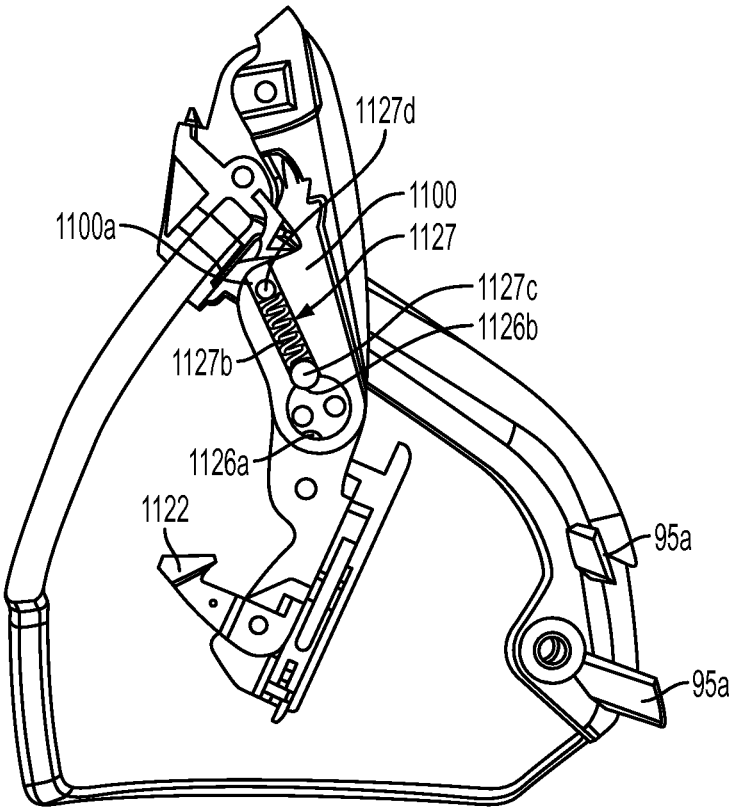
FIG. 43 is a sectional view taken generally along line 43-43 shown in FIG. 42.
Figure 44:
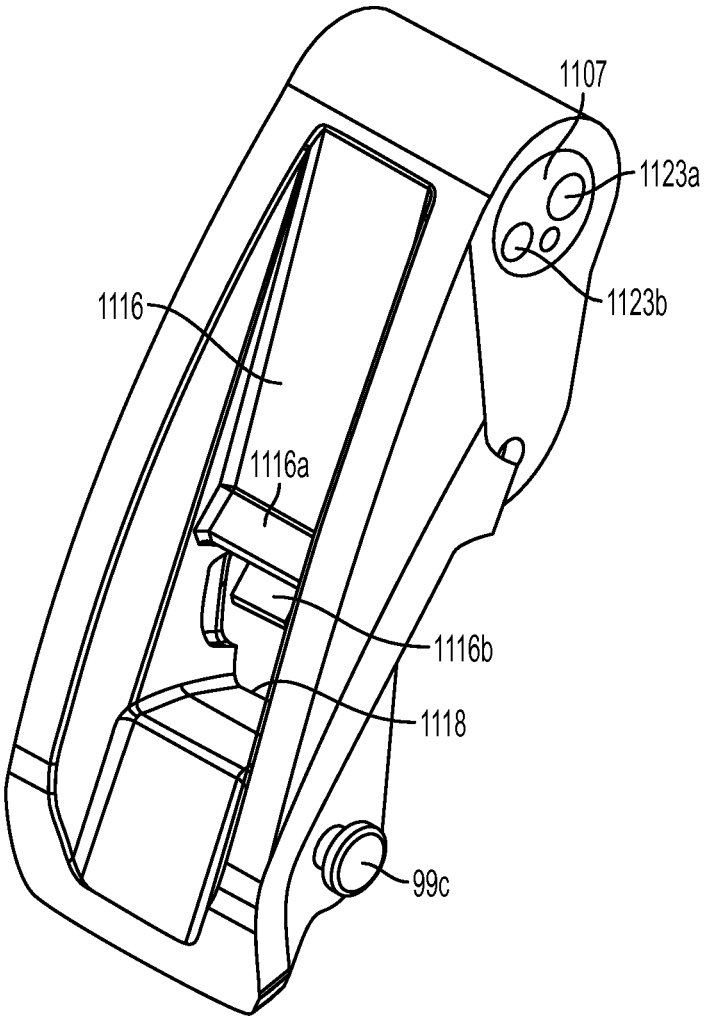
FIG. 44 is an enlarged, front perspective view of the lever for raising the face shield, shown in FIG. 1.
Figure 45:
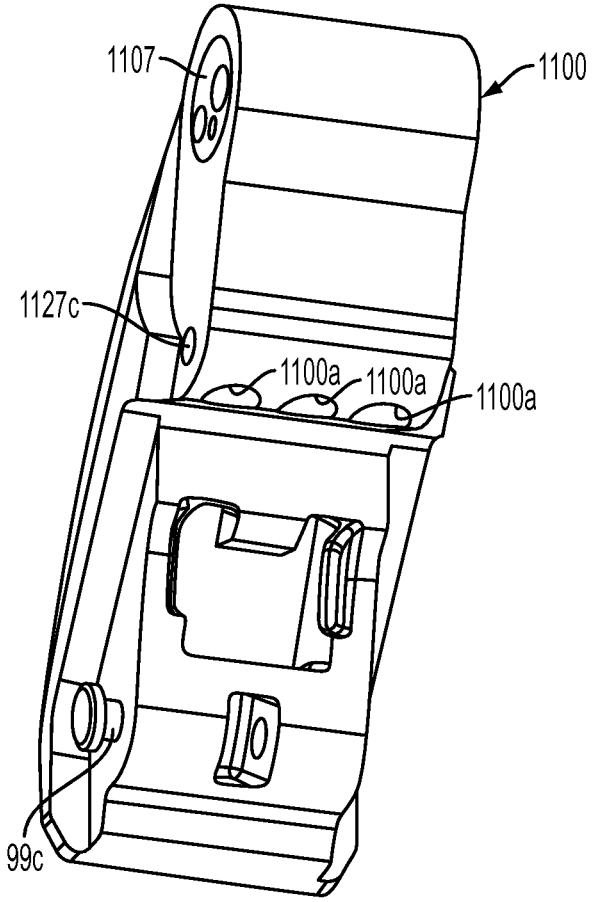
FIG. 45 is a rear perspective view of the lever shown in FIG. 44.
Figure 46:
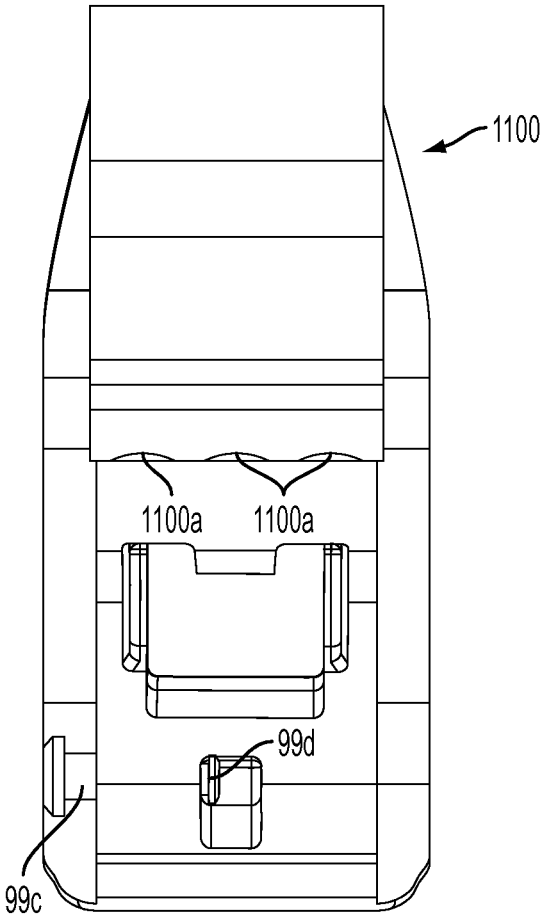
FIG. 46 is a rear view of the lever shown in FIG. 45.

The pivot pin 1107 includes two recesses 1126*a*, 1126*b* at two spaced apart, circumferential positions. A detent mechanism 1127 is shown in FIGS. 41 and 43. The detent mechanism includes three spring mechanisms 1127*a* arranged in parallel. Each mechanism includes a compression spring 1127*b* that urges a ball 1127*c* toward the pivot pin 1107. All the compression springs are braced by a backing through pin 1127*d*. The compression spring 1127*b* and the ball 1127*c* are captured within a cylindrical passage 1100*a* formed in the lever 1100, by the backing pin 1127*d* and the pivot pin 1107. When installed, the springs 1127*b* are pre-compressed between the backing pin 1127*d* and the pivot pin 1107 to the degree necessary to allow the balls 1127*c* to be urged into the appropriate recess 1126*a*, 1126*b* when the recess presents itself to the balls 1127*c* upon rotation of the lever 1100 with respect to the pivot pin 1107. The balls 1127*c* fit into the recess 1126*a* when the face shield is moved slightly away from the helmet and mandible to allow for increased ventilation, and fit into the recess 1126*b* when the face shield 38, 138 is pivoted into the raised, non-use position (FIG. 32). The engagement between the detent mechanism 1127 and either of the recesses 1126*a*, 1126*b* provides a resilient hold that can be overcome by force from the wearers hand to pivot the face shield.

The face shield is operable with one hand to raise and lower the face shield. One finger depresses the latch 1122 as the rest of the band lifts the face shield to a raised position. The face shield can be lowered with one hand and the latch is self engaging.

Figure 34:
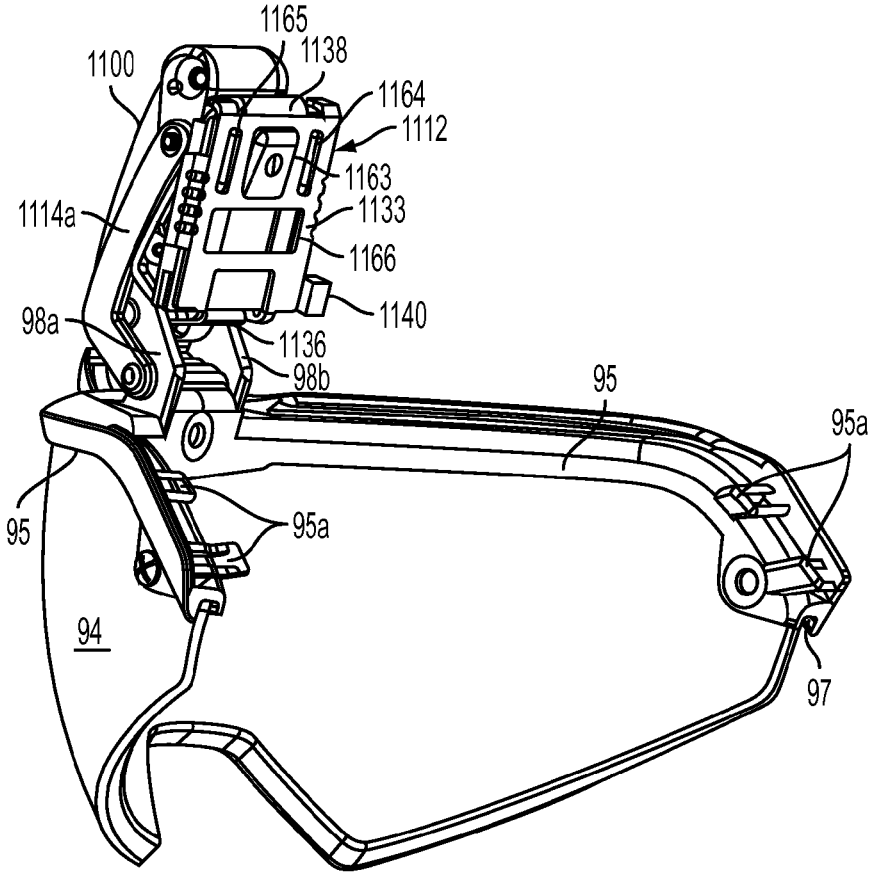
FIG. 34 is a rear perspective view of a face shield portion of a portion of the mounting arrangement shown in FIG. 33.
Figure 38A:
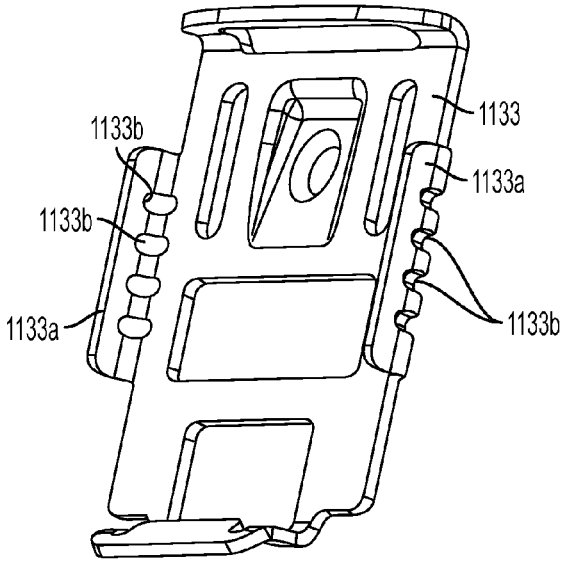
FIG. 38A is a perspective view of a portion of a mounting arrangement baseplate.
Figure 38B:
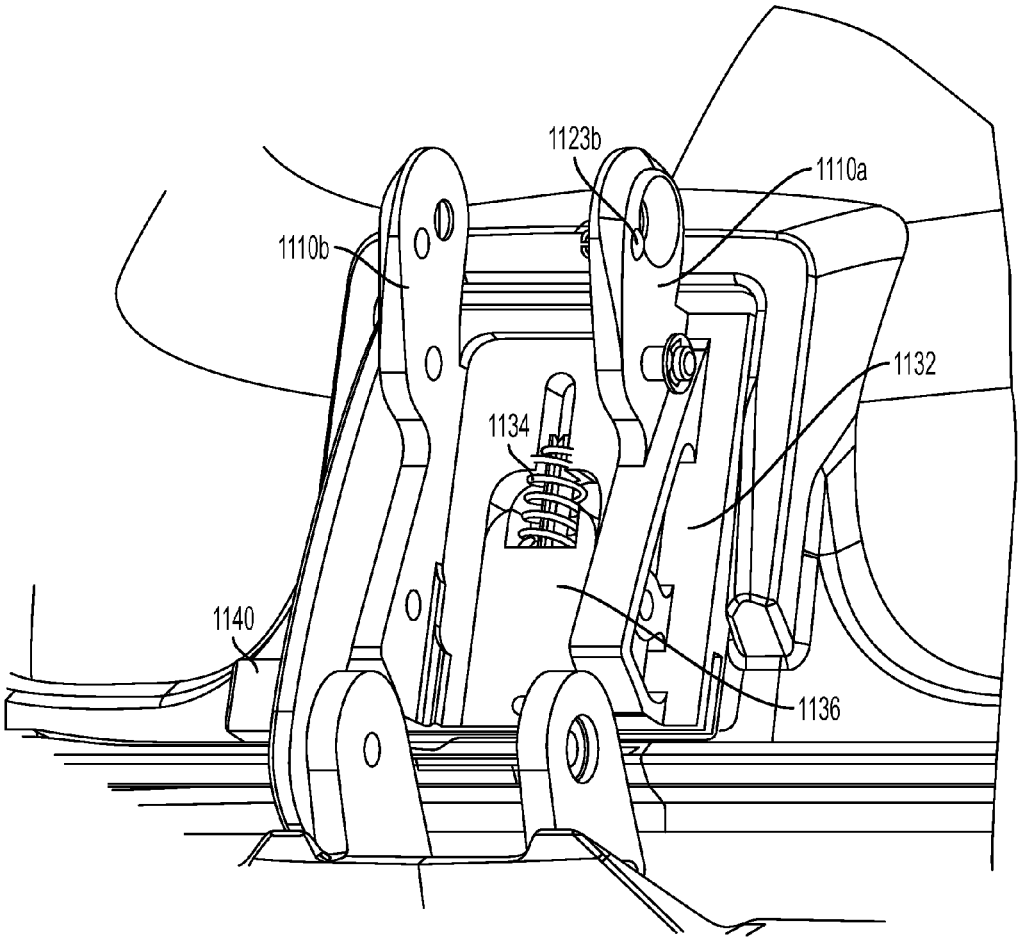
FIG. 38B is a perspective view of the mounting arrangement with portions removed for explanation of underlying features.
Figure 38C:
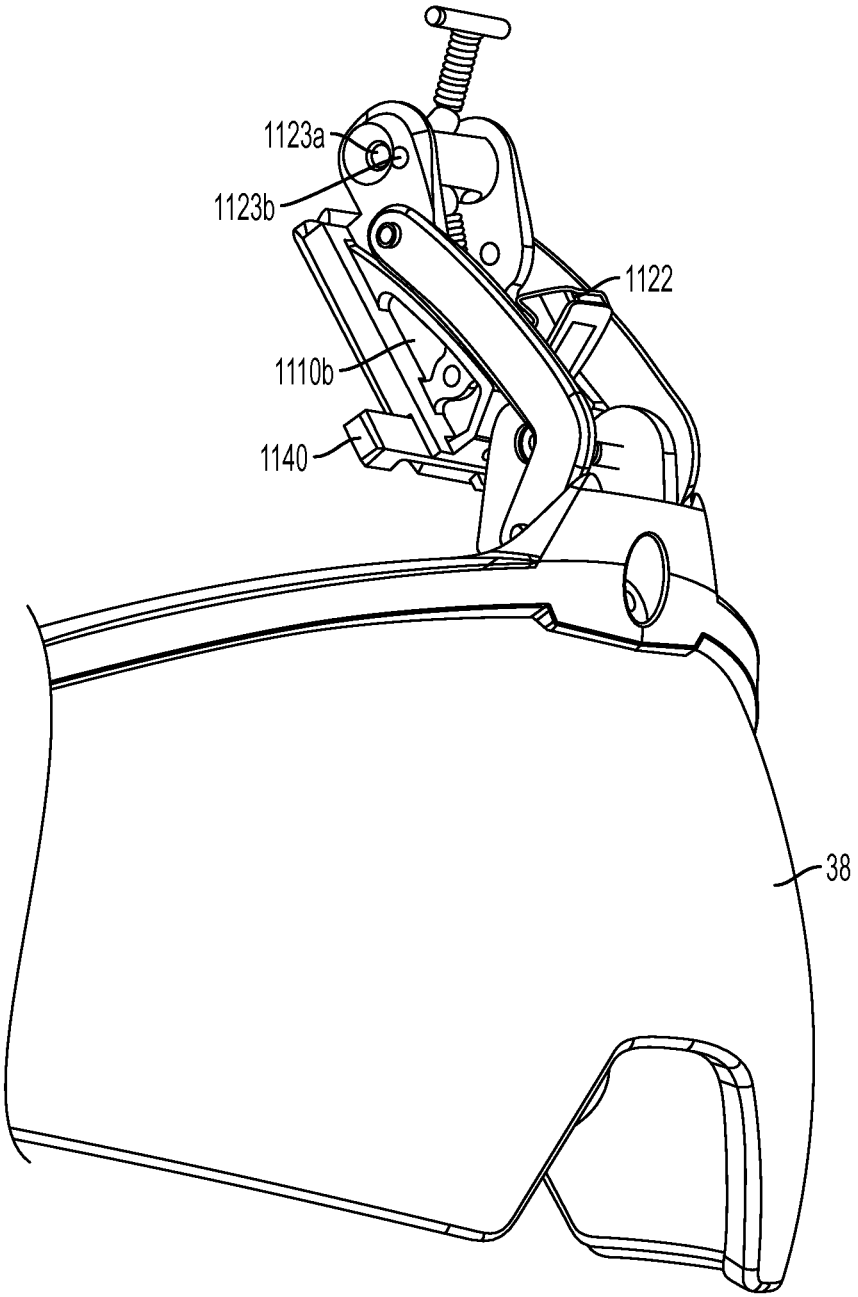
FIG. 38C is a perspective view of the mounting arrangement with portions removed for explanation of underlying features.

FIG. 38B shows the baseplate 1112 includes a main body portion 1132, a backing plate 1133 (FIG. 38A), a spring 1134, and a latching tongue 1136. The main body portion 1132 includes an upper edge 1138 (FIGS. 34 and 37). The spring 1134 biases the latching tongue 1136 in a direction away from the upper edge 1138. A handle 1140 is connected to the latching tongue through a side clearance within the main body portion 1132.

The backing plate 1133 is a metal piece and includes side walls 1133*a* having holes 1133*b* which allow resin of the main body portion 1132 to flow through the holes during overmolding to integrate the backing plate 1133 with the main body portion 1132.

The mount 144 includes a top front formation or central accessory mount 1144 (FIG. 35) that includes an inverted U-shaped retainer portion 1148, surface depressions 1150, 1152, 1154, 1156, 1158, a top slot 1160 and a bottom slot 1162. The surface depressions 1150-1158 are sized and shaped to receive protrusions 1163, 1164, 1165, 1166 (FIG. 34) on a back of the baseplate 1112.

The front mount 144 includes a top formation or central accessory mount 144*a* that includes an inverted U-shaped retainer portion 144*b*. The top formation 144*a* may have surface depressions, a top slot, and a bottom slot (not shown) such as surface depressions 1150-1158, a top slot 1160 and a bottom slot 1162 of mount 144. The surface depressions may be sized and shaped to receive protrusions 1163, 1164, 1165, 1166 (FIG. 34) on a back of the baseplate 1112. The baseplate 1112 may be supported on ledge 144*c*. In one embodiment the ledge 144*c* may be a latch that is resiliently biased upward to secure the base plate in the retainer portion 144*b*. The ledge 144*c* may have a lip to prevent the forward movement of the base plate 1114.

Figure 35:
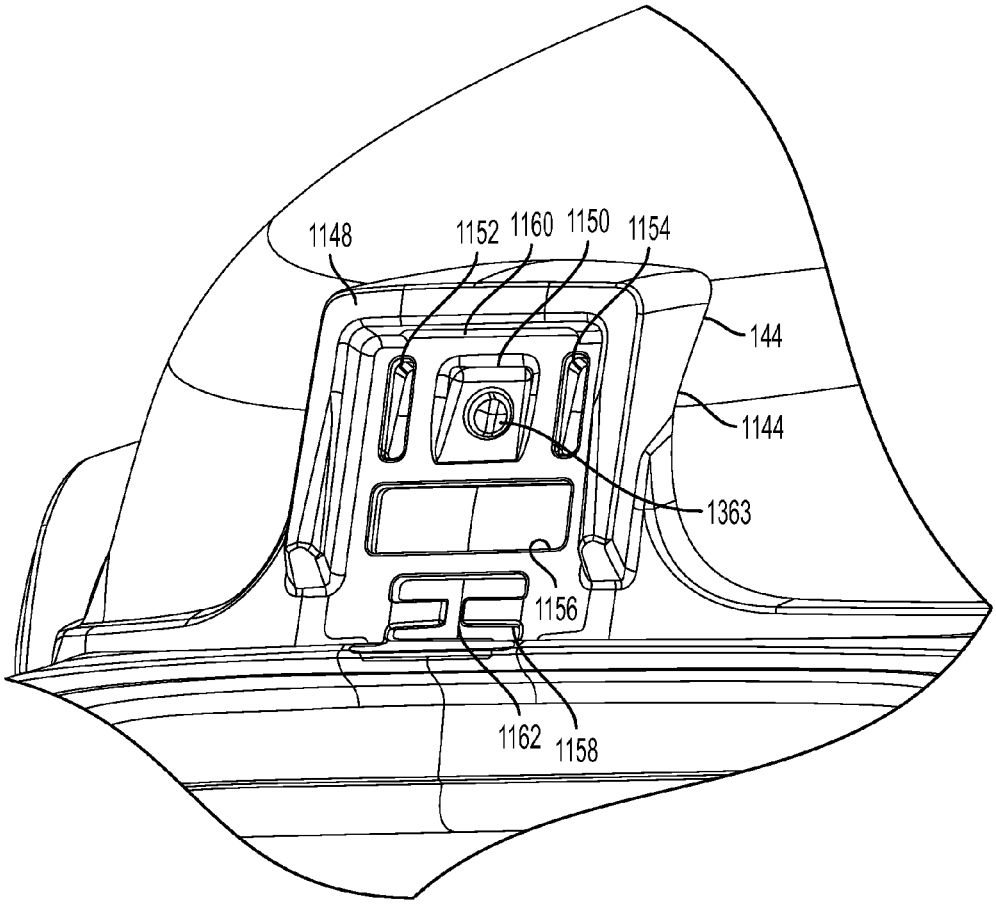
FIG. 35 is an enlarged, fragmentary front perspective view of an alternate front mount on an alternate helmet.

The front mount is also compatible to mount a night vision appliance or night vision goggle. The front mount or front bracket portions are mounted on a helmet 34 using screws 1360, 1362 and a center screw 1363 (FIG. 35).

To mount the baseplate 1112 to and into the formation 1144, the upper edge 1138 is fit into the top slot 1160, the baseplate is fit snugly within the retainer portion 1148 and the tongue 1136 is retracted upwardly by force on the handle 1140 until the tongue can be fit into the bottom slot 1162.

Similarly, to mount baseplate 1112 to and into front mount 144, the upper edge 1138 into the top slot 144*d*, the baseplate is fit snugly within the retainer portion 144*b* and the tongue 1136 is retracted upwardly by force on the handle 1140 until the tongue can be fit into the bottom slot, or secured on the ledge 144*c*.

The face shield frame 95 can also incorporate a removable gasket to seal against the helmet brim to prevent ingress of fluids.

FIG. 34 shows the frame 95 includes frame supports 95*a* that brace against the helmet gasket 240 when the face shield is properly seated. FIGS. 3 and 39 show a contact gasket 101*a* that seals the contact between the frame 101 and the accessory-mounting rim portion such as an accessory-mounting rim portion, such as a halo 200. The gasket 101*a* has a first lip 101*b* that crosses a second lip 101*c* of the gasket at it approaches the lateral edges of the frame 101.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A helmet assembly, comprising:

a helmet having a shell with a front brim and an outside surface;

a front mount attached to a front of the helmet above the front brim, wherein the front mount comprises a center portion positioned along a front-to-back midplane at a front of the helmet, and first and second lateral portions extending laterally in opposite directions away from the front-to-back midplane to locations closer to an ear coverage area than to the center portion of the front mount;

a first anchor protruding from the shell;

the front mount is attached to the helmet via the first anchor and without using any through-holes in the shell;

a ballistic impact resistant face shield, wherein the face shield is movable between a non-use position and a deployed position, and in both the non-use position and the deployed position, the face shield is mounted to the center portion of the front mount.

2. The helmet assembly of claim 1, further comprising a mounting arrangement for supporting the face shield, the mounting arrangement connected to the front mount, the mounting arrangement movable between a deployed position and a standby position.

3. The helmet assembly of claim 1, further comprising:

a mandible guard for protecting a portion of a user's face; and an accessory-mounting rim portion attached along a lower edge of the helmet, said mandible guard mounted to at least a portion of said accessory-mounting rim portion.

4. The helmet assembly of claim 1, wherein the first and second lateral portions comprises at least one bracket portion to permit mounting of accessories on the bracket portion.

5. The helmet assembly of claim 4, wherein the at least one bracket portion comprises edge lips on at least two sides of the at least one bracket portion for retaining an accessory.

6. The helmet assembly of claim 4, wherein the at least one bracket portion comprises edge lips on at least three sides of the bracket portion for retaining an accessory.

7. The helmet assembly of claim 4, wherein the at least one bracket portion comprises, extending in a horizontal direction, a right bracket portion, a left bracket portion and a center portion connecting the right and left bracket portions.

8. The helmet assembly of claim 4, further comprising a center vent through the at least one bracket portion that vents air from inside the helmet to outside the helmet.

9. The helmet assembly of claim 4, wherein the at least one bracket portion comprises at least one rearwardly extending lateral accessory engagement portion arranged for mounting an accessory on a side of the helmet.

10. The helmet assembly of claim 9, wherein the at least one rearwardly extending lateral accessory engagement portion comprises a lateral accessory engagement portion on each side of the helmet, each lateral accessory engagement portion being contiguous with one of the right bracket portion and the left bracket portion respectively.

11. The helmet assembly of claim 4, further comprising a heads-up display releasably securable to the at least one bracket portion.

12. The helmet assembly of claim 11, wherein the face shield is positionable in the deployed position against the helmet and in front of a user's eyes, and the heads-up display has a retractable display screen that is positioned inwardly of the face shield when the heads-up display is secured to the at least one bracket portion and the display screen is in a deployed position.

13. The helmet assembly of claim 11, wherein the face shield is positionable in the deployed position against the helmet and in front of a user's eyes, and the heads-up display includes a display screen which is positioned behind the face shield when the display screen is in the deployed position.

14. The helmet assembly of any of claim 4, wherein the at least one bracket portion comprises edge lips on at least two sides of the at least one bracket portion, and further comprising a heads-up display releasably securable to the at least one bracket portion, wherein the heads-up display comprises upper and lower rail lips that extend vertically in opposite directions and that fit behind upper and lower edge lips of the at least one bracket portion to be releasably secured to the front mount.

15. The helmet assembly of claim 4, further comprising a heads-up display having a recessed area with an engagement rail therein for engaging the at least one bracket portion, wherein the heads-up display has a display screen, the display screen has a deployed position generally in front of a user's eye and a retracted standby position where the display screen is retracted upwardly to withdraw the display screen from the user's view and to withdraw the screen within the heads-up display.

16. The helmet assembly of claim 15, wherein the at least one bracket portion comprises an upper edge lip on an upper edge of the at least one bracket portion and a lower edge lip on a lower edge of the at least one bracket portion, wherein an upper portion of the engagement rail comprises an upward rail lip and a lower portion of the engagement rail comprises a downward rail lip, the upward rail lip engages an inside surface of the upper edge lip of the at least one bracket portion and the downward rail lip engages the inside surface of the lower edge lip of the at least one bracket portion to secure the heads-up display to the front mount, and the heads-up display has a release mechanism configured such that when the release mechanism is activated, the upward rail lip and the downward rail lip draw closer to each other to release the lips from the edge lips of the at least one bracket portion.

17. The helmet assembly of claim 15, wherein the recessed area closely conforms to the at least one bracket portion and allows the heads-up display to position the display screen on an interior side of the face shield, and a center portion of the heads-up display has a curved profile so as to allow an upward movement of the face shield without interference.

18. The helmet assembly of claim 4, wherein the at least one bracket portion comprises edge lips on at least two sides of the at least one bracket portion, and further comprising a heads-up display mounted to the at least one bracket portion, wherein the heads-up display has a base unit and a display screen, and the base unit is supported by a supporting mechanism which includes a first arm having a ball mount connection to a first base, the first base having a thumbscrew, the first base connecting to a connecting cylinder, the connecting cylinder connecting to an attachment base, wherein the thumbscrew tightens or loosens the ball connection to allow the manual manipulation of the position of the base unit, the thumbscrew provides compression friction to secure the ball mount connection in place after the ball mount has been manipulated into a desired position by a user, the attachment base has attaching lips at a top and a bottom engaged with the two edge lips of the at least one bracket portion to secure the heads-up display to the at least one bracket portion.

19. The helmet assembly of claim 4, wherein the at least one bracket portion comprises an upper edge lip and a lower edge lip and a recess portion between the upper and lower edge lips, the upper and lower edge lips extending inwardly toward each other, wherein an accessory can be fit beneath the upper and lower edge lips over the recess portion, to be held behind the edge lips to the bracket portion.

20. The helmet assembly of claim 1, wherein the shell does not have any holes in the outside surface of the shell.

21. The helmet assembly of claim 1, wherein the first anchor is positioned at front, center of the shell.

22. The helmet assembly of claim 21, further comprising second and third anchors positioned to the left and right of the first anchor respectively.

23. The helmet assembly of claim 1, wherein the first anchor is formed into the helmet during manufacture and is permanently affixed to the helmet.

24. A helmet assembly, comprising:

a helmet having a shell with a front brim and an outside surface;

a front mount attached to a front of the helmet above the front brim, wherein the front mount comprises a center portion positioned along a front-to-back midplane at a front of the helmet, and first and second lateral portions extending laterally in opposite directions away from the front-to-back midplane to locations closer to an ear coverage area than to the center portion of the front mount; and the front mount is attached to the helmet without using any holes in the shell;

wherein the first and second lateral portions comprises at least one bracket portion to permit mounting of accessories on the bracket portion;

a heads-up display having a recessed area with an engagement rail therein for engaging the at least one bracket portion, wherein the heads-up display has a display screen, the display screen has a deployed position generally in front of a user's eye and a retracted standby position where the display screen is retracted upwardly to withdraw the display screen from the user's view and to withdraw the screen within the heads-up display;

wherein the at least one bracket portion comprises an upper edge lip on an upper edge of the at least one bracket portion and a lower edge lip on a lower edge of the at least one bracket portion, wherein an upper portion of the engagement rail comprises an upward rail lip and a lower portion of the engagement rail comprises a downward rail lip, the upward rail lip engages an inside surface of the upper edge lip of the at least one bracket portion and the downward rail lip engages the inside surface of the lower edge lip of the at least one bracket portion to secure the heads-up display to the front mount, and the heads-up display has a release mechanism configured such that when the release mechanism is activated, the upward rail lip and the downward rail lip draw closer to each other to release the lips from the edge lips of the at least one bracket portion.

25. A helmet assembly, comprising:

a helmet having a shell with a front brim and an outside surface;

a front mount attached to a front of the helmet above the front brim, wherein the front mount comprises a center portion positioned along a front-to-back midplane at a front of the helmet, and first and second lateral portions extending laterally in opposite directions away from the front-to-back midplane to locations closer to an ear coverage area than to the center portion of the front mount; and the front mount is attached to the helmet without using any holes in the shell;

wherein the first and second lateral portions comprises at least one bracket portion to permit mounting of accessories on the bracket portion; and the at least one bracket portion comprises edge lips on at least two sides of the at least one bracket portion, and further comprising a heads-up display mounted to the at least one bracket portion, wherein the heads-up display has a base unit and a display screen, and the base unit is supported by a supporting mechanism which includes a first arm having a ball mount connection to a first base, the first base having a thumbscrew, the first base connecting to a connecting cylinder, the connecting cylinder connecting to an attachment base, wherein the thumbscrew tightens or loosens the ball connection to allow the manual manipulation of the position of the base unit, the thumbscrew provides compression friction to secure the ball mount connection in place after the ball mount has been manipulated into a desired position by a user, the attachment base has attaching lips at a top and a bottom engaged with the two edge lips of the at least one bracket portion to secure the heads-up display to the at least one bracket portion.

* * * * *